US007151238B2

(12) United States Patent
Kama

(10) Patent No.: US 7,151,238 B2
(45) Date of Patent: Dec. 19, 2006

(54) THERMAL DEVELOPMENT APPARATUS AND THERMAL DEVELOPMENT PROCESS

(75) Inventor: Takeshi Kama, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/927,026

(22) Filed: Aug. 27, 2004

(65) Prior Publication Data

US 2005/0048418 A1 Mar. 3, 2005

(30) Foreign Application Priority Data

Aug. 29, 2003 (JP) ..... P. 2003-307775

(51) Int. Cl.
*G03D 13/00* (2006.01)

(52) U.S. Cl. ..... 219/400; 219/216; 430/353; 399/265; 399/270; 396/575

(58) Field of Classification Search ..... 396/575
See application file for complete search history.

(56) References Cited

U.S. PATENT DOCUMENTS 3,496,332 A * 2/1970 Lunde ..... 219/216
3,585,917 A * 6/1971 Griffith ..... 219/216
3,850,635 A * 11/1974 Leavitt ..... 430/336
4,052,732 A * 10/1977 Meadows ..... 396/575
4,148,575 A * 4/1979 Siryj ..... 219/216
4,198,145 A * 4/1980 Scott ..... 219/216
4,293,212 A * 10/1981 Siryj et al. ..... 219/216
4,371,246 A * 2/1983 Siryj ..... 219/216
5,669,032 A * 9/1997 Islam et al. ..... 219/216

FOREIGN PATENT DOCUMENTS

JP 2000-321743 A 11/2000

* cited by examiner

*Primary Examiner*—Joseph Pelham
(74) *Attorney, Agent, or Firm*—Sughrue Mion, PLLC

(57) ABSTRACT

A thermal development apparatus for thermally developing a thermal developable recording material in a thermal development section, the thermal developable recording material having a latent image formed in advance, wherein the thermal development section has:

a heating member made of a porous body having a gas permeability, the heating member having a heating surface that is disposed so as to face a surface of the thermal developable recording material; and an air feed unit for feeding heated air to the thermal developable recording material through the heating member.

4 Claims, 8 Drawing Sheets

PRIOR ART

THERMAL DEVELOPMENT APPARATUS AND THERMAL DEVELOPMENT PROCESS

This application is based on Japanese Patent application JP 2003-307775, filed Aug. 29, 2003, the entire content of which is hereby incorporated by reference.

BACKGROUND OF THE INVENTION

1. Technical Field of the Invention

The present invention relates to a thermal development apparatus and a thermal development process to be applied to image recording in a dry system using a dry material in which a wet processing is not carried out.

2. Description of the Related Art

In recent years, thermal development apparatus and thermal development recording apparatus by the dry system in which a wet processing is not carried out are proposed. In such thermal development apparatus and thermal development recording apparatus, photosensitive and/or thermosensitive recording materials (hereinafter referred to as "photosensitive/thermosensitive recording materials") and film-shaped recording materials including photothermographic materials (hereinafter referred to as "thermal developable recording materials") are used as a recording medium. Also, in the thermal development apparatus and thermal development recording apparatus by the dry system, a thermal developable recording material is irradiated with laser beams in an exposing section to form a latent image; the thermal developable recording material is then brought into contact with a heating unit in a thermal development section to undergo thermal development; and thereafter, the image-formed thermal developable recording material is discharged out the apparatus. According to such dry system, not only an image can be formed within a short period of time as compared with the wet processing, but also problems of waste liquid treatment involved in the wet processing can be overcome.

As such dry system, there is hitherto known a thermal development recording apparatus shown in FIG. 13. As shown in FIG. 13, a thermal development recording apparatus 100 is provided with a recording material feed section 120, a truing-up section 140, an image exposing section 160 for forming a latent image in a thermal developable recording material F, a thermal development section 180 for thermally developing the thermal developable recording material F, and a power source section 155 and a control section 150 for driving these respective sections in sequence in the traveling course of the thermal developable recording material F.

The thermal developable recording material F is taken out one by one from the recording material feed section 120 and fed into the truing-up section 140. In the truing-up section 140, the recording material F is positioned in the direction rectangular to the traveling direction (this direction being hereinafter referred to as "width direction") and then traveled into the mage exposing section 160 in the downstream side.

The image exposing section 160 is a site for imagewise exposing the thermal developable recording material F upon scan exposure with light beams and is constructed so as to have an exposure unit 146 and a sub-scanning traveling unit 148. The exposure unit 146 is a known light beam scanning device for polarizing light beams L having been pulse width modulated corresponding to a recorded image to the main scanning direction (the width direction of the recording material F) and making them incident into a prescribed recording position. Since the light beams L having been pulse width modulated corresponding to the recorded image are polarized to the main scanning direction, the thermal developable recording material F is two-dimensionally scan exposed by the light beams L to form a latent image.

After forming a latent image in the image exposing section 160, the recording material F is traveled into the thermal development section 180 by traveling rolls 164, 166 and the like. The thermal developable recording material F having been subjected to thermal processing in the thermal development section 180 is sent out into a tray 192 via a discharge roll 191.

Here, the thermal development section 180 is provided with flat plate heaters 181*a*, 181*b*, 181*c* as heating bodies which will reach the temperature necessary for processing the thermal developable recording material F, the plate heaters 181*a*, 181*b*, 181*c* being arranged in the traveling direction of the thermal developable recording material F; transfer units 186, 188 for transferring relatively against the respective plate heaters 181*a*, 181*b*, 181*c* while bringing the thermal developable recording material F into contact with the surface of each of the plate heaters 181*a*, 181*b*, 181*c*; and press rolls 182*a*, 182*b*, 182*c* as units for pressing the back side of the surface of the thermal developable recording material F coming into contact with the respective plate heaters 181*a*, 181*b*, 181*c* for the purpose of conducting heat to the thermal developable recording material F from the plate heaters 181*a*, 181*b*, 181*c* (for example, see JP-A-2000-321743 and so on).

Now, in general, an image forming layer containing an emulsion and the like is formed on the both surfaces of the thermal developable recording material F. In the thermal development section 180 of the related art thermal development recording apparatus 100, since the thermal developable recording material F is transferred in the traveling direction while pressing on the plate heaters 181*a*, 181*b*, 181*c* by the press rolls 182*a*, 182*b*, 182*c*, the surface of the thermal developable recording material F is in friction at the upper surfaces of the plate heaters 181*a*, 181*b*, 181*c*. Accordingly, there was room for an improvement in view of the matter that the image forming layer containing an emulsion and the like is peeled.

SUMMARY OF THE INVENTION

Under these circumstances, the invention has been made, and its object is to provide a thermal development apparatus and a thermal development process capable of preventing peeling of an image forming layer processed on the surface of a thermal developable recording material.

The foregoing object of the invention is achieved by the following description of (1) to (13).

(1) A thermal development apparatus for thermally developing a thermal developable recording material having a latent image formed therein in advance in a thermal development section, the thermal development section being provided with a heating member made of a porous body having aligned therein a heating surface so as to be faced opposite to the surface of the thermal developable recording material and having gas permeability and an air feed unit for feeding heated air into the thermal developable recording material through the heating member.

According to this thermal development apparatus, since heated air is blown to the thermal developable recording material from the air feed unit through the heating member made of a porous body, the thermal developable recording material can be thermally developed upon contact with this heated air. At this time, air to be blown lies between the thermal developable recording material and the heating surface of the heating member; the thermal developable recording material becomes in the state that it is heated in the non-contact state with the heating member so that the thermal developable recording material can be avoided from traveling in the state that it is brought into direct contact with a heating unit such as plate heaters as in the related art; and it is possible to prevent the image forming layer formed in the surface side to be heated of the thermal developable recording material from peeling caused due to sliding with the heating unit.

Also, it is not necessary to provide traveling units such as the press rolls 182*a*, 182*b*, 182*c* as in the related art thermal development recording apparatus 100 shown in FIG. 13. By omitting such traveling units, not only it is possible to make the whole of the apparatus small, but also it is possible to cut the costs regarding the traveling units.

(2) The thermal development apparatus as set forth above in (1), wherein a pressure chamber, a part of which is provided with the heating member, and a blower for feeding air into the pressure chamber are provided.

According to this thermal development apparatus, air can be fed into the pressure chamber by the blower; and since the air fed into the pressure chamber passes through a heating member constructing the pressure chamber and is blown to the thermal developable recording material, by heating the thermal developable recording material in the non-contact state with the heating member, it is possible to prevent the image forming layer formed in the surface side to be heated of the thermal developable recording material from peeling caused due to sliding with the heating unit.

(3) The thermal development apparatus as set forth above in (2), wherein an air heating unit for heating air within the pressure chamber by heating the pressure chamber is provided.

This thermal development apparatus is constructed such that by heating the pressure chamber by the air heating unit, air within the pressure chamber is heated and that by blowing this heated air to the thermal developable recording material from the heating member, the thermal developable recording material is thermally developed without bringing into direct contact with the heating member.

(4) The thermal development apparatus as set forth above in (2), wherein an air heating unit for heating air sent from the blower and feeding the heated air into the pressure chamber is provided.

This thermal development apparatus is constructed such that by heating the air fed from the blower, feeding the heated air into the pressure chamber, and blowing it to the thermal developable recording material through the heating member, the thermal developable recording material can be thermally developed without bringing into direct contact with the heating member.

(5) The thermal development apparatus as set forth above (1), wherein a pressure reducing machine for sucking air within the pressure chamber and adsorbing the thermal developable recording material onto the heating surface is provided.

According to this thermal development apparatus, the pressure within the pressure chamber is reduced to render an internal pressure lower than the external atmosphere, thereby generating an air flow going from the outside of the pressure chamber towards the inside of the pressure chamber through the heating member that is a porous body, and air between the thermal developable recording material and the heating surface is sucked to bring the thermal developable recording material into contact with the heating surface and heat it, whereby the thermal developable recording material can be thermally developed. Also, after completion of the thermal development, the actuation of the pressure reducing machine is released to stop sucking, and the thermal developable recording material can be traveled in the state that it is again floated up by air to be blown out.

(6) The thermal development apparatus as set forth above in (1), wherein the plural number of the heating members are provided such that the heating surfaces are opposed to each other via the thermal developable recording material.

According to this thermal development apparatus, by feeding air heated from the both of the opposing heating surfaces, heating can be performed uniformly from the both surfaces in the thermal development recording material having an image forming layer provided on the both surfaces thereof, and therefore, it is possible to perform thermal development with good efficiency. Also, it is possible to prevent the generation of unevenness in density surely.

Also, since the thermal developable recording material is regulated at the intermediate position between the both heating surfaces by the pressure of air to be fed from the heating surfaces, it is not necessary to specially provide a guide or the like for keeping the position at which the thermal developable recording material is traveled. Therefore, it is possible to more simplify the traveling mechanism of the thermal developable recording material.

(7) The thermal development apparatus as set forth above in any (1) to (6), wherein the heating surface is provided horizontally.

According to this thermal development recording apparatus, since the heating surface is provided horizontally, by blowing air heated from the heating member, the thermal developable recording material is floated substantially in parallel to the heating surface, whereby it can be thermally developed without bringing into direct contact with the heating member.

(8) The thermal development apparatus as set forth above in any one of (1) to (6), wherein the heating surface is provided in the oblique or vertical state against the horizontal direction, and a stopper for stopping the thermal developable recording material at the position opposing to the heating surface is provided.

According to this thermal development apparatus, since the heating surface is kept in the oblique or vertical state against the horizontal direction, the thermal developable recording material moves by its self-weight along the surface direction. In this way, even when a traveling mechanism such as traveling rolls is not provided specially, the thermal developable recording material can be thermally developed by heating and moving in such a manner that it does not come into contact with the heating member. Also, since the stopper is provided, the thermal developable recording material can be properly heated at the heating position in the state that it is once stopped. Accordingly, it is possible to prevent the movement of the thermal developable recording material towards the downstream side of the traveling direction in the state that it is not sufficiently heated.

(9) The thermal development apparatus as set forth above in any one of (1) to (6), wherein the plural number of the thermal development sections are provided along the traveling direction of the thermal developable recording material.

According to this thermal development apparatus, by setting up the respective thermal development sections along the traveling course so as to have a different temperature step by step by distinguishing them for pre-heating and real heating, it is possible to prevent the generation of wrinkles in the thermal developable recording material caused by abrupt heating.

(10) A thermal development apparatus for thermally developing a thermal developable recording material having a latent image formed therein in advance in a thermal development section, the thermal development section being provided with a porous member provided with a heated air feed surface opposing to the surface of the thermal developable recording material and having gas permeability and a heated air feed unit for feeding heated air into the thermal developable recording material through the porous member.

According to this thermal development apparatus, since heated air is blown to the thermal developable recording material from the heated air feed unit through the porous member, air to be blown lies between the thermal developable recording material and the heated air feed surface of the porous member; the thermal developable recording material becomes in the non-contact state with the porous member; and the thermal developable recording material can be thermally developed upon contact with the heated air. At this time, since the thermal developable recording material and the porous member are in the non-contact state with each other, in traveling the thermal developable recording material before and after the thermal development, it is possible to prevent the image forming layer from peeling caused due to sliding of the surface to be heated and the porous member.

(11) A thermal development process of thermally developing a thermal developable recording material having a latent image formed therein in advance, which comprises heating the thermal developable recording material in the non-contact state with the porous member by blowing heated air to the thermal developable recording material from a porous member having gas permeability.

According to this thermal development process, since heated air is blown on the thermal developable recording material through the porous member having gas permeability, the thermal developable recording material can be thermally developed upon contact with this heated air. At this time, air to be blown lies between the thermal developable recording material and the porous member; the thermal developable recording material is heated in the non-contact state with the porous member; and the thermal developable recording material is free from traveling in the state that it is brought into direct contact with a heating unit such as plate heaters as in the related art. Accordingly, it is possible to prevent the image forming layer formed in the surface side to be heated of the thermal developable recording material from peeling caused due to sliding with the porous member, etc.

(12) A thermal development process of once stopping traveling of a thermal developable recording material having a latent image formed therein in advance and thermally developing the thermal developable recording material, which comprises sucking air through a heating member made of a porous body having gas permeability to bring the thermal developable recording material into contact with the heating member, thereby performing thermal development.

According to this thermal development process, by sucking air between the thermal developable recording material and the heating member and bringing the thermal developable recording material into contact with the heating surface due to a change of the pressure of air generated at this time, air is blown to the thermal developable recording material through the heating member after thermal development upon heating, whereby the thermal developable recording material can be traveled in the non-contact state with the heating member. Also, it is possible to prevent the image forming layer of the thermal developable recording material from peeling caused due to sliding with the heating member.

(13) The thermal development process as set forth above in (12), wherein the thermal developable recording has the plural number of regions of that is divided along the traveling direction, and the thermal developable recording material is successively thermally developed therein.

According to this thermal development process, since the thermal developable recording material is successively thermally developed in every region of the thermal development section divided into the plural number along the traveling direction, it is possible to make the size of the heating member in the thermal development section small, whereby the thermal development apparatus can be made small in size. Also, in the case where the thermal developable recording material in which the size of the thermal development traveling direction is long is thermally developed using this thermal development process, the thermal developable recording material can be thermally developed by successively heating every region of the plural number of image regions divided in such a manner that a joint between the images to be developed is a boundary.

According to the invention, it is possible to provide a thermal development apparatus and a thermal development process capable of preventing an image forming layer processed on the surface of a thermal developable recording material from peeling.

BRIEF DESCRIPTION OF THE INVENTION

DETAILED DESCRIPTION OF THE INVENTION (First Embodiment)

The embodiments of the thermal development apparatus and the thermal development process according to the invention will be described below in detail with reference to the accompanying drawings. Incidentally, in the following description, with respect to members and the like having equivalent constructions and actions to those as already described, their descriptions are simplified or omitted.

Figure 1:
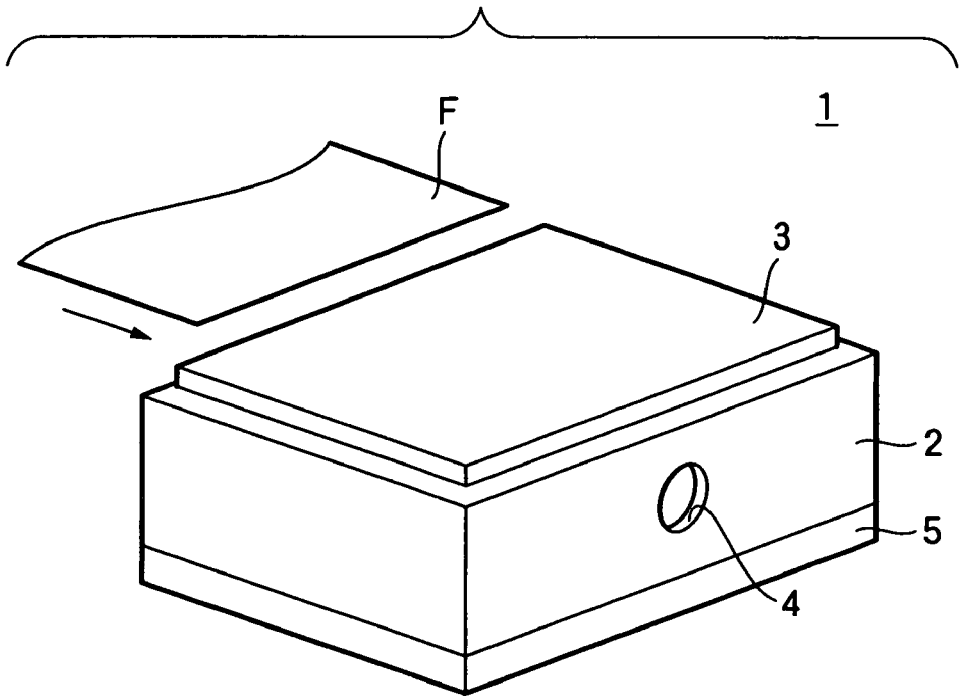
FIG. 1 is an entire perspective view to show the thermal development section of the thermal development apparatus according to the invention.
Figure 2:
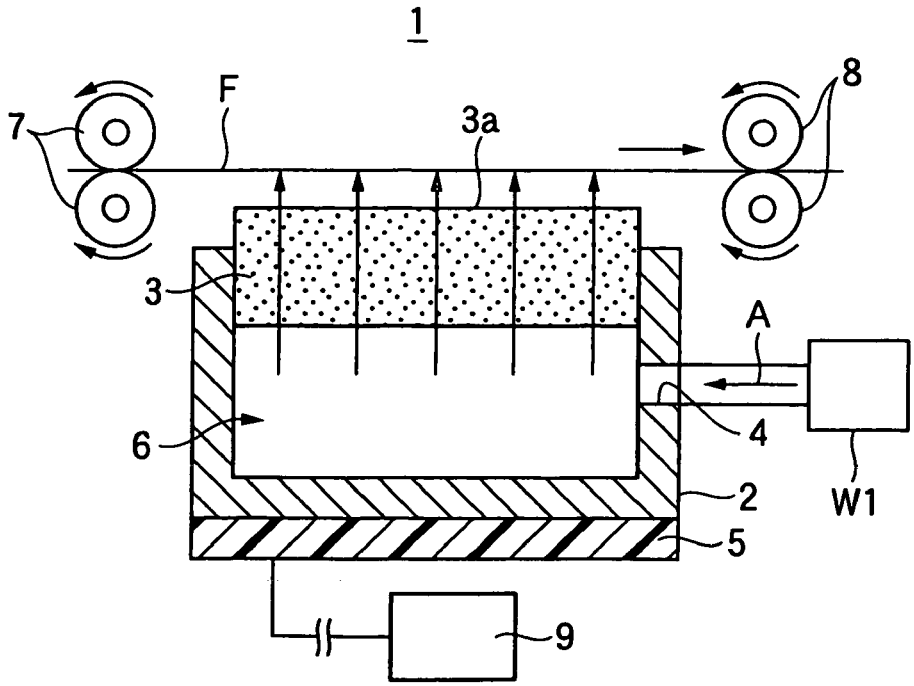
FIG. 2 is a cross-sectional view of the thermal development section.

FIG. 1 is an entire perspective view to show a thermal development section to be used in a thermal development apparatus of the First Embodiment according to the invention. FIG. 2 is a cross-sectional view of the thermal development section shown in FIG. 1 in the state that it is seen in the width direction (the vertical direction against the traveling direction of a thermal developable recording material).

As shown in FIGS. 1 and 2, a thermal development section 1 is provided with an aluminum-made box body 2, a heating member provided on the upper surface of the box body 2, and a box body heating section 5 aligned such that it comes into contact with the lower surface of the box body 2. The box body heating section 5 functions as an air heating unit. The heating member 3 is provided with a heating surface 3*a* for heating a thermal developable recording material F that passes over the heating member 3. The heating surface 3*a* is aligned in such a manner that it is faced opposite to the surface of the thermal developable recording material F.

Also, the thermal development section 1 is provided with a blower W1. The blower W1 feeds air into the box body 2.

The thermal developable recording material F includes a photothermographic material or a photosensitive/thermosensitive material, and a latent is formed in advance.

The box body 2 is provided with an aperture 4 into which air can be taken from the blower W1 and a pressure chamber 6 capable of accommodating the air to be taken therein. In this Embodiment, the pressure chamber 6 is a space partitioned by the box body 2 and the heating member 3.

Though the material of the box body 2 is not limited to aluminum, it is preferable that the box body 2 is constructed of a material having good heat conductivity.

The box body heating section 5 has a function to heat the box body 2, thereby heating air within the pressure chamber 6. In this Embodiment, a sheet heater such as a rubber heater was used. But, the box body heating section 5 is not limited to the rubber heater. However, when a sheet heater such as a rubber heater is used, by sticking it so as to cover the whole of the lower surface of the box body 2, it is possible to heat the whole of the box body 2 with good efficiency. Also, in the state that the sheet heater is installed in the box body 2, the assembly is not bulky so that it can be suppressed that the apparatus becomes large in size.

A driving section 9 is connected to the box body heating section 5. The driving section 9 makes it possible to switch "ON" or "OFF" of the box body heating section 5 or to set up the heating quantity of the box body heating section 5.

The heating member 3 is made of a porous body having gas permeability, in which a number of fine pores are formed so as to pass air therethrough. It is preferable that the porous body has a pore size of from 10 to 20 μm and a porosity of 10% or more per area of the heating surface 3*a*. As the heating member 3, for example, porous aluminum can be used. The porous aluminum has a structure in which a number of fine pores having from about 12 μm to 15 μm are opened and which does not require vent hole processing. Also, the porous aluminum has good heat conductivity. Also, besides the porous aluminum, sintered metals, SMC, porous ceramics, and the like can be used. However, it is more preferable to use porous aluminum because the material cost can be made low.

In this way, since the heating member 3 is made of a porous body having gas permeability, air that has passed through the heating member 3 can be uniformly blown out from the heating surface 3*a* by the fine pores.

When air within the box body 2 passes through the fine pores of the heating member 3, it is given resistance and also pressurized by air blown from the blower W1. In this way, air within the box body 2 passes through the fine pores of the heating member 3 accompanied by a pressure, is blown out from the heating surface 3*a* of the heating member 3, and comes into contact with the thermal developable recording material F, thereby applying a pressure thereto. Namely, the thermal development section 1 has such a structure that air in the pressure chamber 6 of the box body 2 passes through the inside of the heating member 3 and is blown out towards the upper portion of the box body 2 from the upper surface of the heating member 3, whereby the thermal developable recording material F can be floated. In the invention, the box body 2 functions as an air feed unit.

A heat sink may be provided on the inner wall surface of the box body 2. In this way, heat of the box body 2 is liable to be radiated in the box body 2 by the heat sink, whereby air within the box body 2 can be heated more smoothly.

An action of the thermal development section 1 will be described.

As shown in FIG. 2, by starting the driving section 9 and heating the box body heating section 5, the box body 2 is heated. On the other hand, as shown by an arrow A, air taken from the aperture 4 and accommodated in the pressure chamber 6 is heated by absorbing heat from the heated box body 2. The heated air is blown out from the heating surface 3*a* via the porous heating member 3.

At this time, since the heated air is uniformly blown out from the fine pores in the heating surface 3*a*, it can uniformly heat the surface to be heated of the thermal developable recording material F. In this way, it is possible to perform uniform thermal development without generating unevenness in density in the thermal developable recording material F.

Incidentally, when the development time is about 14 seconds, air to be blown out from the heating surface 3*a* has a temperature of about 120° C. or higher and a pressure of from 1.5 atm to 5 atm.

The thermal developable recording material F objective to the thermal treatment is traveled in the vicinity of the upper portion of the heating surface 3*a* of the heating member 3. As shown in FIG. 2, the thermal developable recording material F is traveled from traveling rolls 7 of one side to traveling rolls 8 of the other side in such a manner that the thermal developable recording material F moves in the position of the upper surface 3*a* of the heating member 3 at a slight gap of not more than 3 mm or from about 0.1 mm to 3 mm. At this time, in the thermal development section 1, the thermal developable recording material F is traveled by the traveling rolls 7 and 8, and as described previously, air heated from the heating surface 3*a* is blown onto the surface of the thermal developable recording material F, whereby the thermal developable recording material F is thermally developed.

According to the thermal development section 1, by blowing heated air onto the thermal developable recording material F, it can be avoided that the thermal developable recording material F slides while coming into contact with the heating member 3. In this way, in carrying out the thermal treatment, the image forming layer containing an emulsion and the like as formed on the surface of the thermal developable recording material F does not cause peeling.

Figure 13:
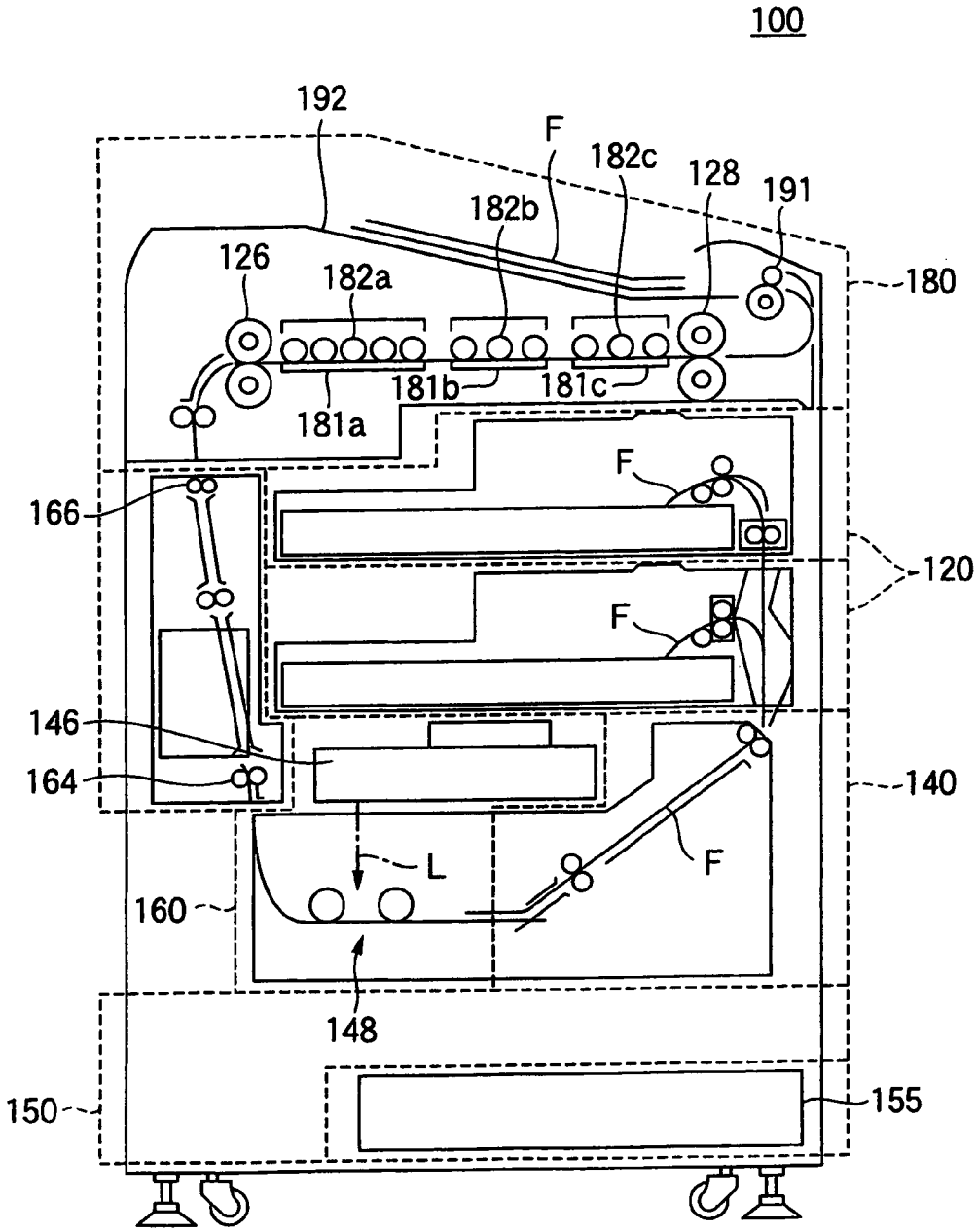
FIG. 13 is a view to show the related art thermal development recording apparatus.

Also, by constructing the heating member 3 using a porous body, since the flow amount of air to be blown out from the heating surface 3*a* becomes uniform in the surface direction of the heating surface 3*a*, it is possible to uniformly heat the surface to be heated of the thermal developable recording material F. Since the thermal development section of the related art thermal development recording apparatus shown in FIG. 13 is constructed in such a manner that the thermal developable recording material F is heated upon direct contact with the plate heaters, the thermal developable recording material F as thermally developed likely generated unevenness in density because of the matter that sites at which it came into contact with the plate heaters and sites at which it did not come into contact with the plate heaters were formed due to wrinkles or the like of the thermal developable recording material F. According to the thermal development section 1 of this Embodiment, since heated air is brought into contact with the thermal developable recording material F by uniformly blowing it onto the entire surface to be heated of the thermal developable recording material F, it is possible to thermally develop the thermal developable recording material F uniformly without generating unevenness in density therein.

Figure 3:
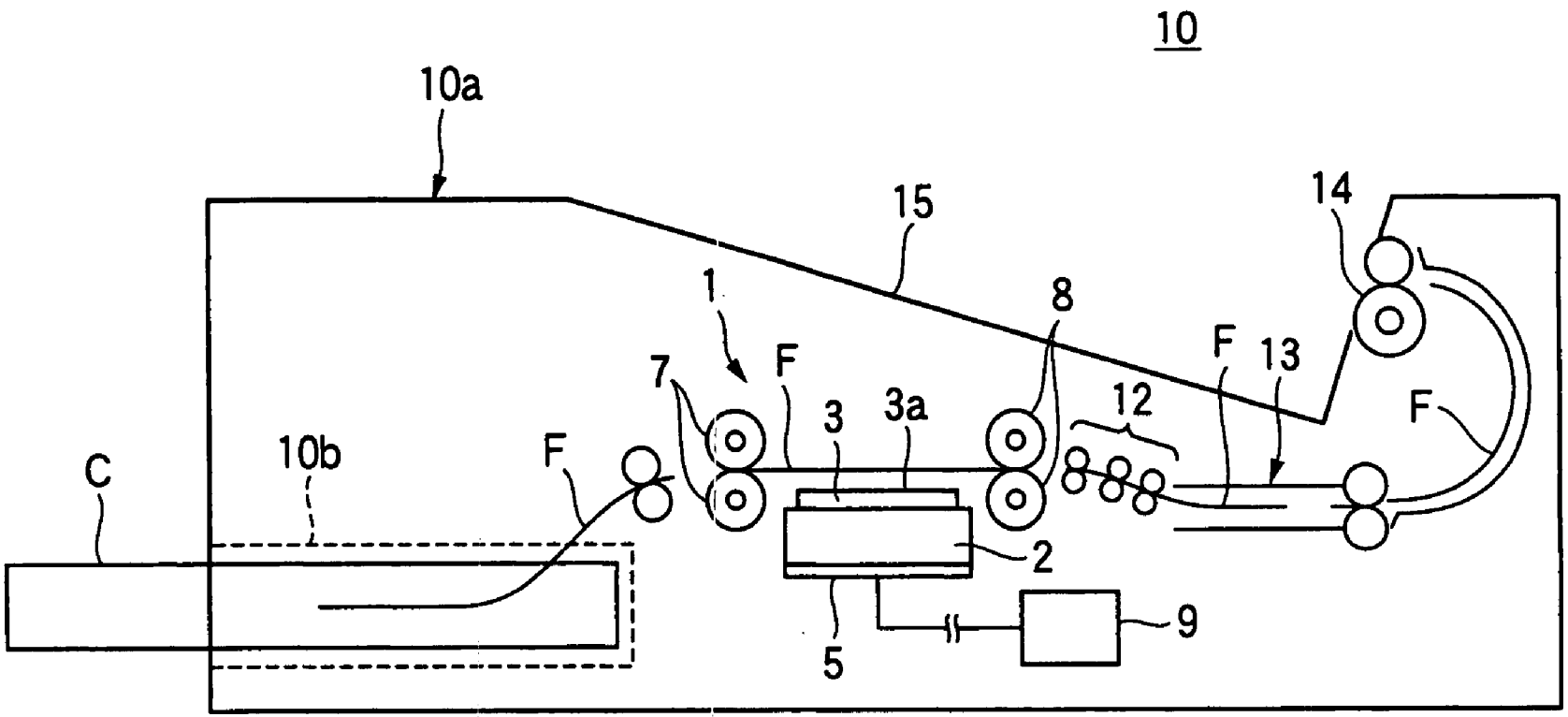
FIG. 3 is a view to show the First Embodiment of the thermal development apparatus according to the invention.

FIG. 3 is an explanatory view to show the First Embodiment of the thermal development apparatus and the thermal development process according to the invention.

As shown in FIG. 3, in a thermal development apparatus 10 of this Embodiment, the thermal developable recording material F having a latent image formed therein in advance and including a photothermographic material or a photosensitive/thermosensitive recording material is thermally developed by the thermal development section.

Figure 4:
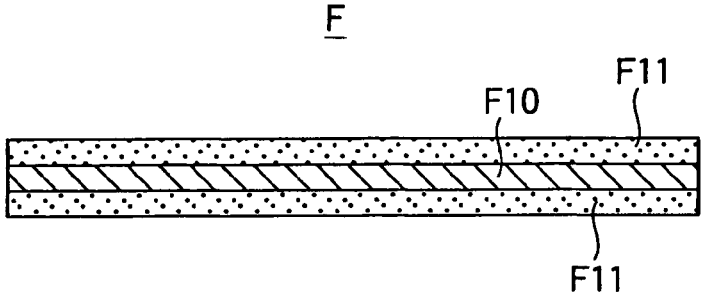
FIG. 4 is a schematic cross-sectional view to show the thermal developable recording material.

FIG. 4 is a schematic cross-sectional view to show the thermal developable recording material F to be used in the thermal development apparatus 10 shown in FIG. 3. The thermal developable recording material F is roughly constructed of a substrate F10 and emulsion-containing image forming layers F11 formed on the both surfaces of the substrate F10.

As shown in FIG. 3, the thermal development apparatus 10 is provided with a main body 10*a*; a cassette insertion section 10*b* into which a cassette C for holding the thermal developable recording material F objective to the thermal development; the thermal development section 1 for thermally developing the thermal developable recording material F taken out from the cassette C as inserted in the cassette insertion section 10*b*; traveling rolls 12 for traveling the thermal developable recording material F as thermally developed; a cooling section 13 for properly cooling the thermal developable recording material F as thermally developed; a discharge roll 14 for discharging the thermal developable recording material F out the main body 10*a*; and a tray 15 for holding the thermal developable recording material F discharged from this discharge roll 14.

Also, in the thermal development apparatus 10, the construction of the thermal development section 1 is the same as that as already explained in FIGS. 1 and 2.

As already described, the foregoing thermal development apparatus 10 is constructed in such a manner that in the thermal development section 1, by blowing heated air onto the thermal developable recording material F to be traveled continuously from the box body 2 as an air feed unit via the porous heating member, the thermal developable recording material F is floated and thermally developed. In this way, since a step of traveling the thermal developable recording material F while bringing it into direct contact with a heating unit such as plate heaters as in the related art is not required, the image forming layer of an emulsion and the like as formed in the side of the surface to be heated of the thermal developable recording material F does not cause peeling due to sliding with the heating unit.

Also, according to the thermal development apparatus 10, it is possible to omit a traveling unit such as press rolls, as required for traveling the thermal developable recording material F while pressing it onto a heating unit such as plate heaters as in the related art thermally developable recording apparatus as already described. By omitting the traveling unit, not only it is possible to make the whole of the apparatus small, but also it is possible to cut the costs regarding the traveling units.

In the thermal development apparatus 10 according to the invention, though the heating member 3 is made of a porous body, it is possible to provide a porous member in place of the heating member 3. That is, even when the thermal development apparatus 10 takes a construction in which previously heated air is fed into the box body 2 from the blower W1 and blown onto the thermal developable recording material F via the porous member and a construction in which air is heated in the box body 2, and this heated air is blown onto the thermal developable recording material F via the porous member, or either one of these constructions, the same effects can be obtained. In these constructions, the porous member is provided with a heated air feed surface opposing to the thermal developable recording material F, and air heated from the box body functioning as a heated air feed unit is blown onto the thermal developable recording material F from the heated air feed surface of the porous member. At this time, since it is not necessary to specially provide a heating device for heating the porous member, it can be avoided that the thermal development section becomes large in size.

By employing the construction of providing the heating member 3 and heating air fed from the box body 2 as in this Embodiment, it is possible to conduct heat of the heating member 3 itself into the thermal developable recording material F by the air fed from the box body 2, and therefore, it is possible to heat the thermal developable recording material F with good efficiency.

Incidentally, in the thermal development apparatus of the Embodiments as described later, there can be employed a construction of providing a porous member in place of the heating member and blowing heated air onto the thermal developable recording material F via the porous member in the same way. Also, there may be employed a construction of sending heated air into the heating member 3 as in the foregoing Embodiment and blowing heated air onto the thermal developable recording material F from the heating surface 3*a* while further heating by the heating member 3.

Next, other embodiments of the thermal development apparatus and the thermal development process according to the invention will be described below with reference to FIGS. 5 to 11.

(Second Embodiment)

Figure 5:
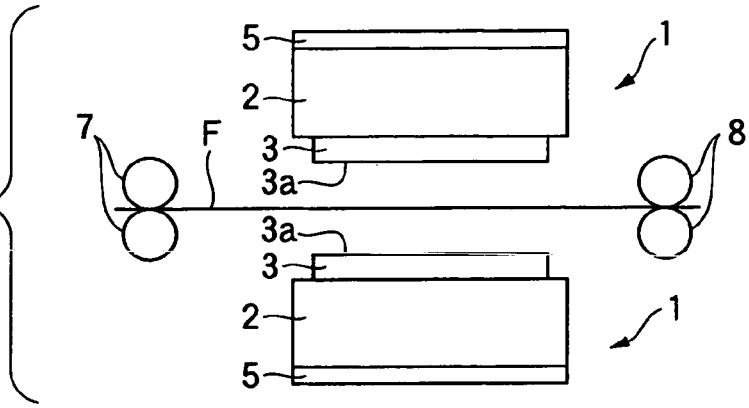
FIG. 5 is a view to show the Second Embodiment of the thermal development apparatus according to the invention.

FIG. 5 shows a thermal development section in the Second Embodiment of the thermal development apparatus and the thermal development process. This Embodiment shows a construction in which two thermal development sections 1 are provided in the upper and lower sides, and the respective heating surfaces 3*a* are opposed to each other via the thermal developable recording material F.

In this way, since air heated from the respective heating surfaces 3*a* is blown onto the both surfaces of the thermal developable recording material F, it is possible to perform thermal development by heating the thermal developable recording material F more uniformly.

Also, it becomes possible to uniformly heat the respective image forming layers F11 provided on the both surfaces in the thermal developable recording material F shown in FIG. 4.

Further, since the thermal developable recording material F is regulated at the intermediate position between the both heating surfaces 3*a* by the pressure of air to be fed from the heating surfaces 3*a*, it is not necessary to specially provide a guide or the like for keeping the position at which the thermal developable recording material F is traveled. Therefore, it is possible to more simplify the traveling mechanism of the thermal developable recording material F.

(Third Embodiment)

Figure 6:
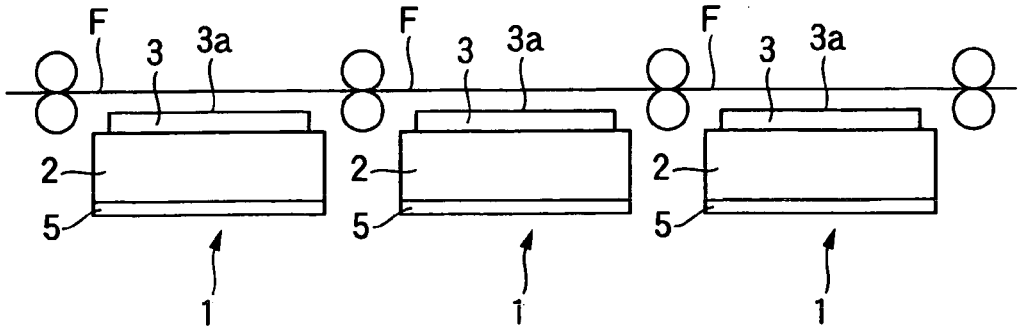
FIG. 6 is a view to show the Third Embodiment of the thermal development apparatus according to the invention.

FIG. 6 shows a thermal development section in the Third Embodiment of the thermal development apparatus and the thermal development process. This Embodiment shows a construction in which the plural number of thermal development sections 1 are provided along the traveling direction of the thermal developable recording material F, and air is blown onto the thermally developable material F from each of the heating surfaces 3*a*.

In this way, by setting up the respective thermal development sections 1 along the traveling course so as to have a different temperature step by step by distinguishing them for pre-heating and real heating, it is possible to prevent the generation of wrinkles in the thermal developable recording material F caused by abrupt heating.

Incidentally, in the construction of FIG. 6, there may be employed a construction in which the plural number of thermal development sections 1 are provided along the traveling direction of the thermal developable recording material F, and as shown in FIG. 5, a pair of the upper and lower thermal development sections 1 are aligned in such a manner that the respective heating surfaces 3*a* are opposed to each other via the thermal developable recording material F. In this way, it is possible to thermally develop the thermal developable recording material F more efficiently. Also, the thermal development sections 1 to be aligned in the upper and lower sides may be aligned in the staggered offset state against the traveling direction of the thermal developable recording material F.

(Fourth Embodiment)

Figure 7:
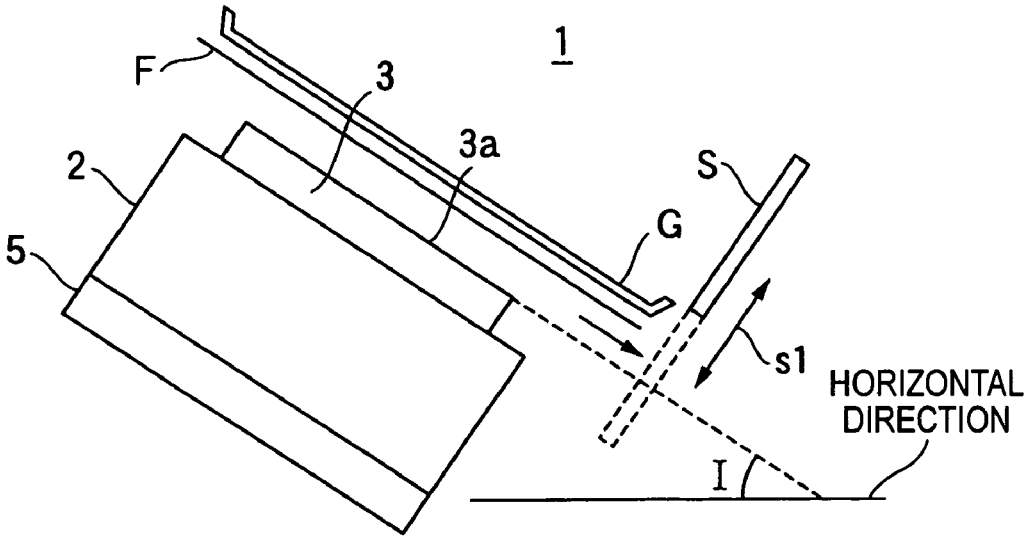
FIG. 7 is a view to show the Fourth Embodiment of the thermal development apparatus according to the invention.

FIG. 7 is an explanatory view to show a thermal development section in the Fourth Embodiment of the thermal development apparatus and the thermal development process. The thermal development section 1 of this Embodiment is constructed in the state that the surface direction of the heating surface 3*a* is inclined by an angle I against the horizontal direction. Also, the thermal development section 1 is provided with a stopper S. The stopper S is constructed in such a manner that it is opened and closed in the direction of an arrow s1 shown in FIG. 7 so as to stop the thermal developable recording material F at the thermal development position. In this way, the thermal developable recording material F does not slide on the heating surface 3*a* by air to be blown from the heating surface 3*a* and moves in the lower side of the surface direction of the heating surface 3*a* due to its self-weight. Thus, it is not required to provide the traveling rolls 7 and 8 in the thermal development section 1 shown in FIGS. 2 to 4, and therefore, it is possible to more simplify the construction by omitting these traveling rolls 7 and 8.

Here, at the time of thermal development, when the stopper S is in the closed state as shown by a broken line in FIG. 7, the thermal developable recording material F is engaged in the stopper S. At this time, the position at which the stopper S is closed is constructed in such a manner that the surface to be heated of the thermal developable recording material F is positioned opposite to the heating surface 3*a* of the heating member 3. Further, after the thermal development, when the stopper S moves in the arrow s1 direction and is in the opened state, the thermal developable recording material F moves to the downstream side of the traveling direction.

Incidentally, as shown in FIG. 7, a guide G for regulating the position of the moving thermal developable recording material F may be provided.

(Fifth Embodiment)

Figure 8:
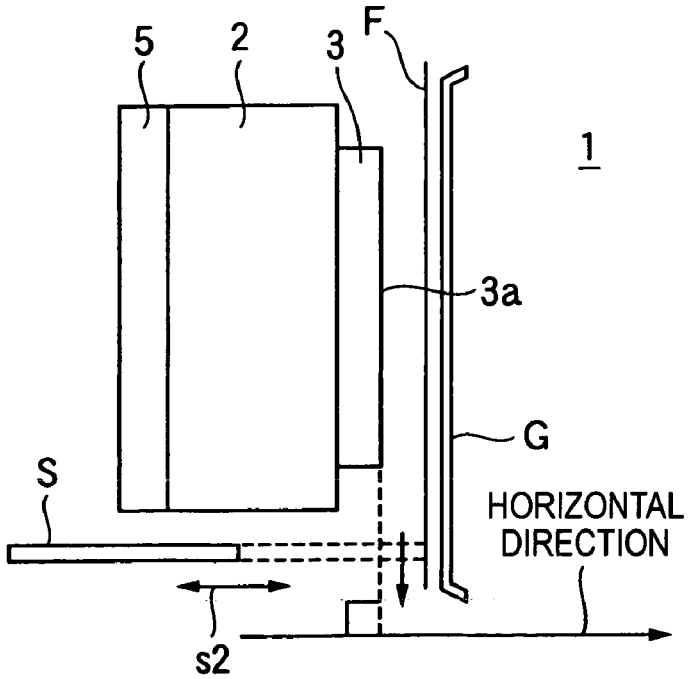
FIG. 8 is a view to show the Fifth Embodiment of the thermal development apparatus according to the invention.

FIG. 8 shows a thermal development section in the Fifth Embodiment of the thermal development apparatus and the thermal development process.

The heat development section 1 of this Embodiment is constructed in such a manner that the surface direction of the heating surface 3*a* is vertical against the horizontal direction. Also, the thermal development section 1 is provided with the stopper S having the same construction as in the foregoing Fourth Embodiment. In the state that the stopper S is closed as shown by a broken line in FIG. 8, the thermal developable recording material F is thermally developed by air heated from the heating surface 3*a* while regulating the thermal developable recording material F such that it does not drop. Further, after completion of the thermal development, the stopper S is released in the direction shown by an arrow s2 in the drawing, and the thermal developable recording material F drops down. Thus, it is not required to specially provide traveling rolls for traveling the thermal developable recording material F, and therefore, it is possible to more simplify the construction.

In the thermal development sections shown in FIGS. 7 and 8, there may be employed a construction in which only the heating surface 3*a* is properly inclined against the box body 2. Also, the plural number of the thermal development sections 1 are aligned along the traveling direction in the state that the respective heating surfaces 3*a* have a different angle I of inclination depending upon the traveling course of the thermal developable recording material F. In this way, it is possible to more simplify the traveling mechanism.

Also, there may be employed a construction in which the heating surface 3*a* is provided in the oblique or vertical state against the horizontal direction as in the thermal development sections shown in FIGS. 7 and 8, and the plural number of the thermal development sections are aligned in such a manner that the heating surfaces are opposed to each other as described in the foregoing Embodiments. In this way, it is possible to thermally develop the thermal developable recording material F having the image forming layers F11 provided on the both surfaces thereof with good efficiency.

(Sixth Embodiment)

Figure 9:
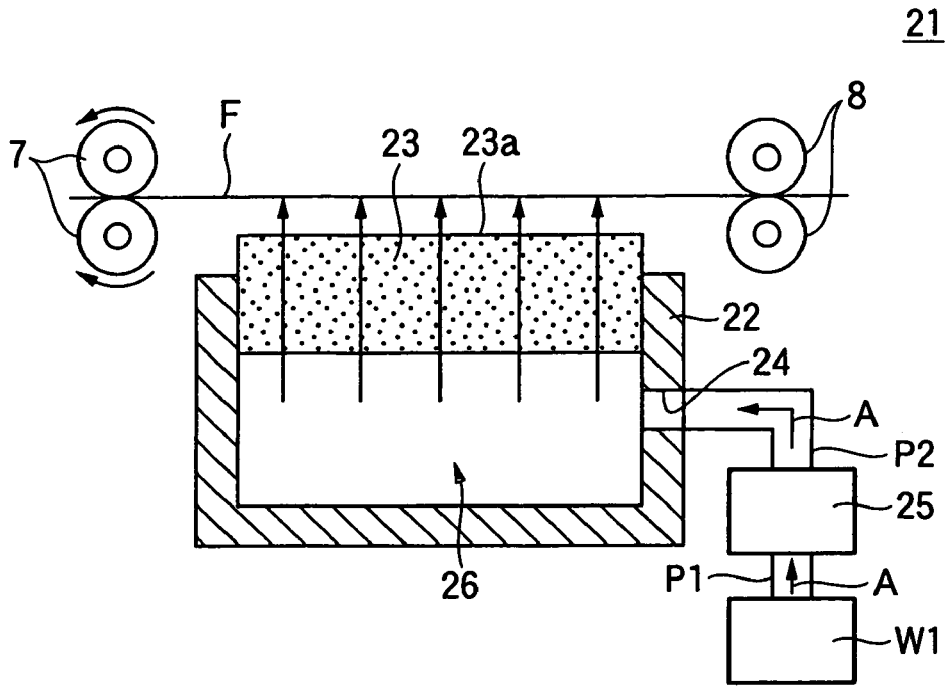
FIG. 9 is a view to show the Sixth Embodiment of the thermal development apparatus according to the invention.

FIG. 9 shows a thermal development section in the Sixth Embodiment of the thermal development apparatus and the thermal development process. A thermal development section 21 shown in FIG. 9 is constructed in such a manner that air as already heated is blown onto a thermal developable recording material F from a heating surface 23*a* while feeding it into a pressure chamber 26. Concretely, the thermal development section 21 has a construction in which the box body heating section 5 shown in FIGS. 1 and 2 is not provided, but instead, a heater 25 functioning as an air feed unit is provided between a boxy body 22 and a blower W1. In this thermal development section 21, air fed from the blower W1 via an air feed pipe P1 as shown by an arrow A is heated by the heater 25, and the heated air is fed into the pressure chamber 26 from an aperture 24 of the box body 22 via an air feed pipe P2 and blown onto the thermal developable recording material F from the heating surface 23*a*, thereby thermally developing the thermal developable recording material F. This construction can also give rise to the same effects as in the foregoing Embodiments. Also, the thermal development apparatus of this Embodiment is not required to install a heating mechanism for heating air in a box body (air feed unit) as in the box body heating section 5 shown in FIG. 1 and the like therein.

(Seventh Embodiment)

Figure 10:
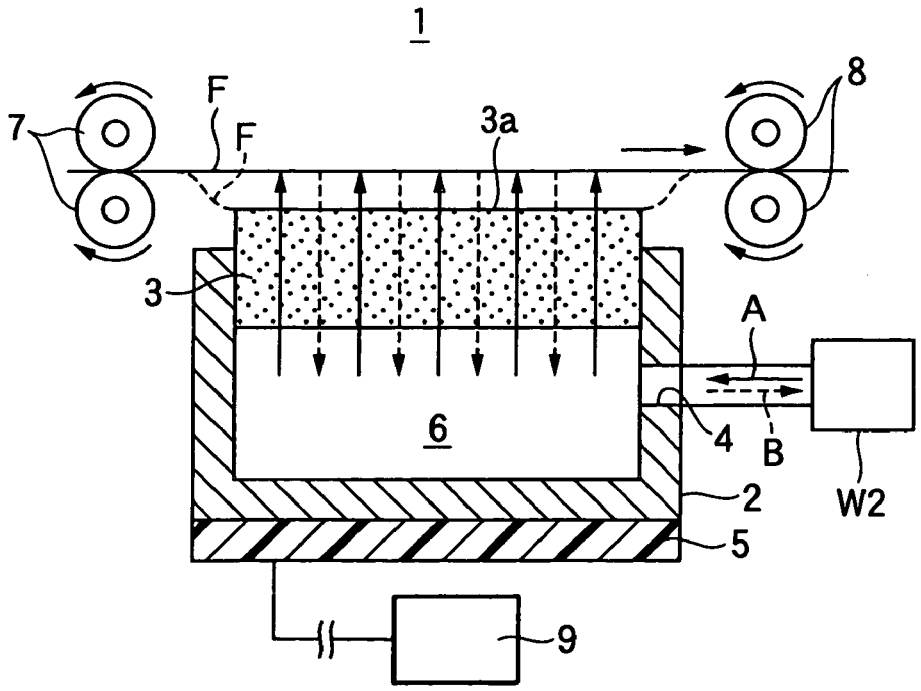
FIG. 10 is a view to show the Seventh Embodiment of the thermal development apparatus according to the invention.
Figure 11:
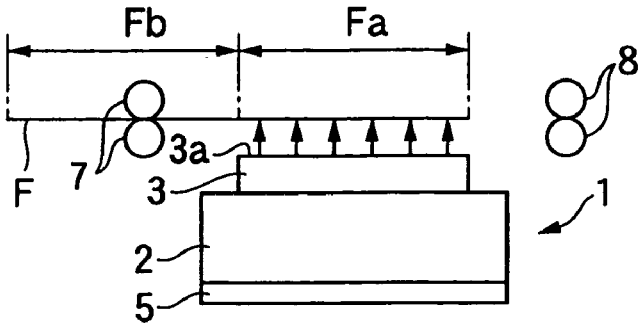
FIG. 11 is a view to show the Eighth Embodiment of the thermal development apparatus according to the invention.
Figure 11:
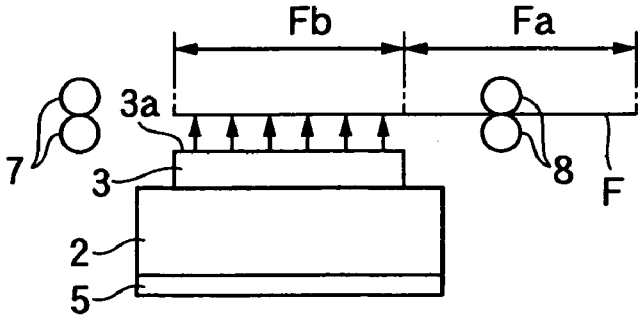

FIG. 10 shows a thermal development section in the Seventh Embodiment of the thermal development apparatus and the thermal development process. The thermal development section 1 shown in FIG. 10 is constructed in such a manner that not only air can be fed from an arrow A in the drawing, heated in the box body 2 and blown onto the thermal developable recording material F via the heating member 3, but also air in the box body 2 can be sucked as shown by an arrow B in the drawing, thereby reducing the pressure in the box body 2. Concretely, the thermal development section 1 is provided with a pressure reducing device W2 for sucking air within the pressure chamber 6 such that the pressure within the pressure chamber 6 is lower than the external atmosphere of the pressure chamber 6 by reducing the pressure within the pressure chamber 6. Incidentally, in this Embodiment, though the thermal development section 1 is constructed in such a manner that the pressure reducing device W2 also has a function as a blower the same as in the foregoing Embodiments, there may be employed a construction in which the pressure reducing device and the blower are provided individually.

By reducing the pressure in the box body 2 by the pressure reducing device W2 to make the internal pressure of the pressure chamber 6 low as compared with the external pressure of the box body 2, an air flow going inward the box body 2 from the external atmosphere via the heating member 3 as shown by arrows shown by broken lines in the drawing is generated, air between the heating surface 3*a* and the thermal developable recording material F is drawn, and the thermal developable recording material F becomes in the adsorbed state onto the heating surface 3*a*. By employing the construction of the Embodiment, it is possible to omit the driving mechanism for bringing the thermal development section 1 close to or far from the thermal developable recording material F as in the thermal development apparatus 1 shown in FIG. 9.

(Eighth Embodiment)

FIG. 11A and FIG. 11B each shows a thermal development section in the Eighth Embodiment of the thermal development apparatus and the thermal development process. The thermal development section 1 shown in FIG. 11A and FIG. 11B is constructed in such a manner that a front-side portion Fa and a rear-side portion Fb of the traveling direction in the thermal developable recording material F are successively thermally developed. Regarding the movement of the thermal development apparatus of this Embodiment, the traveling rolls 7 are first rotated to travel the thermal developable recording material F, and the traveling rolls 7 are stopped in the state that the front-side portion Fa reaches a prescribed position in the upper side of the heating surface 3*a*. The front-side portion Fa is then thermally developed, and thereafter, the traveling rolls 7 and 8 are driven to travel the thermal developable recording material F. The front-side portion Fa is traveled to the downstream side of the traveling direction by the traveling rolls 8, the traveling rolls 7 are stopped in the state that the rear-side portion Fb reaches a prescribed position in the upper side of the heating surface 3*a*, and the rear-side portion Fb is thermally developed. In this Embodiment, the process of the thermal development section 1 at the time of thermal development is the same as that described in the foregoing Embodiments. Namely, the thermal developable recording material F may be thermally developed by blowing air heated from the heating member 3. Alternatively, the thermal developable recording material F may be thermally developed by heating upon bringing it into contact with the heating surface 3*a* by reducing the pressure of the pressure chamber 6 within the box body 2 in the state that traveling of the thermal developable recording material F is stopped and sucking air between the thermal developable recording material F and the heating surface 3*a* of the heating member 3, as shown in FIG. 10.

In this way, since the size of the heating surface 3*a* of the heating member in the thermal development section 1 can be made small, it is possible to make the thermal development apparatus small in size. Also, by employing this thermal development process, even in the case of thermally developing the thermal developable recording material F in which the dimension of the thermal development traveling direction is long, it is possible to divide the thermal developable recording material into the plural number of regions and thermally develop it every region. At this time, with respect to the position of the thermal developable recording material F to be divided, by defining a space between the images to be developed as a boundary of each region, it is possible to prevent the generation of a joint mark caused by a difference in density of the images after the thermal development.

Incidentally, in the invention, the thermal development section in the thermal development apparatus and thermal development processes of the foregoing Embodiments can be applied to a thermal development recording apparatus.

Figure 12:
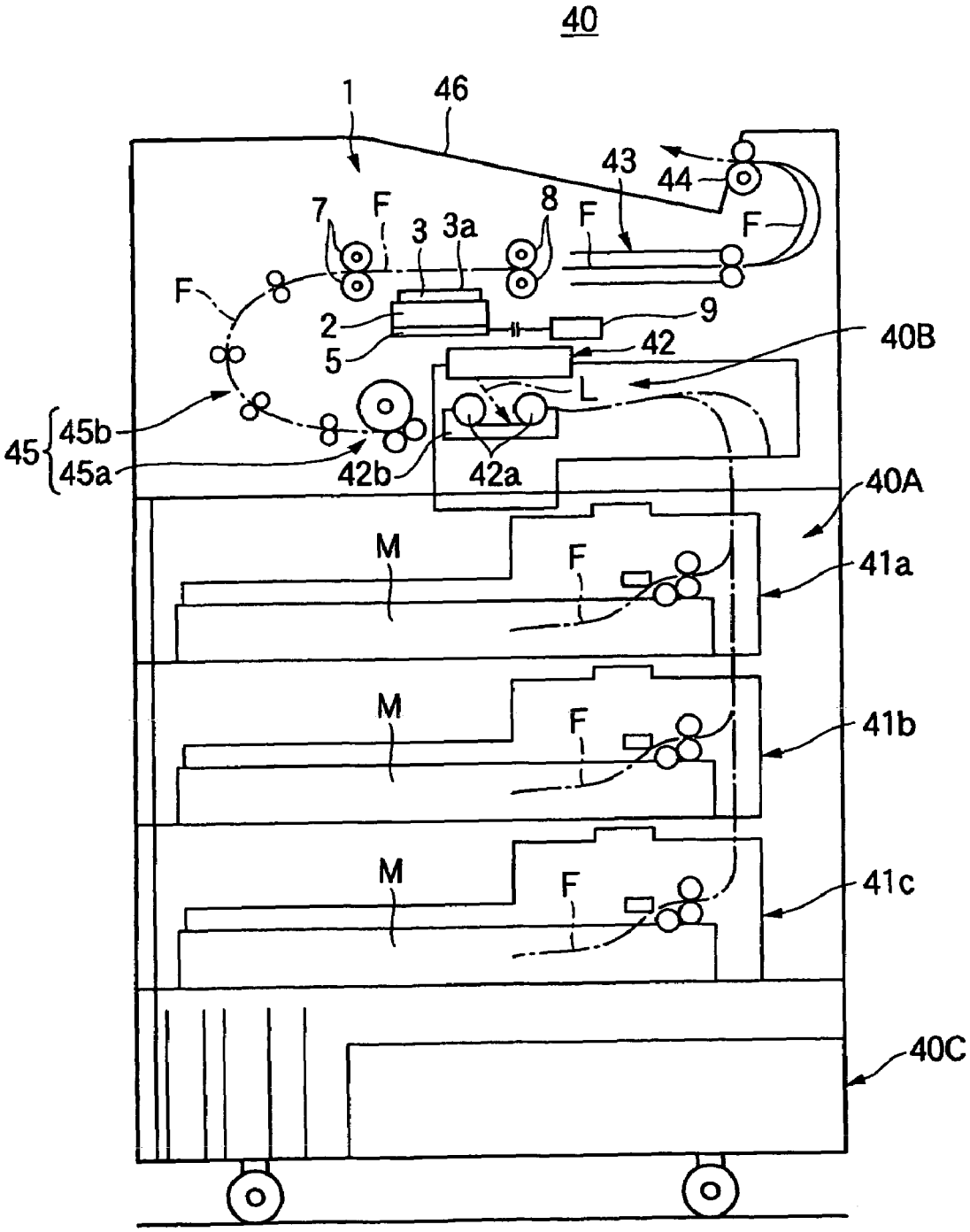
FIG. 12 is a view to show the thermal development apparatus according to the invention.

FIG. 12 is an explanatory drawing to show a thermal development recording apparatus according to the invention.

As shown in FIG. 12, according to a thermal development recording apparatus 40, a thermal developable recording material F including a photothermographic material or a photo-sensitive/thermosensitive recording material is exposed with laser beams L to form a latent image in the thermal developable recording material F, and the thermal developable recording material F having a latent image formed therein is thermally developed by a thermal development section 1.

In the thermal development recording apparatus 40 of the Embodiment, the thermal development section 1 is the same as in the foregoing Embodiments.

Concretely, the thermal development recording apparatus 40 is provided with a thermal development recording material feed section 40A, an image exposing section 40B, a traveling mechanism 45 for traveling the exposed thermal developable recording material F to the downstream side of the traveling direction, a thermal development section 1 for thermally developing the thermal developable recording material F, a cooling section 43 for properly cooling the thermal developable recording material F after the thermal development, a discharge roll 44, and a tray 46 into which the thermal developable recording material F is discharged in that order in the traveling direction of the thermal developable recording material F. Also, the thermal development recording apparatus 40 is provided with traveling units for traveling the thermal developable recording material F, each of which is provided between the respective sections, and a power source/control section 40C for driving and controlling the respective sections. The thermal development recording apparatus 40 of the Embodiment is constructed in such a manner that the power source/control section 40C is aligned in the lowermost portion thereof; that the thermal development recording material feed section 40A is aligned in the upper side of the power source/control section 40C; that the image exposing section 40B, the thermal development section 1 and the cooling section 43 are aligned in the upper side of the thermal development recording material feed section 40A; and that the image exposing section 40B and the thermal development section 1 are aligned adjacent to each other. According to this construction, since the exposure step and the thermal development step can be carried out within a short traveling distance, it is possible to make the traveling path length of the thermal developable recording material F shortest and to shorten an output time per one sheet of the thermal developable recording material. Also, it is possible to perform the both steps of the exposure step and the thermal development step simultaneously against one sheet of the thermal developable recording material F.

The thermal development recording material feed section 40A is a section for taking out the thermal developable recording material F one by one from a magazine M and feeding it into the image exposing section 40B. The thermal development recording material feed section 40A is provided with three-stage loading sections 41*a*, 41*b*, 41*c*, in the vertical direction and feed rolls, traveling rolls and a traveling guide aligned in each of the loading sections 41*a*, 41*b*, 41*c*. In the loading sections 41*a*, 41*b*, 41*c*, the magazines M each containing thermal developable recording materials having a different size or direction (for example, a B4 size and a size of 14 inch×17 inch) are respectively inserted, and the thermal developable recording materials of these magazines can be selectively used as the need arises.

The image exposing section 40B is provided with a guide plate 42*b* on the surface of which the thermal developable recording material F slides and moves, two driving rolls 42*a* for traveling the thermal developable recording material F while pressing it onto the upper surface of the guide plate 42*b*, and a scan exposing section 42 for scan exposing the thermal developable recording material F with light beams L between the two driving rolls 42*a*.

The traveling mechanism 45 is provided with traveling rolls 45*a* for traveling the thermal developable recording material F having been exposed by the image exposing section 40B into the thermal development section 1 and guide rolls 45*b* for guiding the thermal developable recording material F into traveling rolls 7 in the thermal development section 1.

In the thermal development recording apparatus 40, since the thermal development section 1 is constructed in such a manner that heated air is blown onto the thermal developable recording material F via a heating member 3 made of a porous body from a box body 2 that is an air feed unit, it is possible to thermally develop the thermal developable recording material F by blowing heated air. In this way, since it is not necessary to perform a step of traveling the thermal developable recording material while bringing it into direct contact with a heating unit such as plate heaters as in the related art, an image forming layer containing an emulsion and the like formed in the side of the surface to be heated of the thermal developable recording material does not cause peeling due to sliding with the heating unit.

Also, it is possible to omit the press rolls 182*a*, 182*b*, 182*c* for traveling the thermal developable recording material F while pressing it onto the plate heaters 181*a*, 181*b*, 181*c* as in the related art thermal development recording apparatus 100 shown in FIG. 13. Thus, in the thermal development recording apparatus, by omitting the traveling unit for traveling while pressing onto the heating unit, not only it is possible to make the whole of the apparatus small, but also it is possible to cut the costs regarding the traveling units.

Incidentally, the invention is never limited to the foregoing embodiments, but proper deformations, improvements, and the like can be made.

The photothermographic material to be used in the thermal development recording apparatus according to the invention will be described below in detail.

A photosensitive material for photography to be used in this embodiment does not write image information by scan exposure with laser light, etc. but records an image by surface exposure.

In the field of a wet type development photosensitive material, there have hitherto been known double-sided or single-sided photosensitive films (X-ray films) and films for mammography in the medical utility, various plate-making films for printing, industrial recording films, and films for photography by general cameras. For example, double-sided coating type X-ray photothermographic materials utilizing a blue fluorescent intensifying screen (for example, see Japanese Patent No. 3,229,344), photothermographic materials using silver iodobromide tabular grains (for example, see JP-A-59-142539), and medical photosensitive materials comprising a support on the both surfaces of which are coated tabular grains of a high silver chloride content having a (100) main face (for example, see JP-A-10-282606) are disclosed in patent documents. Also, double-sided coating type photothermographic materials are disclosed in other documents (for example, see JP-A-2000-227642, JP-A-2001-22027, JP-A-2001-109101, and JP-A-2002-90941). However, in these known examples, when a finely divided silver halide of not larger than 0.1 μm is used, though the haze is not deteriorated, the sensitivity is low so that the resulting photographic materials are not durable to practical use for photography. On the other hand, in the case where silver halide grains of 0.5 μm or larger are used, deterioration in the image quality due to poor haze by the residual silver halide and poor print-out was serious so that the resulting photographic materials were not durable to practical use.

Photosensitive materials using tabular grains of silver iodide as silver halide grains are known in the field of wet type development (for example, see JP-A-59-119344 and JP-A-59-119350). However, there is not known any example with respect to the application thereof in photothermographic materials. This is because as described previously, the sensitivity is low, an effective sensitizing measure is not known, and technical barriers further increase in the thermal development.

In the light of the invention, for the sake of using for photosensitive materials for photography, a higher sensitivity is required, and a higher level in the image quality of the resulting images, such as haze, is required as photothermographic materials.

As photothermographic materials that can meet the foregoing requirements, the following are useful.

1. Photothermographic Material

A photothermographic material of this embodiment has an image forming layer containing a photosensitive silver halide, a non-photosensitive organic silver salt, a reducing agent, and a binder on at least one surface of a support. Also, preferably, it may have a surface protective layer on the image forming layer, or a back layer, a back protective layer, etc. on the opposite surface thereto.

The construction of these respective layers and preferred components thereof will be described below in detail.

(Compound Capable of Substantially Reducing Visible Light Absorption Derived from Photosensitive Silver Halide after Thermal Development)

In this embodiment, it is preferred to contain a compound capable of substantially reducing visible light absorption derived from a photosensitive silver halide after thermal development as compared with that before the thermal development.

In this embodiment, as the compound capable of substantially reducing visible light absorption derived from a photosensitive silver halide after thermal development, it is especially preferred to use a silver iodide complex forming agent.

(Explanation of Silver Iodide Complex Forming Agent)

In this embodiment, the silver iodide complex forming agent can contribute to Lewis acid base reaction in which at least one of a nitrogen atom or a sulfur atom in the compound provides an electron to a silver ion as a ligand atom (electron donor: Lewis base). Though the stability of the complex is defined in terms of sequential stability constant or overall stability constant, it depends upon a combination of three members of a silver ion, an iodide ion and the silver complex forming agent. As a general guide, it is possible to obtain a large stability constant by a chelating effect by intramolecular chelate ring formation and a measure such as an increase of the acid base dissociation constant of ligand.

While the action mechanism of the silver iodide complex forming agent in this embodiment has not be definitely clarified yet, it is estimated that silver iodide becomes soluble by forming a stable complex composed of at least three components including an iodide ion and a silver ion. Though the silver iodide complex forming agent in this embodiment is poor in the ability to solubilize silver bromide or silver chloride, it peculiarly acts to silver iodide.

While the details of the mechanism by which the image preservability is improved by the silver iodide complex forming agent in this embodiment have not be clarified yet, it may be thought that at least a part of the photosensitive silver halide reacts with the silver iodide complex forming agent in this embodiment at the time of thermal development to form a complex, whereby the photosensitivity lowers or disappears, and especially, the image preservability under light irradiation is largely improved. Also, it is a large characteristic feature that film cloudiness by the silver halide is reduced at the same time, resulting in obtaining a clear image having high image quality. The film cloudiness can be confirmed by a reduction of absorption in ultraviolet and visible region of a spectral absorption spectrum.

In this embodiment, the absorption spectrum in ultraviolet and visible region of the photosensitive silver halide can be measured by the transmission method or reflection method. In the case where the absorption derived from other compound to be added in the photothermographic material overlaps the absorption of the photosensitive silver halide, the absorption spectrum in ultraviolet and visible region of the photosensitive silver halide can be observed by a measure such as differential spectrum and removal of other compound by a solvent singly or in combination.

A distinct difference of the silver iodide complex forming agent in this embodiment from the related art silver ion complex forming agents resides in the matter that the iodide ion is essential in forming a stable complex. The related art silver ion complex forming agents have an action to dissolve a silver ion-containing salt such as silver bromide, silver chloride, and organic silver salts such as silver behenate, whereas the silver iodide complex forming agent in this embodiment has a large characteristic feature that it does not act so far as silver iodide is not present.

Concrete compounds of the silver iodide complex forming agent in this embodiment are identical to compounds described in detail in Japanese Patent Application Nos. 2002-367661, 2002-367662 and 2002-367663. Specific examples of compounds described in these patent applications can also be enumerated as specific examples of the compound in this embodiment.

In this embodiment, in order that the image preservability, especially the image preservability under light irradiation may be largely improved, the absorption intensity of the absorption spectrum in ultraviolet and visible region of the photosensitive silver halide after the thermal development is preferably not more than 80%, more preferably not more than 40%, especially preferably not more than 20%, and most preferably not more than 10% as compared with that before the thermal development.

The silver iodide complex forming agent in this embodiment may be contained in the photosensitive material by containing it in a coating solution by any method in the solution state, the emulsified dispersion state, the solid fine particle dispersion state, and the like.

As the emulsification dispersion method that is well known, there is enumerated a method in which the silver iodide complex forming agent is dissolved using an oil such as dibutyl phthalate, tricresyl phosphate, glyceryl triacetate, and diethyl phthalate and a co-solvent such as ethyl acetate and cyclohexanone, to prepare mechanically an emulsified dispersion.

(Explanation of Photosensitive Silver Halide)

1) Halogen Formulation

It is important that the photosensitive silver halide to be used in this embodiment has a high silver iodide content of from 40% by mole to 100% by mole. With respect to the remainder, there are no particular limitations, silver halides such as silver chloride and silver bromide and organic silver salts such as silver thiocyanate and silver phosphate can be chosen. Of these, silver bromide and silver chloride are especially preferable. By using such a silver halide having a high silver iodide content, it is possible to design a preferable photothermographic material having good image preservability after the development processing, especially a markedly small increase of fog by light irradiation.

Further, the silver iodide content is preferably from 70% by mole to 100% by mole, more preferably from 80% by mole to 100% by mole, and further preferably from 90% by mole to 100% by mole from the standpoint of image preservability against light irradiation after the processing.

The distribution of the halogen formulation within the grain may be uniform, or may be changed stepwise or continuously. Also, silver halide grains having a core/shell structure can be preferably used. The structure is preferably a doublet to quintet structure. More preferably, core/shell grains having a doublet to quartet structure can be used A core-high silver iodide structure having a high silver iodide content in the core part or a shell-high silver iodide structure having a high silver iodide content in the sheet part can also be preferably used. Also, technologies for localizing silver chloride or silver bromide as an epitaxial part in the grain surface can be preferably employed.

The silver iodide of this embodiment can take an arbitrary β-phase or γ-phase content. The β-phase as referred to herein means a high-silver iodide structure having a hexagonal system wurtzite structure, and the γ-phase as referred to herein means a high-silver iodide structure having a cubic zincblend structure. The γ-phase content as referred to herein is determined using a measure proposed by C. R. Berry. This measure is concerned with the determination by the powder X-ray diffraction method based on peaks of the β-phases (100), (101) and (002) and the γ-phase (111) of silver iodide. The details can be, for example, referred to *Physical Review*, Volume 161, No. 3, pp.848–851 (1967).

2) Grain Size

With respect to the silver halide of high silver iodide to be used in this invention, a sufficiently large grain size necessary for achieving high sensitivity can be chosen. In this embodiment, the silver halide preferably has a mean sphere-corresponding diameter of from 0.3 μm to 5.0 μm, and more preferably from 0.5 μm to 3.0 μm. The mean sphere-corresponding diameter means a diameter of a sphere having a volume the same as that of one silver halide grain. With respect to the measurement method, it can be determined by determining the grain volume from a projected area and a thickness of individual grains observed by an electron microscope, followed by reducing in terms of a sphere having a volume the same as the grain volume.

3) Coating Amount

In general, in the case of a photothermographic material in which a silver halide remains as it is after the thermal development, if the coating amount of the silver halide is increased, transparency of the resulting film lowers, and therefore, such is not preferable in view of the image quality. Accordingly, nonetheless a requirement for increasing the sensitivity, the coating amount of the silver halide was controlled to a low level. However, in the case of this embodiment, since a haze of the film due to the silver halide can be reduced in the thermal development processing, it is possible to coat a larger amount of the silver halide. In the invention, the coating amount of the silver halide is preferably from 0.5% by mole to 100% by mole, and more preferably from 5% by mole to 50% by mole per mole of silver of the non-photosensitive organic silver salt.

4) Grain Formation Method

The formation method of photosensitive silver halides is well known in the art. For example, methods described in *Research Disclosure*, No. 17029, June 1978 and U.S. Pat. No. 3,700,458 can be employed. Concretely, there is employed a method in which a silver supply compound and a halogen supply compound are added in a gelatin or other polymer solution to prepare a photosensitive silver halide, followed by mixing with an organic silver salt. Also, a method described in paragraph Nos. 0217 to 0224 of JP-A-11-119374 and methods described in JP-A-11-352627 and Japanese Patent Application No. 2000-42336 are preferable.

With respect to the formation method of tabular grains of silver iodide, methods described in the above-cited JP-A-59-119350 and JP-A-59-119344 are preferably employed.

5) Grain Shape

Examples of the shape of the silver halide grains in this embodiment include cubic grains, octahedral grains, tetradecahedral grains, dodecahedral grains, tabular grains, spherical grains, rod-like grains, and pebble-like grains. Of these, dodecahedral grains, tetradecahedral grains, and tabular grains are preferable. The dodecahedral grain as reference to herein means a grain having (001), {1(−1)0} and {101} faces, and the tetradecahedral grain as referred to herein means a grain having (001), {100} and {101} faces. Here, the {100} and {101} faces mean a group of crystal faces having face indices equivalent to the (100) face and (101) face respectively.

The dodecahedron, tetradecahedron and octahedron of silver iodide can be prepared by referring to Japanese Patent Application Nos. 2002-081020, 2002-87955 and 2002-91756.

The tabular grains have an aspect ratio of 2 or more, and preferably from 2 to 50.

The silver halide having a formulation of high silver iodide content of this embodiment can take a complicated form. However, as a preferred form, junction grains shown in FIG. 1 on page 164 of R. L. Jenkins, et al., *J of Phot. Sci.*, Vol. 28 (1980) are enumerated. Tabular grains shown in FIG. 1 of ibid. are also preferably used. Silver halide rains having round corners can also be preferably used. With respect to the face indices (Miller indices) of the outer surface of photosensitive silver halide grain, there are no particular limitations, but grains in which in the case where a spectral sensitizing dye is adsorbed, a proportion occupied by the [100] face having a high spectral sensitizing efficiency is high are preferable. This proportion is preferably 50% or more, more preferably 65% or more, and further preferably 80% or more. A ratio of the [100] face of the Miller indices can be determined by a method described in T. Tani, *J. Imaging Sci.*, 29, 165 (1985) utilizing the adsorption dependency upon the [111] face and [100] face in the adsorption of a sensitizing dye.

6) Heavy Metal

The photosensitive silver halide grains of this embodiment can contain a metal or metal complex belonging to the Group 8 to the Group 10 of the Periodic Table (expressing from the Group 1 to the Group 18). As the metal or central metal of the metal complex belonging to the Group 8 to the Group 10 of the Periodic Table, rhodium, ruthenium, and iridium are preferable. The metal complex may be made of one kind of a metal, or two or more kinds of complexes made of the same metal or different metals may be used together. A content of the metal or metal complex is preferably in the range of from $1\times10^{-9}$ moles to $1\times10^{-3}$ moles per mole of silver. Such heavy metals or metal complexes and addition methods thereof are described in JP-A-7-225449, paragraph Nos. 0018 to 0024 of JP-A-11-65021, and paragraph Nos. 0227 to 0240 of JP-A-11-119374.

In this embodiment, silver halide grains in which a hexacyano metal complex is present on the outermost surface of the grain are preferable. Examples of the hexacyano metal complex include $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. In this embodiment, hexacyano Fe complexes are preferable.

The hexacyano metal complex can be added by mixing with a mixed solvent of water and an adequate water-miscible organic solvent (for example, alcohols, ethers, glycols, ketones, esters, and amides) or gelatin.

The addition amount of the hexacyano metal complex is preferably from $1\times10^{-5}$ moles to $1\times10^{-2}$ moles, and more preferably from $1\times10^{-4}$ moles to $1\times10^{-3}$ moles per mole of silver.

In order that the hexacyano metal complex may be made present in the outermost surface of the silver halide grain, after completion of the addition of a silver nitrate aqueous solution to be used for the grain formation, the hexacyano metal complex is directly added before a charging step until a chemical sensitization step for carrying out chalcogen sensitization such as sulfur sensitization, selenium sensitization, and tellurium sensitization or noble metal sensitization such as gold sensitization, during a water washing step, during a dispersion step, or before a chemical sensitization step. For the sake of not growing the silver halide grain, it is preferable that the hexacyano metal complex is added rapidly after the grain formation and that it is added before completion of a charging step.

Further, metal atoms (for example, $[Fe(CN)_6]^{4-}$) that can be contained in the silver halide grains to be used in this embodiment and desalting method and chemical sensitization method of silver halide emulsions are described in paragraph Nos. 0046 to 0050 of JP-A-11-84574, paragraph Nos. 0025 to 0031 of JP-A-11-65021, and paragraph Nos. 0242 to 0250 of JP-A-11-119374.

7) Gelatin

As gelatin to be contained in the photosensitive silver halide emulsion that is used in this embodiment, a variety of gelatins can be used. For the sake of keeping the dispersed state in an organic silver salt-containing coating solution of the photosensitive silver halide emulsion good, it is preferred to use gelatin having a low molecular weight of from 500 to 60,000. The low-molecular weight gelatin may be used at the time of grain formation or at the time of dispersion after the desalting processing but is preferably used at the time of dispersion after the desalting processing.

8) Chemical Sensitization

Though the photosensitive silver halide to be used in this embodiment may not be chemically sensitized, it is preferable that it is chemically sensitized by at least one method of the chalcogen sensitization method, the gold sensitization method, and the reduction sensitization method. Examples of the chalcogen sensitization method include the sulfur sensitization method, the selenium sensitization method, and the tellurium sensitization method.

In the sulfur sensitization, an unstable sulfur compound is used. As the unstable sulfur compound, those described in P. Grafkides, *Chimie et Physique Photographique* (5th Ed., published by Paul Momtel (1987)) and *Research Disclosure*, Vol. 307, No. 307105 can be used.

Specifically, known sulfur compounds such as thiosulfates (for example, sodium thiosulfate), thioureas (for example, diphenylthiourea, triethylthiourea, N-ethyl-N'-(4-methyl-2-thiazolyl)thiourea, and carboxy-methyltrimethylthiourea), thioamides (for example, thioacetamide), rhodanines (for example, diethylrhodanine and 5-benzylidene-N-ethylrhodanine), phosphine sulfides (for example, trimethylphosphine sulfide), thiohydantoins, 4-oxo-oxazolin-2-thiones, disulfides or polysulfides (for example, dimorpholine disulfide, cystine, and lenthionine (1,2,3,5,6-pentathiepane), polythionates, and elemental sulfur, and active gelatin can be used. Especially, thiosulfates, thioureas, and rhodanines are preferable.

In the selenium sensitization, an unstable selenium compound is used, and as the selenium compound, those described in JP-B-43-13489, JP-B-44-15748, JP-A-4-25832, JP-A-4-109340, JP-A-4-271341, JP-A-5-40324, JP-A-5-11385, and Japanese Patent Application Nos. 4-202415, 4-330495, 4-333030, 5-4203, 5-4204, 5-106977, 5-236538, 5-241642 and 5-286916 can be used.

Specifically, colloidal metallic selenium, selenoureas (for example, N,N-dimethylselenourea, trifluoromethyl-carbonyl-trimethylselenourea, and acetyl-trimethylseleno-urea), selenoamides (for example, selenoamide and N,N-di-ethylphenylselenoamide), phosphine selenides (for example, triphenylphosphine selenide and pentafluorophenyl-tri-phenylphosphine selenide), selenophosphates (for example, tri-p-tolylselenophosphate and tri-n-butylselenophosphate), selenoketones (for example, selenobenzophenone), iso-selenocynates, selenocarboxylates, selenoesters, and diacyl selenides may be used. Also, non-unstable selenium compounds described in JP-B-46-4553 and JP-B-52-34492, such as selenious acid, selenocyanates, selenazoles, and selenides, can be used. Especially, phosphine selenides, selenoureas, and selenocyanates are preferable.

In the tellurium sensitization, an unstable tellurium compound is used, and as the unstable tellurium compound, those described in JP-A-4-224595, JP-A-4-271341, JP-A-4-333043, JP-A-5-303157, JP-A-6-27573, JP-A-6-175258, JP-A-6-180478, JP-A-6-208186, JP-A-6-208184, JP-A-6-317867, JP-A-7-140579, JP-A-7-301879, and JP-A-7-301880 can be used.

Specifically, phosphine tellurides (for example, butyl-diisopropylphosphine telluride, tributylphosphine telluride, tributoxyphosphine telluride, and ethoxy-diphenylphosphine telluride), diacyl (di) tellurides (for example, bis (diphenylcarbamoyl) ditelluride, bis(N-phenyl-N-methyl-carbamoyl) ditelluride, bis(N-phenyl-N-methylcarbamoyl) telluride, bis(N-phenyl-N-benzylcarbamol) telluride, and bis (ethoxycarbonyl) telluride), telluroureas (for example, N,N'-dimethylethylenetelurourea and N,N'-di-phenylethylenetellurourea), telluroamides, and telluroesters may be used. Especially, diacyl (di)tellurides and phosphine tellurides are preferable. In particular, compounds described in the documents described in paragraph No. 0030 of JP-A-11-65021 and compounds represented by the general formulae (II), (III) and (IV) in JP-A-5-313284 are more preferable.

Especially, in the chalcogen sensitization of this embodiment, selenium sensitization and tellurium sensitization are preferable, and tellurium sensitization is particularly preferable.

In the gold sensitization, gold sensitizers described in described in P. Grafkides, *Chimie et Physique Photographique* (5th Ed., published by Paul Momtel (1987)) and *Research Disclosure*, Vol. 307, No. 307105 can be used. Specific examples include chloroauric acid, potassium chloroaurate, potassium aurothiocyanate, gold sulfide, and gold selenide. In addition, gold compounds described in U.S. Pat. Nos. 2,642,361, 5,049,484, 5,049,485, 5,169,751 and 5,252,455 and Belgian Patent No. 691,857 can be used. Also, salts of metals other than gold, such as platinum, palladium, and iridium, as described in P. Grafkides, *Chimie et Physique Photographique* (5th Ed., published by Paul Momtel (1987)) and *Research Disclosure*, Vol. 307, No. 307105, can be used.

Though the gold sensitization can be employed singly, its combination with the foregoing chalcogen sensitization is preferable. Specific examples of the combination include gold-sulfur sensitization, gold-selenium sensitization, gold-sulfur-selenium sensitization, gold-sulfur-tellurium sensitization, gold-selenium-tellurium sensitization, and gold-sulfur-selenium-tellurium sensitization.

In this embodiment, the chemical sensitization can be carried out at any time after the grain formation and before coating. Specifically, it can be carried out after desalting and (1) before spectral sensitization, (2) simultaneously with spectral sensitization, (3) after spectral sensitization, or (4) immediately before coating.

The use amount of the chalcogen sensitizer to be used in this embodiment varies depending upon the silver halide grains to be used, the chemical ripening condition, and the like. The chalcogen sensitizer is used in an amount of from about $10^{-8}$ to $10^{-1}$ moles, and preferably from about $10^{-7}$ to $10^{-2}$ moles per mole of the silver halide.

Similarly, the addition amount of the gold sensitizer to be used in this embodiment varies depending upon a variety of conditions and is preferably from $10^{-7}$ moles to $10^{-2}$ moles, and more preferably from $10^{-6}$ moles to $5\times10^{-3}$ moles per mole of the silver halide as a standard. With respect to the circumferential condition for chemically sensitizing this emulsion, any condition can be chosen. The pAg is not more than 8, preferably not more than 7.0, more preferably not more than 6.5, and especially not more than 6.0, and the pAg is 1.5 or more, preferably 2.0 or more, and especially preferably 2.5 or more; the pH is from 3 to 10, and preferably from 4 to 9; and the temperature is from about 20 to 95° C., and preferably from about 25 to 80° C.

In this embodiment, in addition to chalcogen sensitization and gold sensitization, reduction sensitization can be employed in combination. In particular, a combination with chalcogen sensitization is preferable. As specific compounds that are used in the reduction sensitization method, ascorbic acid, thiourea dioxide, and dimethylamine borane are preferable. Besides, it is preferred to use stannous chloride, aminoiminomethanesulfinic acid, hydrazine derivatives, borane compounds, silane compounds, polyamine compounds, etc. The reduction sensitizer may be added at any time of the production step of a photosensitive emulsion from the crystal growth until the preparation step immediately before coating. Also, it is preferred to perform reduction sensitization by ripening the emulsion while keeping a pH at 8 or more or a pAg at not more than 4. Further, it is also preferred to perform reduction sensitization by introducing a single addition segment of a silver ion during the grain formation.

Similarly, the addition amount of the reduction sensitizer varies depending upon a variety of conditions and is preferably from $10^{-7}$ moles to $10^{-1}$ moles, and more preferably from $10^{-6}$ moles to $5\times10^{-2}$ moles per mole of the silver halide as a standard.

A thiosulfonic acid compound may be added in the silver halide emulsion to be used in this embodiment by a method described in EP-A-293,917.

In this embodiment, in view of designing a photothermographic material having high sensitivity, it is preferable that the photosensitive silver halide grains are chemically sensitized by at least one method of gold sensitization and chalcogen sensitization.

9) Compound in which a one-electron oxidant formed upon one-electron oxidation can release one electron or more electrons:

It is preferable that the photothermographic material in this embodiment contains a compound in which a one-electron oxidant formed upon one-electron oxidation can release one electron or more electrons. This compound is used singly or in combination with the foregoing various other chemical sensitizers so that it can give rise to an increase of the sensitivity of the silver halide.

The compound in which a one-electron oxidant formed upon one-electron oxidation can release one electron or more electrons, which is contained in the photothermographic material of this embodiment, is a compound selected from the following Type 1 to Type 5.

(Type 1)

A compound in which a one-electron oxidant formed upon one-electron oxidation can release two or more electrons accompanied with subsequent bond cleavage reaction.

(Type 2)

A compound in which a one-electron oxidant formed upon one-electron oxidation can release one more electron accompanied with subsequent bond cleavage reaction, and having two or more adsorbing groups onto the silver halide in the same molecule.

(Type 3)

A compound in which a one-electron oxidant formed upon one-electron oxidation can further release one or more electrons after the lapse of a subsequent bond forming step.

(Type 4)

A compound in which a one-electron oxidant formed upon one-electron oxidation can further release one or more electrons after the lapse of subsequent ring cleavage reaction.

(Type 5)

A compound represented by X—Y, wherein X represents a reducing group, and Y represents a split-off group, and in which a one-electron oxidant formed upon one-electron oxidation of the reducing group represented by X splits off Y accompanied with subsequent cleavage reaction of the X—Y bond to form the X radical, from which one more electron can be released.

Of the compounds of the foregoing Type 1 and Types 3 to 5, "a compound having an adsorbing group onto the silver halide in the molecule" or "a compound having a partial structure of spectral sensitizing dye in the molecule" is preferable, and "a compound having an adsorbing group onto the silver halide in the molecule" is more preferable. The compounds of the Types 1 to 4 are more preferably "a compound having a nitrogen-containing heterocyclic group substituted with two or more mercapto groups" as an adsorbing group.

The compounds of the Types 1 to 4 of this embodiment are each identical with compounds described in detail in JP-A-2003-114487, JP-A-2003-114486, JP-A-2003-140287, JP-A-2003-75950, and JP-A-2003-114488. Examples of specific compounds described in these patent specifications can be enumerated as specific examples of the compounds of the Types 1 to 4 of this embodiment. Also, synthesis examples of the compounds of the Types 1 to 4 of this embodiment are identical with those described in these patents.

As specific examples of the compound of the Type 5 of this embodiment, examples of compounds called "a one-photon two-electron sensitizer" or "a deprtonated electron donating sensitizer" as described in patents including JP-A-9-211769 (Compounds PMT-1 to S-37 described in Tables E and F on pages 28 to 32), JP-A-9-211774, JP-A-11-95355 (Compounds INV 1 to 36), JP-T-2001-500996 (Compounds 1 to 74, 80 to 87 and 92 to 122), U.S. Pat. Nos. 5,747,235 and 5,747,236, European Patent Nos. 786,692A1 (Compounds INV 1 to 35) and 893,732A1, and U.S. Pat. Nos. 6,054,260 and 5,994,051 can be enumerated as they are.

The compounds of the Types 1 to 5 of this embodiment may be used in any time at the time of preparation of a photosensitive silver halide emulsion or during the preparation of a photothermographic material. For example, the compound can be used at the time of forming photosensitive silver halide grains, in the desalting step, at the time of chemical sensitization, or before coating. Also, the compound can be added in a divided manner of plural times during these steps. The addition timing is preferably from at the time of completion of the formation of photosensitive silver halide grains until before the desalting step, at the time of chemical sensitization (immediately before start of the chemical sensitization to immediately after completion of the chemical sensitization), or before coating, and more preferably from at the time of chemical sensitization until before mixing with a non-photosensitive organic silver salt.

It is preferable that each of the compounds of the Types 1 to 5 of this embodiment is dissolved in water or a water-soluble solvent such as methanol and ethanol or a mixed solvent thereof and then added. In the case where the compound is dissolved in water, with respect to a compound in which its solubility increases when the pH is made high or low, the compound may be dissolved and added after increasing or decreasing the pH.

It is preferable that each of the compounds of the Types 1 to 5 of this embodiment is used in an emulsion layer containing a photosensitive silver halide and a non-photosensitive organic silver salt. The compound may be added in a protective layer or an interlayer in addition to the emulsion containing a photosensitive silver halide and a non-photosensitive organic silver salt and diffused at the time of coating. Regardless of before and after addition of a sensitizing dye, the compound of this embodiment is preferably contained in a proportion of from $1\times10^{-9}$ to $5\times10^{-1}$ moles, and more preferably from $1\times10^{-8}$ to $5\times10^{-2}$ moles per mole of the silver halide in the silver halide emulsion layer.

10) Adsorbing redox compound having an adsorbing group and a reducing group:

In this embodiment, it is preferable that a compound having an adsorbing group onto a silver halide and a reducing group in the molecule is contained. The adsorbing redox compound is preferably a compound represented by the following formula (I).

$$A—(W)_n—B \qquad \text{Formula (I)}$$

In the formula (I), A represents a group that can be adsorbed onto a silver halide (hereinafter referred to as "adsorbing group"); W represents a divalent connecting group; n represents 0 or 1; and B represents a reducing group.

In the formula (I), the adsorbing group represented by A is a group that is adsorbed directly onto a silver halide or a group of promoting adsorption onto a silver halide. Specific examples thereof include a mercapto group (or its salt), a thione group (—C(═S)—), a heterocyclic group containing at least one atom. selected from a nitrogen atom, a sulfur atom, a selenium atom, and a tellurium atom, a sulfide group, a disulfide group, a cationic group, and an ethynyl group.

The mercapto group (or its salt) as the adsorbing group, as referred to herein, means a mercapto group (or its salt) and simultaneously represents a heterocyclic group, aryl group or alkyl group substituted with at least one mercapto group (or its salt). The heterocyclic group as referred to herein means an at least 5-membered to 7-membered, monocyclic or fused, aromatic or non-aromatic heterocyclic group, and examples thereof include an imidazole ring group, a thiazole ring group, an oxazole ring group, a benzimidazole ring group, a benzothiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, and a triazine ring group. Also, the heterocyclic group may be a quaternary nitrogen atom-containing heterocyclic group. In this case, the substituted mercapto group may be dissociated to become a meso ion. When the mercapto group forms a salt, examples of a counter ion include cations of alkali metals, alkaline earth metals, heavy metals, and the like (for example, $Li^+$, $Na^+$, $K^+$, $Mg^{2+}$, $Ag^+$, and $Zn^{2+}$), an ammonium ion, quaternary nitrogen atom-containing heterocyclic groups, and a phosphonium ion.

The mercapto group as the adsorbing group may further cause tautomerism to become a thione group.

The thione group as the adsorbing group, as referred to herein, includes a chain or cyclic thioamide group, a thiureido group, a thiourethane group, or a dithiocarbamic acid ester group.

The heterocyrlic group containing at least one atom selected from a nitrogen atom, a sulfur atom, a selenium atom, and a tellurium atom, as referred to herein, means a nitrogen-containing heterocyclic group having an —NH— group capable of forming imino silver (>NAg) as a partial structure of the hetero ring, or a heterocyclic group having an —S— group, an —Se— group, a —Te— group or an ═N— group, capable of being coordinated with a silver ion through a coordinate bond, as a partial structure of the hetero ring. Examples of the former include a benzotriazole group, a triazole group, an indazole group, a pyrazole group, a tetrazole group, a benzimidazole group, an imidazole group, and a purine group; and examples of the latter include a thiophene group, a thiazole group, an oxazole group, a benzothiophene group, a benzothiazole group, a benzoxazole group, a thiadiazole group, an oxadiazole group, a triazine group, a selenoazole group, a benzoselenoazole group, a tellurazole group, and a benzotellurazole group.

The sulfide group or disulfide group as the adsorbing group, as referred to herein, includes all groups having a partial structure of —S— or —S—S—.

The cationic group as the adsorbing group, as referred to herein, means a quaternary nitrogen atom-containing group, and specifically means an ammonio group or a quaternary nitrogen atom-containing nitrogen-containing heterocyclic group. Examples of the quaternary nitrogen atom-containing nitrogen-containing heterocyclic group include a pyridinio group, a quinolinio group, an isoquinolinio group, and an imidazolio group.

The ethynyl group as the adsorbing group, as referred to herein, means a —C≡CH group, in which the hydrogen atom may be substituted.

The foregoing adsorbing groups may have a substituent.

Further, as specific examples of the adsorbing group, those described on pages 4 to 7 of the JP-A-11-95355 are enumerated.

In the formula (I), preferred examples of the adsorbing group represented by A include mercapto-substituted heterocyclic groups (for example, a 2-mercaptothiadiazole group, a 2-mercapto-5-aminothiadiazole group, a 3-merpcato-1,2,4-triazole group, a 5-mercaptotetrazole group, a 2-mercapto-1,3,4-oxadiazole group, a 2-mercaptobenzimidazole group, a 1,5-dimethyl-1,2,4-triazolium-3-thiolate group, a 2,4-dimercaptopyrimidine group, a 2,4-dimercaptotriazine group, a 3,5-dimercapto-1,2,4-triazole group, and a 2,5-dimercapto-1,3-thiazole group) and nitrogen-containing heterocyclic groups having an —NH— group capable of forming imino silver (>NAg) as a partial structure of the hetero ring (for example, a benzotriazole group, a benzimidazole group, and an indazole group). More preferably, the adsorbing group is a 2-mercaptobenzimidazole group and a 3,5-di-mercapto-1,2,4-triazole group.

In the formula (I), W represents a divalent connecting group. As the connecting group, any group can be employed so far as it does not adversely affect the photographic property. For example, divalent connecting groups constructed of a carbon atom, a hydrogen atom, an oxygen atom, a nitrogen atom, or a sulfur atom can be utilized. Specific examples thereof include alkylene groups having from 1 to 20 carbon atoms (for example, a methylene group, an ethylene group, a trimethylene group, a tetramethylene group, and a hexamethylene group), alkenylene groups having from 2 to 20 groups, alkynylene groups having from 2 to 20 carbon atoms, arylene groups having from 6 to 20 carbon atoms (for example, a phenylene group and a naphthylene group), —CO—, —$SO_2$—, —O—, —S—, —$NR_1$—, and combinations of these connecting groups. Here, $R_1$ represents a hydrogen atom, an alkyl group, a heterocyclic group, or an aryl group.

The connecting group represented by W may have an arbitrary substituent.

In the formula (I), the reducing group represented by B, as referred to herein, means a group capable of reducing a silver ion. Examples thereof include a formyl group, an amino group, triple bond-containing groups such as an acetylene group and a propargyl group, a mercaopt group, and residues resulting from elimination of one hydrogen atom from hydroxylamines, hydroxamates, hydroxyureas, hydroxyurethanes, hydroxysemicarbazides, reductones (including reductone derivatives), anilines, phenols (including chroman-6-ols, 2,3-dihydrobenzofuran-5-ols, aminophenols, sulfonamidophenols, and polyphenols such as hydroquniones, catechols, resorcinols, benzenetriols, and bisphenols), acyl hydrazines, carbamoyl hydrazines, 3-pyrazolidones, etc. As a matter of course, these groups may have an arbitrary substituent.

In the formula (I), the oxidation potential of the reducing group represented by B can be measured using a measurement method described in Akira Fujishima, *Denkikagaku Sokuteiho* (pages 150 to 208, published by Gihodo Co., Ltd.) or *Jikken Kagaku Koza*, 4th Ed., compiled by The Chemical Society of Japan (Vol. 9, pages 282 to 344, published by Maruzen Co., Ltd.). Specifically, for example, according to the technique of rotating disk voltammetry, a sample is dissolved in a solution of methanol (pH: 6.5) and a Britton-Robinson buffer (10/90 by volume), and after passing a nitrogen gas for 10 minutes, the oxidation potential can be measured at a sweep rate of 20 mV/sec at 25° C. and 1,000 rpm using a rotating disk electrode (RDE) made of glassy carbon as a working electrode, a platinum wire as a counter electrode, and a saturated calomel electrode as a reference electrode, respectively. A half-wave potential (E1/2) can be determined from the resulting voltammogram.

In this embodiment, in the case where the reducing group represented by B is measured according to the foregoing measurement method, the oxidation potential is preferably in the range of from about −0.3 V to about 1.0 V, more preferably in the range of from about −0.1 V to about 0.8 V, and especially preferably in the range of from about 0 to about 0.7 V.

In the formula (I), the reducing group represented by B is preferably the residue resulting from elimination of one hydrogen atom from hydroxylamines, hydroxamates, hydroxyureas, hydroxysemicarbazides, reductones, phenols, acyl hydrazines, carbamoyl hydrazines, or 3-pyrazolidones.

Specific examples of the reducing group represented by B will be given below, but it should not be construed that this embodiment is limited thereto. Here, the * mark shows the bonding position to A or W.

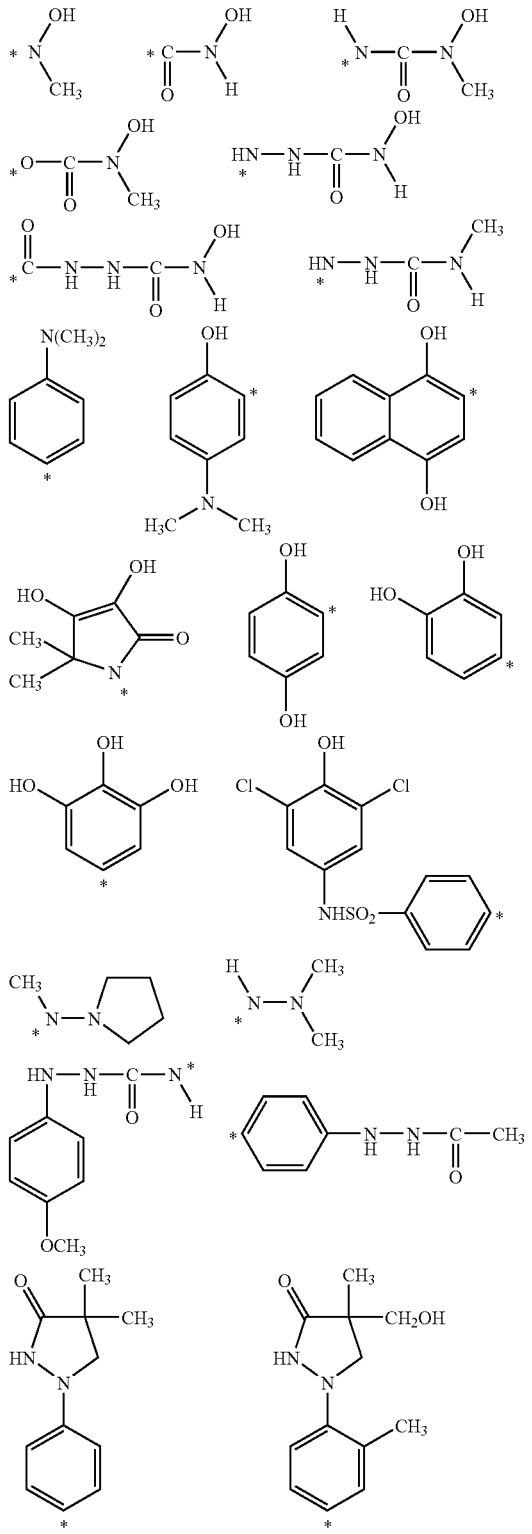

In this embodiment, the compound of the formula (I) may be a compound into which a ballast group or a polymer chain, which is commonly employed in immobile photographic additives such as couplers, is incorporated. Also, as the polymer, for example, those described in JP-A-100530 are enumerated.

In this embodiment, the compound of the formula (I) may be a bis body or a tris body. In this embodiment, the compound of the formula (I) preferably has a molecular weight of from 100 to 10,000, more preferably from 120 to 1,000, and especially preferably from 150 to 500.

In this embodiment, adsorbing redox compounds having an adsorbing group onto a silver halide and a reducing group in the molecule are identical to compounds described in detail in Japanese Patent Application Nos. 2002-328531 and 2002-379884. Specific examples of the adsorbing redox compounds having an adsorbing group onto a silver halide and a reducing group in the molecule as described in these patent specifications can be enumerated as specific examples of the compound in this embodiment.

The compound of this embodiment can be easily synthesized according to known methods.

In this embodiment, as the compound of the formula (I), though one kind of a compound may be used singly, it is preferred to use two or more kinds of compounds at the same time. In the case of using two or more kinds of compounds, these compounds may be added in the same layer or in a different layer from each other. Also, their addition methods may be different from each other.

In this embodiment, the compound of the formula (I) is preferably added in a silver halide emulsion layer, and more preferably added at the time of preparing an emulsion. In the case of adding the compound at the tome of preparing an emulsion, the compound can be added at any stage during the step. For example, the compound can be added in a step of forming silver halide grains, a step before start of the desalting step, a step of the desalting step, a step before start of chemical ripening; a step of chemical ripening, or a step before preparation of completed emulsion. Also, the compound can be added in a divided manner of plural times during these steps. Also, though it is preferable that the compound is used in the emulsion layer, the compound may be added in an adjacent protective layer or interlayer in addition to the emulsion layer and then diffused at the time of coating.

The preferred addition amount of the compound largely depends upon the foregoing addition method or the kind of a compound to be added but is generally from $1\times10^{-6}$ to 1 mole, preferably from $1\times10^{-5}$ to $5\times10^{-1}$ moles, and more preferably from $1\times10^{-4}$ to $1\times10^{-1}$ moles per mole of the photosensitive silver halide.

In this embodiment, the compound of the formula (I) can be dissolved in water or a water-soluble solvent such as methanol or ethanol or a mixed solvent thereof and then added. In this case, the pH may be adequately adjusted with an acid or a base, or a surfactant may be made co-existent. Further, the compound can be dissolved in a high-boiling organic solvent and then added as an emulsified dispersion. Also, the compound can be added as a solid dispersion.

11) Sensitizing dye

As the sensitizing dye that can be applied to this embodiment, sensitizing dyes capable of spectrally sensitizing silver halide grains in a desired wavelength region in adsorbing onto the silver halide grains and having a spectral sensitivity suitable for spectral characteristics of an exposure light source can be advantageously chosen. It is preferable that the photothermographic material of this embodiment is spectrally sensitized so as to have a spectral sensitivity peak especially at from 600 nm to 900 nm or from 300 nm to 500 nm. With respect to the sensitizing dye and addition method thereof, compounds described in paragraph Nos. 0103 to 0109 of JP-A-11-65021 and those represented by the general formula (II) of JP-A-10-186572, dyes represented by the general formula (I) and described in paragraph No. 0106 of JP-A-11-119374, dyes described in U.S. Pat. No. 5,510,236 and in Example 5 of U.S. Pat. No. 3,871,887, dyes disclosed in JP-A-2-96131 and JP-A-59-48753, and descriptions at page 19, line 38 to page 20, line 35 of European Patent No. 0803764A1 and Japanese Patent Application Nos. 2000-86865, 2000-102560 and 2000-205399 can be employed. These sensitizing dyes may be used singly or in combination of two or more thereof.

In this embodiment, the addition amount of the sensitizing dye can be adjusted to a desired amount depending upon performances such as sensitivity and fog and is preferably from $10^{-6}$ to 1 mole, and more preferably from $10^{-4}$ to $10^{-1}$ moles per mole of the silver halide in the photosensitive layer.

In this embodiment, for the sake of enhancing the spectral sensitization efficiency, a supersensitizer can be used. As the supersensitizer that is used in this embodiment, compounds described in EP-A-587,338, U.S. Pat. Nos. 3,877,943 and 4,873,184, JP-A-5-341432, JP-A-11-109547, and JP-A-10-111543 are enumerated.

11) Joint use of silver halides

In the photothermographic material to be used in this embodiment, photosensitive silver halide emulsions may be used singly or in admixture of two or more thereof (for example, those having a different mean grain size, those having a different halogen formulation, those having a different crystal habit, and those having a different chemical sensitization condition). By using the plural number of kinds of photosensitive silver halides having a different sensitivity, it is possible to adjust the gradation. As technologies regarding this, those described in JP-A-57-119341, JP-A-53-106125, JP-A-47-3929, JP-A-48-55730, JP-A-46-5187, JP-A-50-73627, and JP-A-57-150841 are enumerated. With respect to a difference of the sensitivity, it is preferable that the respective emulsions have a difference of the sensitivity of 0.2 log E or more.

13) Mixing of silver halide and organic silver salt

In this embodiment, it is especially preferable that the photosensitive silver halide grains are formed and chemically sensitized in the absence of a non-photosensitive organic silver salt. This is because in a method of adding a halogenating agent to an organic silver salt to form a silver halide, there is some possibility that a sufficient sensitivity is not achieved.

Examples of a method of mixing a silver halide and an organic silver salt include a method in which a photosensitive silver halide and an organic silver salt as prepared separately are mixed in a ball mill, a colloidal mill, a vibrating mill, a homogenizer, etc. and a method in which a photosensitive silver halide after completion of the preparation is mixed at any timing during the preparation of an organic silver salt to prepare an organic silver salt. In all of these methods, the effects of this embodiment can be preferably obtained.

14) Mixing of silver halide into coating solution

In this embodiment, a preferred timing of adding the silver halide to a coating solution for image forming layer is from 180 minutes before coating to just before coating, and preferably from 60 minutes before coating to 10 seconds before coating. The mixing method and mixing condition are not particularly limited so far as the effects of this embodiment are sufficiently revealed. Specific examples of the mixing method include a method in which mixing is carried out in a tank so as to set up a mean residence time calculated from the addition flow amount and the solution feed amount into a coater at a desired time and a method of using a static mixer described in Chapter 8 of *Fluid Mixing Technology*, written by N. Harnby, M. F. Edwards and A. W. Nienow and translated by Koji Takahashi (published by Nikkan Kogyo Shimbun, Ltd., 1989).

(Explanation of Organic Silver Salt)

The non-photosensitive organic silver salt that is used in this embodiment is a silver salt that is relatively stable against to light but that when heated at 80° C. or higher in the presence of an exposed photosensitive silver halide and a reducing agent, forms a silver image. The organic silver salt may be an arbitrary organic substance containing a source capable of reducing a silver ion. Such non-photosensitive organic silver salts are described in paragraph Nos. 0048 to 0049 of JP-A-10-62899, at page 18, line 24 to page 19, line 37 of European Patent No. 0803764A1, and in European Patent No. 0962812A1, JP-A-11-349591, JP-A-2000-7683, and JP-A-2000-72711. Silver salts of organic acids, especially silver salts of long chain aliphatic carboxylic acids (having from 10 to 30 carbon atoms, and preferably from 15 to 28 carbon atoms) are preferable. Preferred examples of organic silver salts include silver behenate, silver arachidate, silver stearate, silver oleate, silver laurate, silver caproate, silver myristate, silver palmitate, and mixtures thereof. In this embodiment, of these organic silver salts, organic acid silvers having a silver behenate content of from 50% by mole to 100% by mole are preferable for use, and those having a silver behenate content of from 75% by mole to 98% by mole are especially preferable.

The shape of the organic silver salt that can be used in this embodiment is not particularly limited and may be acicular, rod-like, tabular or flaky.

In this embodiment, flaky organic silver salts are preferable. In this specification, the flaky organic silver salt is defined as follows. That is, an organic silver salt is observed by an electron microscope, the shape of an organic silver salt grain is approximated into a rectangular parallelopiped, and sides of the rectangular parallelopiped are defined to be a, b and c in the order from the shortest side (c may be equal to b). Using the numerical values a and b in the shorter sides, x is determined as follows.

$$x=b/a$$

With respect to about 200 grains, x is determined. When its average value, x (average) meets the relationship: x (average)≧1.5, the organic silver salt is defined to be flaky. Preferably, 30≧x (average)≧1.5, and more preferably 15≧x (average)≧1.5. Incidentally, the acicular organic silver salt is in the relationship: 1≦x (average) <1.5.

In the flaky grain, a can be considered to be a thickness of the tabular grain in which a plane composed of the b and c sides is the main flat plane. The average of a is preferably from 0.01 μm to 0.3 μm, and more preferably from 0.1 μm to 0.23 μm. The average of c/b is preferably from 1 to 6, more preferably from 1 to 4, further preferably from 1 to 3, and especially preferably from 1 to 2.

The grain size distribution of the organic silver salt is preferably monodispersed. The term "monodispersed" means that a percentage of a value obtained by dividing a standard deviation of each of the short axis and the long axis by the short axis and the long axis, respectively is preferably not more than 100%, more preferably not more than 80%, and further preferably not more than 50%. With respect to the measurement method of the shape of the organic silver salt, the shape can be determined from an image of the organic silver salt dispersion by a transmission electron microscope. As another method of measuring the monodispersed state, there is a method of determining it from a standard deviation of volume weighted average diameter of the organic silver salt, and a percentage of a value obtained by dividing by the volume weighted average diameter (coefficient of variation) is preferably not more than 100%, more preferably not more than 80%, and further preferably not more than 50%. With respect to the measurement method, for example, it can be determined from a grain size (volume weighted average diameter) obtained by irradiating the organic silver salt dispersed in a liquid with laser beams and determining an autocorrelation function of a fluctuation of its scattered light against a change of the time.

With respect to the production of the organic acid silver to be used in this embodiment and its dispersion method, known methods can be applied. For example, JP-A-10-62899, European Patent Nos. 0803763A1 and 0962812A1, JP-A-11-349591, JP-A-2000-7683, JP-A-2000-72711, JP-A-2001-163827, JP-A-2001-163889, JP-A-2001-163890, JP-A-11-203413, and Japanese Patent Application Nos. 2000-90093, 2000-195621, 2000-191226, 2000-213813, 2000-214155 and 2000-191226 can be made hereof by reference.

In this embodiment, it is possible to produce a photosensitive material by mixing an organic silver salt aqueous dispersion and a photosensitive silver salt aqueous dispersion. In mixing, it is a method preferably used for the purpose of adjusting the photographic characteristic to mix two or more kinds of organic silver salt aqueous dispersions and two or more kinds of photosensitive silver salt aqueous dispersions.

In this embodiment, the organic silver salt can be used in a desired amount, and its silver amount is preferably from 0.1 to 5 g/m$^2$, more preferably from 1 to 3 g/m$^2$, and especially preferably from 1.2 to 2.5 g/m$^2$.

(Explanation of Reducing Agent)

The photothermographic material of this embodiment contains a reducing agent for the organic silver salt. The reducing agent may be an arbitrary substance (preferably an organic substance) capable of reducing a silver ion into metallic silver. Examples of the reducing agent are described in paragraph Nos. 0043 to 0045 of JP-A-11-65021 and at page 7, line 34 to page 18, line 12 of European Patent No. 0803764.

The reducing agent to be used in this embodiment is preferably a so-called hindered phenol based reducing agent having a substituent at the ortho position with respect to the phenolic hydroxyl group or a bisphenol based reducing agent. In particular, a compound represented by the following general formula (R) is preferable.

General Formula (R)

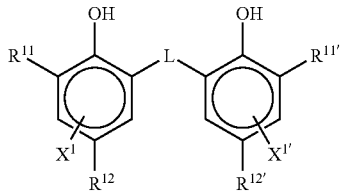

In the general formula (R), $R^{11}$ and $R^{11'}$ each independently represents an alkyl group having from 1 to 20 carbon atoms; $R^{12}$ and $R^{12'}$ each independently represents a hydrogen atom or a substituent capable of being substituted on the benzene ring; L represents an —S— group or a —$CHR^{13}$— group; $R^{13}$ represents a hydrogen atom or an alkyl group having from 1 to 20 carbon atoms; and $X^1$ and $X^{1'}$ each independently represents a hydrogen atom or a group capable of being substituted on the benzene ring.

The respective substituents will be described below.

1) $R^{11}$ and $R^{11'}$:

$R^{11}$ and $R^{11'}$ each independently represents a substituted or unsubstituted alkyl group having from 1 to 20 carbon atoms. Though the substituent of the alkyl group is not particularly limited, preferred examples thereof include an aryl group, a hydroxyl group, an alkoxy group, an aryloxy group, an alkylthio group, an arylthio group, an acylamino group, a sulfonamide group, a sulfonyl group, a phosphoryl group, an acyl group, a carbamoyl group, an ester group, and a halogen atom.

2) $R^{12}$ and $R^{12}$ ' and $X^1$ and $X^{1'}$:

$R^{12}$ and $R^{12}$ ' each independently represents a hydrogen atom or a group capable of being substituted on the benzene ring.

$X^1$ and $X^1$ ' each independently represents a hydrogen atom or a group capable of being substituted on the benzene ring. Preferred examples of the respective groups capable of being substituted on the benzene ring include an alkyl group, an aryl group, a halogen atom, an alkoxy group, and an acylamino group.

3) L:

L represents an —S— group or a —$CHR^{13}$— group. $R^{13}$ represents a hydrogen atom or an alkyl group having from 1 to 20 carbon atoms, and the alkyl group may have a substituent.

Specific examples of the unsubstituted alkyl group represented by $R^{13}$ include a methyl group, an ethyl group, a propyl group, a butyl group, a heptyl group, an undecyl group, an isopropyl group, a 1-ethylpentyl group, and a 2,4,4-trimethylpentyl group.

Examples of the substituent of the alkyl group are identical to those of the substituent of $R^{11}$ and include a halogen atom, an alkoxy group, an alkylthio group, an aryloxy group, an arylthio group, an acylamino group, a sulfonamide group, a sulfonyl group, a phosphoryl group, an oxycarbonyl group, a carbamoyl group, and a sulfamoyl group.

4) Preferred Substituents:

$R^{11}$ and $R^{11'}$ are each preferably a secondary or tertiary alkyl group having from 3 to 15 carbon atoms, and specific examples thereof include an isopropyl group, an isobutyl group, a t-butyl group, a t-amyl group, a t-octyl group, a cyclohexyl group, a cyclopentyl group, a 1-methylcyclohexyl group, and a 1-methylcyclopropyl group. $R^{11}$ and $R^{11'}$ are each more preferably a tertiary alkyl group having from 4 to 12 carbon atoms. Of these, a t-butyl group, a t-amyl group, and a 1-methylcyclohexyl group are further preferable, and a t-butyl group is most preferable.

$R^{12}$ and $R^{12'}$ are each preferably an alkyl group having from 1 to 20 carbon atom, and specific examples thereof include a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, and a methoxyethyl group. Of these, a methyl group, an ethyl group, a propyl group, an isopropyl group, and a t-butyl group are more preferable.

$X^1$ and $X^{1'}$ are each preferably a hydrogen atom, a halogen atom, or an alkyl group, and more preferably a hydrogen atom.

L is preferably a —$CHR^{13}$— group.

$R^{13}$ is preferably a hydrogen atom or an alkyl group having from 1 to 15 carbon atoms, and preferred examples of the alkyl group include a methyl group, an ethyl group, a propyl group, an isopropyl group, and a 2,4,4-trimethylpentyl group. $R^{13}$ is especially preferably a hydrogen atom, a methyl group, a propyl group, or an isopropyl group.

In the case where $R^{13}$ is a hydrogen atom, $R^{12}$ and $R^{12'}$ are each preferably an alkyl group having from 2 to 5 carbon atoms, more preferably an ethyl group or a propyl group, and most preferably an ethyl group.

In the case where $R^{13}$ is a primary or secondary alkyl group having from 1 to 8 carbon atoms, $R^{12}$ and $R^{12'}$ are each preferably a methyl group. Preferred examples of the primary or secondary alkyl group having from 1 to 8 carbon atoms represented by $R^{13}$ include a methyl group, an ethyl group, a propyl group, and an isopropyl group. Of these, a methyl group, an ethyl group, and a propyl group are more preferable.

In the case where all of $R^{11}$, $R^{11'}$, $R^{12}$, and $R^{12'}$ are a methyl group, $R^{13}$ is preferably a secondary alkyl group. In this case, the secondary alkyl group represented by $R^{13}$ is preferably an isopropyl group, an isobutyl group, or a 1-ethylpentyl group, and more preferably an isopropyl group.

The foregoing reducing agent varies with respect to various thermal development performances depending upon a combination of $R^{11}$, $R^{11}$ ', $R^{12}$, $R^{12'}$, and $R^{13}$. Since these thermal development performances can be adjusted by jointly using two or more kinds of reducing agents in a varied mixing ratio, it is preferred to use a combination of two or more kinds of reducing agents depending upon the purpose.

Specific examples of the compound represented by the general formula (R) of this embodiment will be given, but it should not be construed that the compound of this embodiment is limited thereto.

(R-1)

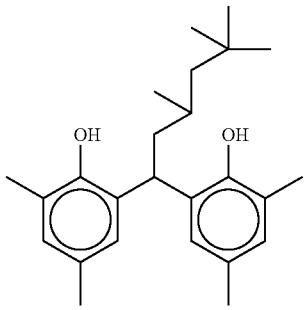

(R-2)

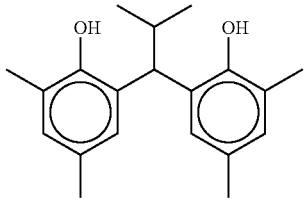

-continued
(R-3)
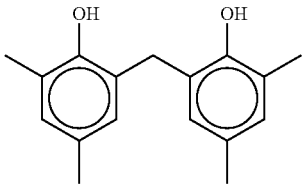
(R-4)
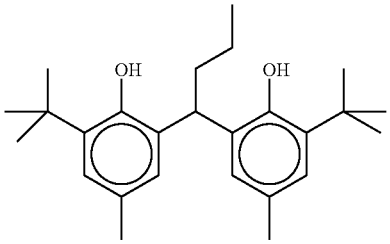
(R-5)
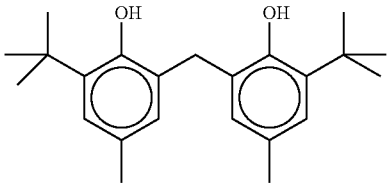
(R-6)
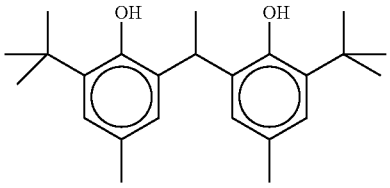
(R-7)
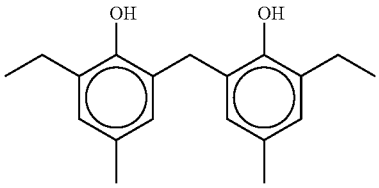
(R-8)
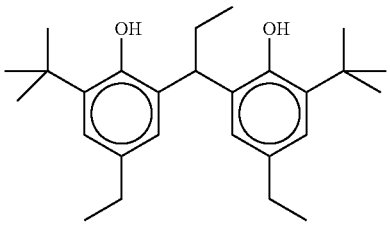
(R-9)
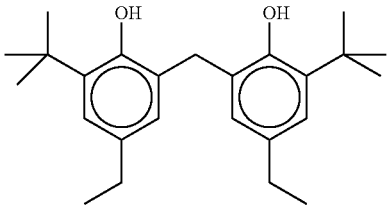
-continued
(R-10)
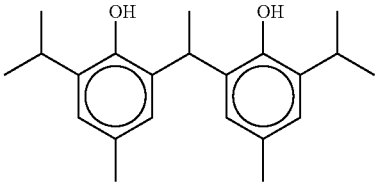
(R-11)
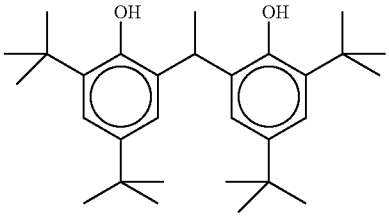
(R-12)
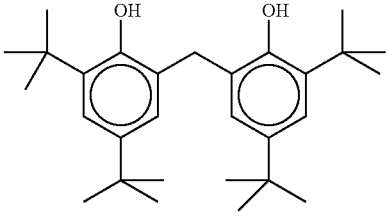
(R-13)
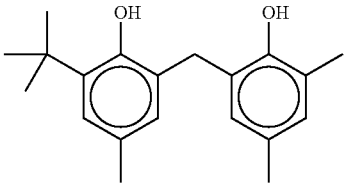
(R-14)
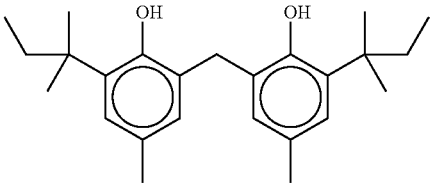
(R-15)
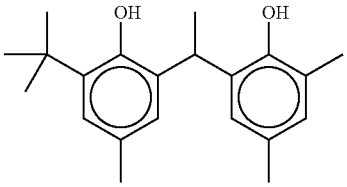
(R-16)
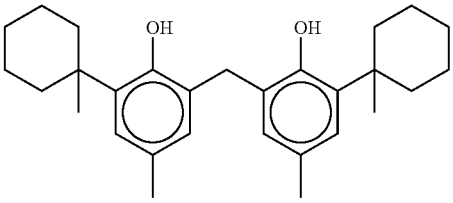

-continued
(R-17)
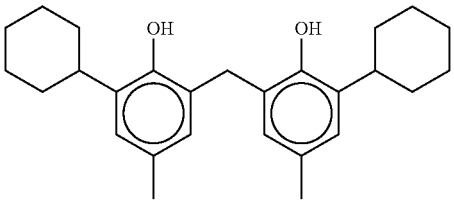
(R-18)
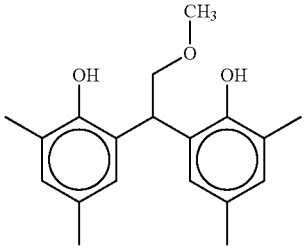
(R-19)
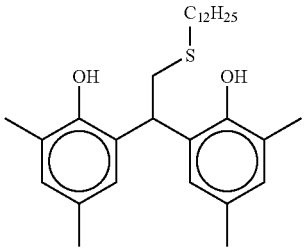
(R-20)
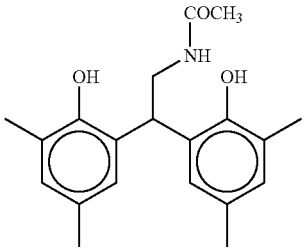
(R-21)
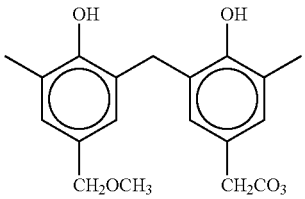
(R-22)
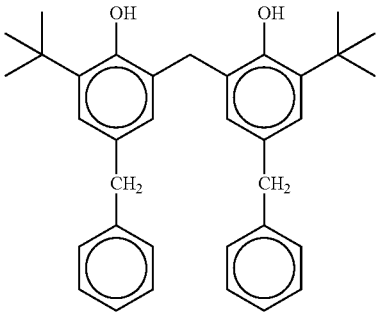
-continued
(R-23)
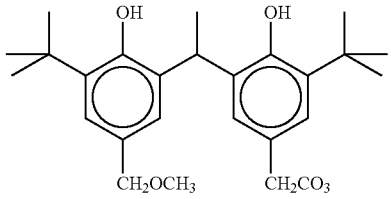
(R-24)
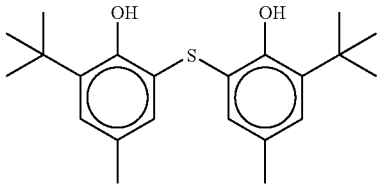
(R-25)
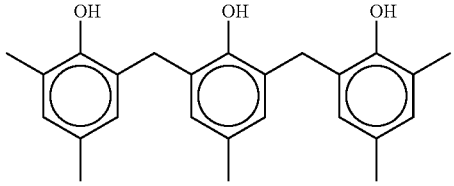
(R-26)
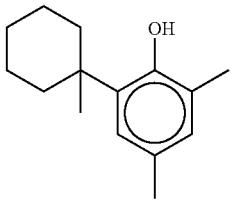
(R-27)
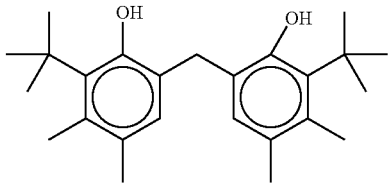
(R-28)
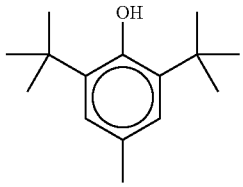
(R-29)
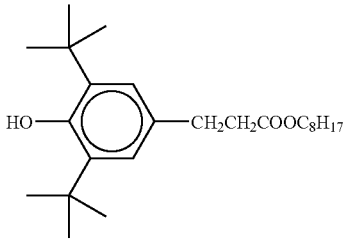

-continued (R-30)

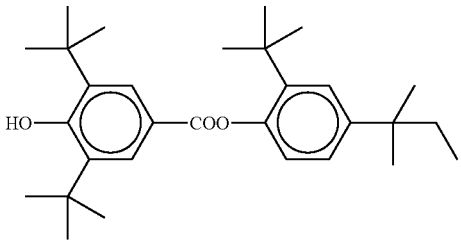

(R-31)

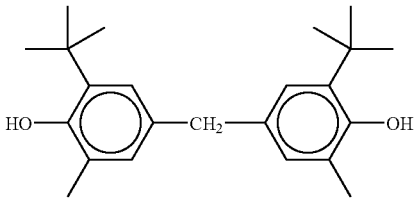

(R-32)

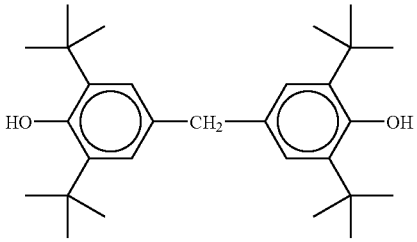

(R-33)

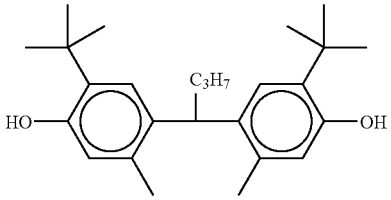

(R-34)

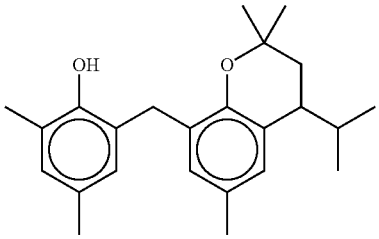

Especially, compounds represented by (R-1) to (R-20) are preferable.

In this embodiment, the addition amount of the reducing agent is preferably from 0.01 to 5.0 g/m$^2$, and more preferably from 0.1 to 3.0 g/m$^2$, and is preferably contained in an amount of from 5 to 50% by mole, and more preferably from 10 to 40% by weight per mole of silver on the plane having an image forming layer.

In this embodiment, though the reducing agent can be added to an image forming layer containing an organic silver salt and a photosensitive silver halide and an adjacent layer thereto, it is more preferable that the reducing agent is contained in the image forming layer.

In this embodiment, the reducing agent can be contained in a coating solution by any method in the solution state, the emulsified dispersion state, the solid fine particle dispersion state, and the like and then contained in the photosensitive material.

As the emulsification dispersion method that is well known, there is enumerated a method in which the reducing agent is dissolved using an oil such as dibutyl phthalate, tricresyl phosphate, glyceryl triacetate, and diethyl phthalate and a co-solvent such as ethyl acetate and cyclohexanone, to prepare mechanically an emulsified dispersion.

Also, as the solid fine particle dispersion method, there is enumerated a method in which the reducing agent is dispersed in a suitable solvent such as water using a ball mill, a colloid mill, a vibrating ball mill, a sand mill, a jet mill, a roll mill, or ultrasonic wave, to prepare a solid dispersion. Above all, a dispersion method using a sand mill is preferable. Incidentally, a protective colloid (for example, polyvinyl alcohol) or a surfactant (for example, anionic surfactants such as sodium triisopropylnaphthalenesulfonate (a mixture in which the substitution positions of the three isopropyl groups are different) may be used in this method. An antiseptic (for example, a benzoisothiazolinone sodium salt) can be contained in the aqueous dispersion.

Above all, the solid particle dispersion method is especially preferable. It is preferred to divide the reducing agent into fine particles having a mean particle size of from 0.01 μm to 10 μm, preferably from 0.05 μm to 5 μm, and more preferably from 0.1 μm to 1 μm and then add them. In this application, it is preferable that other solid dispersions are dispersed in the particle size of this range and used.

(Explanation of Development Accelerator)

In the photothermographic material of this embodiment, sulfonamidophenol based compounds represented by the general formula (A) described in JP-A-2000-267222 and JP-A-2000-330234, hindered - phenol based compounds represented by the general formula (II) described in JP-A-2001-92075, hydrazine based compounds represented by the general formula (I) described in JP-A-10-62895 and JP-A-11-15116 and those represented by the general formula (1) described in Japanese Patent Application No. 2001-074278, and phenol based or naphthol based compounds represented by the general formula (2) described in Japanese Patent Application No. 2000-76240 are preferably used as a development accelerator. Such a development accelerator is used in an amount ranging from 0.1 to 20% by mole, preferably from 0.5 to 10% by mole, and more preferably from 1 to 5% by mole based on the reducing agent. As the method of introducing the development accelerator into the photosensitive material, the same methods as in the case of the reducing agent are employable. Above all, it is especially preferable that the development accelerator is added as a solid dispersion or emulsified dispersion. In the case where the development accelerator is added as an emulsified dispersion, it is preferable that it is added as an emulsified dispersion dispersed in a high-boiling solvent that is a solid at the ambient temperature and a low-boiling co-solvent or that it is added as a so-called oil-less emulsified dispersion not using a high-boiling solvent.

In this embodiment, of the foregoing development accelerators, hydrazine based compounds represented by the general formula (1) described in Japanese Patent Application No. 2001-074278 and phenol based or naphthol based compounds represented by the general formula (2) described in Japanese Patent Application No. 2000-76240 are especially preferable.

Preferred specific examples of the development accelerator of this embodiment will be given below, but it should not be construed that this embodiment is limited thereto.

(A-1)

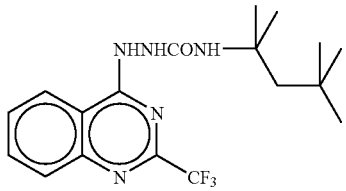

(A-2)

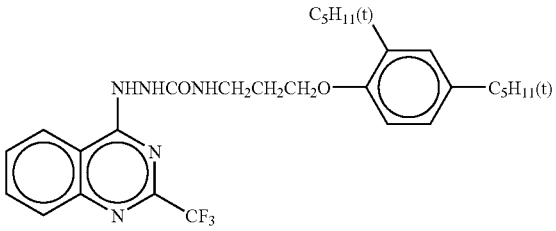

(A-3)

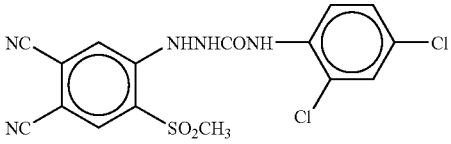

(A-4)

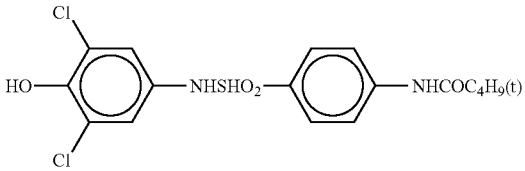

(A-5)

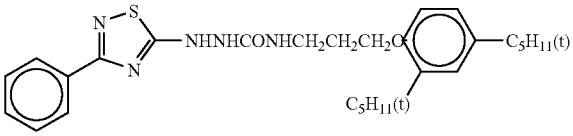

(A-6)

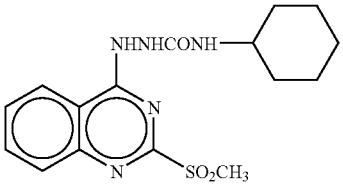

(A-7)

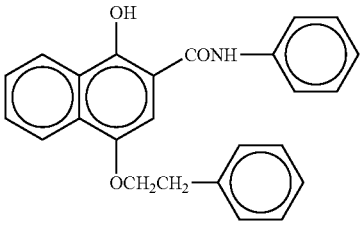

-continued (A-8)

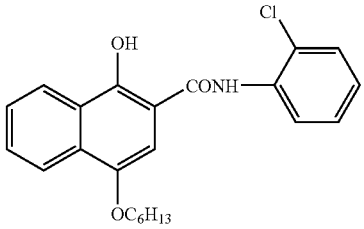

(A-9)

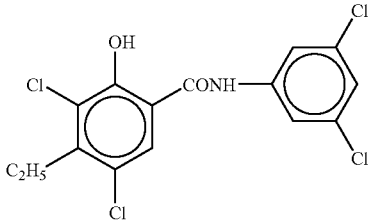

(A-10)

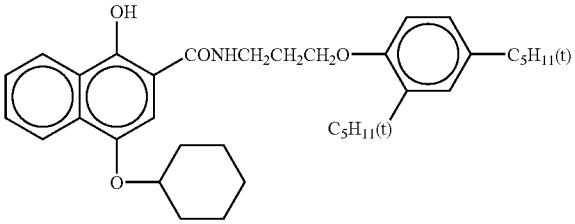

(Explanation of Hydrogen Bonding Compound)

In this embodiment, it is preferable to jointly use a non-reducing compound having a group capable of forming a hydrogen bond with the aromatic hydroxyl group (—OH) of the reducing agent or with an amino group when the reducing agent has an amino group.

Examples of the group capable of forming a hydrogen bond include a phosphoryl group, a sulfoxide group, a sulfonyl group, a carbonyl group, an amide group, an ester group, a urethane group, a ureido group, a tertiary amino group, and a nitrogen-containing aromatic group. Of these compounds, compounds having a phosphoryl group, a sulfoxide group, an amide group (provided that it does not have an >N—H group and is blocked as in >N—Ra (Ra represents a substituent other than H)), a urethane group (provided that it does not have an >N—H group and is blocked as in >N—Ra (Ra represents a substituent other than H)), or a ureido group (provided that it does not have an >N—H group and is blocked as in >N—Ra (Ra represents a substituent other than H)) are preferable.

In this embodiment, a compound represented by the following general formula (D) is especially preferable as the hydrogen bonding compound.

General Formula (D)

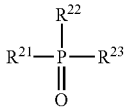

In the general formula (D), $R^{21}$ to $R^{23}$ each independently represents an alkyl group, an aryl group, an alkoxy group, an aryloxy group, an amino group, or a heterocyclic group, and these groups may be unsubstituted or have a substituent.

In the case where $R^{21}$ to $R^{23}$ each has a substituent, examples of the substituent include a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group, and a phosphoryl group. Of these substituents, alkyl groups or aryl groups such as a methyl group, an ethyl group, an isopropyl group, a t-butyl group, a t-octyl group, a phenyl group, a 4-alkoxyphenyl group, and a 4-acyloxyphenyl group are preferable.

Specific examples of the alkyl group represented by each of $R^{21}$ to $R^{23}$ include a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenethyl group, and a 2-pheoxypropyl group.

Examples of the aryl group include a phenyl group, a cresyl group, a xylyl group, a naphthyl group, a 4-t-butylphenyl group, a 4-t-octylphenyl group, a 4-anisidyl group, and a 3,5-dichlorophenyl group.

Examples of the alkoxy group include a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group, and a benzyloxy group.

Examples of the aryloxy group include a phenoxy group, a cresyloxy group, an isopropylphenoxy group, a 4-t-butylphenoxy group, a naphthoxy group, and a biphenyloxy group.

Examples of the amino group include a dimethylamino group, a diethylamino group, a dibutylamino group, a dioctylamino group, an N-methyl-N-hexylamino group, a dicyclohexylamino group, a diphenylamino group, and an N-methyl-N-phenylamino group.

It is preferable that $R^{21}$ to $R^{23}$ are each an alkyl group, an aryl group, an alkoxy group, or an aryloxy group. In view of the effects of this embodiment, it is preferable that at least one of $R^{21}$ to $R^{23}$ is an alkyl group or an aryl group, and it is more preferable that two or more of $R^{21}$ to $R^{23}$ are each an alkyl group or an aryl group. Also, from the standpoint that the compound is cheaply available, the case where $R^{21}$ to $R^{23}$ are the same group is preferable.

In this embodiment, specific examples of hydrogen bonding compounds including those represented by the general formula (D) will be given below, but it should not be construed that this embodiment is limited thereto.

(D-1)

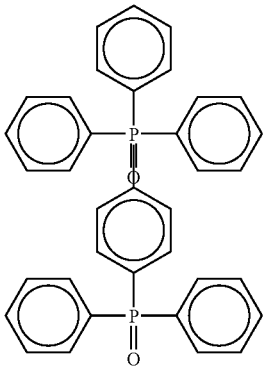

(D-2)

-continued (D-3)

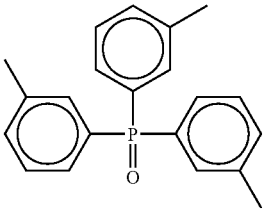

(D-4)

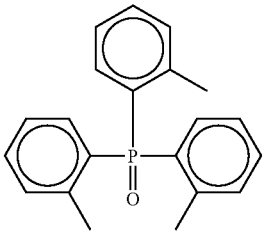

(D-5)

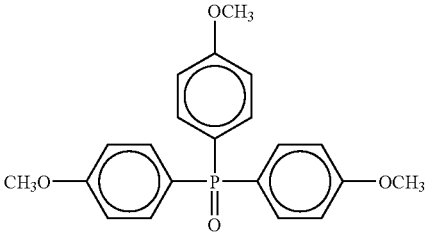

(D-6)

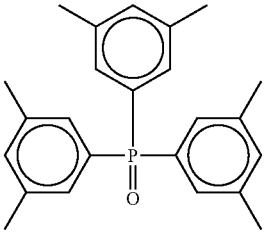

(D-7)

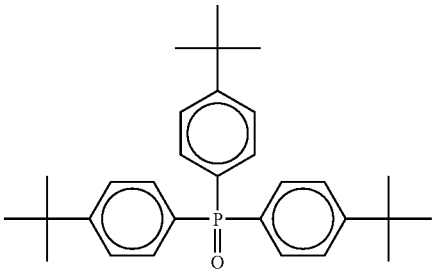

(D-8)

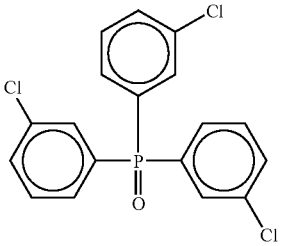

(D-9)

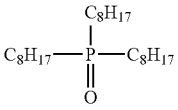

-continued (D-10)

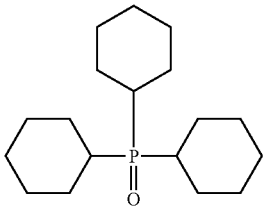

(D-11)

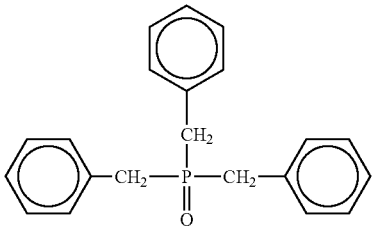

(D-12)

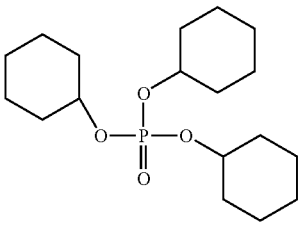

(D-13)

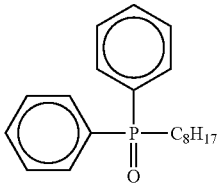

(D-14)

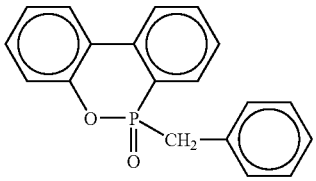

(D-15)

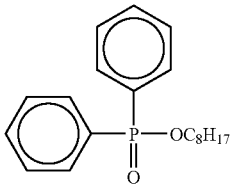

(D-16)

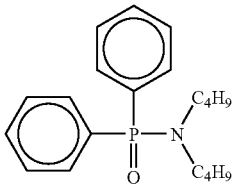

-continued (D-17)

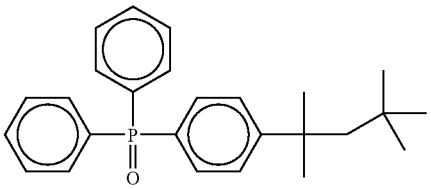

(D-18)

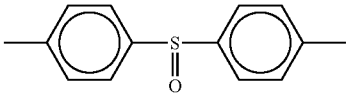

(D-19)

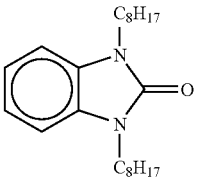

(D-20)

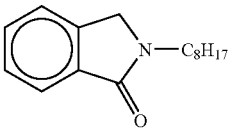

(D-21)

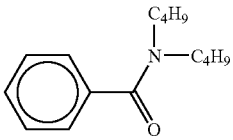

In addition to the foregoing compounds, specific examples of the hydrogen bonding compound include those described in Japanese Patent Application Nos. 2000-192191 and 2000-194811.

Likewise the reducing agent, the hydrogen bonding compound of this embodiment can be contained in a coating solution in the solution state, the emulsified dispersion state, or the solid fine particle dispersion state and then used in the photosensitive material. The compound of this embodiment forms a complex with a phenolic hydroxyl group-containing compound in the solution state through a hydrogen bond and can be isolated in the crystal state as a complex depending upon a combination of the reducing agent and the compound of the general formula (A) of this embodiment.

It is especially preferable from the standpoint of obtaining a stable performance to use the thus isolated crystal powder as a solid fine particle dispersion. Also, a method of mixing the reducing agent and the hydrogen bonding compound of this embodiment in the powered state and forming a complex at the time of dispersion in a sand grinder mill or the like using an adequate dispersant can be preferably employed.

The hydrogen bonding compound of this embodiment is preferably used in an amount ranging from 1 to 200% by mole, more preferably from 10 to 150% by mole, and further preferably from 30 to 100% by mole based on the reducing agent.

(Explanation of Binder)

A binder of the organic silver salt-containing layer of this embodiment may be any polymer. A suitable binder is transparent or semi-transparent and generally colorless. Examples thereof include natural resins, polymers or copolymers, synthetic resins, polymers or copolymers, and film-forming media, for example, gelatins, rubbers, poly (vinyl alcohol)s, hydroxyethyl celluloses, cellulose acetates, cellulose acetate butyrates, poly(vinyl-pyrrolidone)s, casein, starch, poly(acrylate)s, poly(methyl methacrylate)s, poly (vinyl chloride)s, poly(methacrylate)s, styrene-maleic anhydride copolymers, styrene-acrylonitrile copolymers, styrene-butadiene copolymers, poly(vinyl acetal)s (for example, poly(vinyl formal) and poly(vinyl butyral)), poly (ester)s, poly(urethane)s, phenoxy resins, poly(vinylidene chloride)s, poly(ethoxide)s, poly(carbonate)s, poly(vinyl acetate)s, poly(olefin)s, cellulose esters, and poly(amide)s. The binder may be coated and formed from water or an organic solvent or emulsion.

In this embodiment, the binder of the layer containing an organic silver salt preferably has a glass transition temperature of from 10° C. to 80° C., more preferably from 20° C. to 70° C., and further preferably from 23° C. to 65° C.

Incidentally, in this specification, Tg is calculated according to the following expression.

$$1/Tg=\Sigma(Xi/Tgi)$$

Here, the polymer is considered to be one resulting from copolymerization of monomer components in the number of n of i=1 to n. Xi represents a weight fraction of the i-th monomer ($\Sigma Xi=1$), and Tgi represents a glass transition temperature (absolute temperature) of a homopolymer of the i-th monomer, provided that $\Sigma$ takes the sum of i=1 to n.

Incidentally, as the glass transition temperature value (Tgi) of a homopolymer of each monomer, values described in J. Brandrup and E. J. Immergut, *Polymer Handbook* (3rd Edition), Wiley-Interscience, 1989 were employed.

The polymer as the binder may be used singly or in admixture of two or more thereof as the need arises. Also, a combination of a polymer having a glass transition temperature of 20° C. or higher with a polymer having a glass transition temperature of lower than 20° C. is employable. In the case where a blend of two or more polymers having a different Tg is used, it is preferable that its weight average Tg falls within the foregoing range.

In this embodiment, in the case where the organic silver salt-containing layer is formed by coating a coating solution in which water accounts for 30% by weight or more of the solvent and drying, further in the case where the binder of the organic silver salt-containing layer is soluble or dispersible in an aqueous solvent (water solvent), and especially in the case where the binder is made of a latex of a polymer having an equilibrium water content at 25° C. and 60% RH of not more than 2% by weight, the performance is enhanced.

In the most preferred embodiment, the binder is prepared in such a manner that the ion conductivity is not more than 2.5 mS/cm. As such a preparation method, there is enumerated a method in which after synthesis of a polymer, the polymer is purified using a separation functioning membrane.

The aqueous solution in which the foregoing polymer is soluble or dispersible, as referred to herein, means water or a mixture of water and not more than 70% by weight of a water-miscible organic solvent.

Examples of the water-miscible organic solvent include alcohols such as methyl alcohol, ethyl alcohol, and propyl alcohol; cellosolves such as methyl cellosolve, ethyl cellosolve, and butyl cellosolve; ethyl acetate; and dimethylformamide.

Also, the "equilibrium water content at 25° C. and 60% RH" as referred to herein can be expressed using a weight W1 of a polymer in the moisture conditioning equilibrium state under an atmosphere at 25° C. and 60% RH and a weight W0 of a polymer in the absolute dry state at 25° C. in the following manner.

$$\text{(Equilibrium water content at 25° C. and 60\% RH)}=[(W1-W0)/W0]\times 100\ \text{(\% by weight)}$$

With respect to the definition and measurement of the water content, for example, *Kobunshi Kogaku Koza* 14, *Kobunshi Zairyo Shikenho* (compiled by The Society of Polymer Science, Japan and published by Chijinshokan Co., Ltd.) can be made hereof by reference.

The binder polymer of this embodiment preferably has an equilibrium water content at 25° C. and 60% RH of not more than 2% by weight, more preferably from 0.01% by weight to 1.5% by weight, and further preferably from 0.02% by weight to 1% by weight.

As the binder of this embodiment, a polymer that is dispersible in an aqueous solvent is especially preferable. Examples of the dispersion state include a latex in which fine particles of a water-insoluble hydrophobic polymer are dispersed and a dispersion in which a polymer molecule is dispersed in the molecular state or while forming a micell, and all of them are preferable. The dispersed particles preferably have a mean particle size in the range of from about 1 to 50,000 nm, and more preferably from about 5 to 1,000 nm. The particle size distribution of the dispersed particles is not particularly limited, and all of ones having a broad particle size distribution and ones having a monodispersed particle size distribution are employable.

In a preferred embodiment of the polymer that is dispersible in an aqueous solvent according to this embodiment, hydrophobic polymers such as acrylic polymers, poly(ester)s, rubbers (for example, SBR resins), poly(urethane)s, poly (vinyl chloride)s, poly (vinyl acetate)s, poly(vinylidene chloride)s, and poly(olefin)s can be preferably used. These polymers may be a linear polymer, a branched polymer, or a crosslinked polymer, and may be a so-called homopolymer resulting from polymerization of a single monomer or a copolymer resulting from polymerization of two or more kinds of monomers. In the case of a copolymer, the copolymer may be a random copolymer or a block copolymer.

These polymers have a number average molecular weight of from 5,000 to 1,000,000, and preferably from 10,000 to 200,000. When the molecular weight is too low, the dynamic strength of the emulsion layer is insufficient, whereas when it is too high, the film forming property is poor, and hence, such is not preferable.

Specific examples of the preferred polymer latex include those enumerated below. In the following, the polymer latices are expressed in terms of starting monomers, the numerical values in the parentheses are % by weight, and the molecular weights are a number average molecular weight. In the case where polyfunctional monomers are used, since a crosslinking structure is formed, the concept of molecular weight cannot be applied. Therefore, the resulting latices are described in terms of "crosslinking", and the description of molecular weight is omitted. Tg represents a glass transition temperature.

P-1: Latex of -MMA(70)-EA(27)-MAA(3)-(molecular weight: 37,000, Tg: 61° C.)

P-2: Latex of -MMA(70)-2EHA(20)-St(5)-AA(5)- (molecular weight: 40,000, Tg: 59° C.)

P-3: Latex of -St(50)-Bu(47)-MAA(3)-(crosslinking, Tg: −17°C.)

P-4: Latex of -St(68)-Bu(29)-AA(3)-(crosslinking, Tg: 17° C.)

P-5: Latex of -St(71)-Bu(26)-AA(3)-(crosslinking, Tg: 24° C.)

P-6: Latex of -St(70)-Bu(27)-IA(3)-(crosslinking)

P-7: Latex of -St(75)-Bu(24)-AA(1)-(crosslinking, Tg: 29° C.)

P-8: Latex of -St(60)-Bu(35)-DVB(3)-MAA(2)-(crosslinking)

P-9: Latex of -St(70)-Bu(25)-DVB(2)-AA(3)-(crosslinking)

P-10: Latex of -VC(50)-MMA(20)-EA(20)-AN(5)-AA(5)-(molecular weight: 80,000)

P-11: Latex of -VDC(85)-MMA(5)-EA(5)-MAA(5)-(molecular weight: 67,000)

P-12: Latex of -Et(90)-MAA(10)-(molecular weight: 12,000)

P-13: Latex of -St(70)-2EHA(27)-AA(3)-(molecular weight: 130,000, Tg: 43° C.)

P-14: Latex of -MMA(63)-EA(35)-AA(2)-(molecular weight: 33,000, Tg: 47° C.)

P-15: Latex of -St(70.5)-Bu(26.5)-AA(3)-(crosslinking, Tg: 23° C.)

P-16: Latex of -St(69.5)-Bu(27.5)-AA(3)-(crosslinking, Tg: 20.5° C.)

The abbreviations of the foregoing structures represent the following monomers. MMA: methyl methacrylate, EA: ethyl acrylate, MMA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The foregoing polymer latices are commercially available, and the following polymers can be utilized. Examples of acrylic polymers include CEVIAN A-4635, CEVIAN A-4718 AND CEVIAN A-4601 (manufactured by Daicel Chemical Industries, Ltd.) and Nipol Lx811, Nipol Lx814, Nipol Lx821, Nipol Lx820 and Nipol Lx857 (manufactured by Zeon Corporation); examples of poly(esters)s include FINETEX ES650, FINETEX ES611, FINETEX ES675 and FINETEX ES850 (manufactured by Dainippon Ink and Chemicals, Incoporated) and WD-size and WMS (manufactured by Eastman Chemical Company); examples of poly (urethane)s include HYDRAN AP10, HYDRAN AP20, HYDRAN AP30 and HYDRAN AP40 (manufactured by Dainippon Ink and Chemicals, Incorporated); examples of rubbers include LACSTAR 7310K, LACSTAR 3307B, LACSTAR 4700H and LACSTAR 7132C (manufactured by Dainippon Ink and Chemicals, Incorporated) and Nipol Lx416, Nipol Lx410, Nipol Lx438C and Nipol Lx2507 (manufactured by Zeon Corporation); examples of poly (vinyl chloride)s include G351 and G576 (manufactured by Zeon Corporation); examples of poly-(vinylidene chloride) s include L502 and L513 (manufactured by Asahi Kasei Corporation); and examples of poly(olefin)s include CHEMIPEARL S120 and CHEMIPEARL SA100 (manufactured by Mitsui Chemicals, Inc.).

These polymer latices may be used singly or in admixture of two or more thereof as the need arises.

As the polymer latex to be used in this embodiment, a latex of a styrene-butadiene copolymer is especially preferable. A weight ratio of the monomer unit of styrene to the monomer unit of butadiene in the styrene-butadiene copolymer is preferably from 40/60 to 95/5. Also, a proportion of the monomer unit of styrene and the monomer unit of butadiene occupying in the copolymer is preferably from 60 to 99% by weight. A preferred range of the molecular weight is the same as that described previously.

Examples of the latex of a styrene-butadiene copolymer that is preferably used in this embodiment include the foregoing P-3 to P-8, P14 and P15 and commercially available LACSTAR 3307B, LACSTAR 7132C and Nipol Lx416.

If desired, hydrophilic polymers such as gelatin, polyvinyl alcohol, methyl cellulose, hydroxypropyl cellulose, and carboxymethyl cellulose may be added to the organic silver salt-containing layer of the photosensitive material of this embodiment.

The addition amount of such a hydrophilic polymer is preferably not more than 30% by weight, and more preferably not more than 20% by weight of the whole of binders of the organic silver salt-containing layer.

As the organic silver salt-containing layer (i.e., the image forming layer) of this embodiment, one formed of a polymer latex using a binder is preferable. With respect to the amount of the binder of the organic silver salt-containing layer, a weight ratio of the whole of binders to the organic silver salt is preferably in the range of from 1/10 to 10/1, and more preferably from 1/5 to 4/1.

Also, such an organic silver salt-containing layer is usually a photosensitive layer (emulsion layer) containing a photosensitive silver halide as a photosensitive silver salt. In such a case, the weight ratio of the whole of binders to the silver halide is preferably in the range of from 400 to 5, and more preferably from 200 to 10.

The amount of the whole of binders of the image forming layer of this embodiment is in the range of from 0.2 to 30 $g/m^2$, and more preferably from 1 to 15 $g/m^2$. In the image forming layer of this embodiment, a crosslinking agent for crosslinking, a surfactant for improving the coating property, and so on may be added.

In this embodiment, as a solvent of the coating solution for organic salt-containing layer of the photosensitive material (for the sake of simplification, both of a solvent and a dispersion medium will be hereinafter referred to as "solvent"), an aqueous solvent containing 30% by weight or more of water is preferable. As components other than water, arbitrary water-miscible organic solvents such as methyl alcohol, ethyl alcohol, isopropyl alcohol, methyl cellosolve, ethyl cellosolve, dimethylformamide, and ethyl acetate may be used. The water content of the solvent is more preferably 50% by weight or more, and further preferably 70% by weight or more.

Preferred examples of formulations of the solvent include not only water (100) but also water/methyl alcohol (90/10), water/methyl alcohol (70/30), water/methyl alcohol/dimethylformamide (80/15/5), water/methyl alcohol/ethyl cellosolve (85/10/5), and water/methyl alcohol/isopropyl alcohol (85/10/5) (the numerical values are % by weight).

(Explanation of Antifoggant)

In this embodiment, it is preferable that a compound represented by the following general formula (H) is contained as an antifoggant.

$$Q—(Y)_n—C(Z_1)(Z_2)X \qquad \text{General Formula (H)}$$

In the general formula (H), Q represents an alkyl group, an aryl group, or a heterocyclic group; Y represents a divalent connecting group; n represents 0 or 1; $Z_1$ and $Z_2$ each represents a halogen atom; and X represents a hydrogen atom or an electron withdrawing group.

Q preferably represents a phenyl group substituted with an electron withdrawing group having a positive value of the Hammett's substituent constant σp. With respect to the Hammett's substituent constant, *Journal of Medicinal Chemistry*, 1973, Vol. 16, No. 11, 1207-1216 can be made hereof by reference.

Examples of such electron withdrawing groups include halogen atoms (for example, a fluorine atom (σp value: 0.06), a chlorine atom (σp value: 0.23), a bromine atom (σp value: 0.23), and an iodine atom (σp value: 0.18)), trihalomethyl groups (for example, tribromomethyl (σp value: 0.29), trichloromethyl (σp value: 0.33), and trifluoromethyl (σp value: 0.54)), a cyano group (σp value: 0.66), a nitro group (σp value: 0.78), aliphatic, aryl or heterocyclic sulfonyl groups (for example, methanesulfonyl (σp value: 0.72)), aliphatic, aryl or heterocyclic acyl groups (for example, acetyl (σp value: 0.50) and benzoyl (σp value: 0.43)), alkynyl groups (for example, C≡CH (σp value: 0.23)), aliphatic, aryl or heterocyclic oxycarbonyl groups (for example, methoxycarbonyl (σp value: 0.45) and phenoxycarbonyl (σp value: 0.44)), a carbamoyl group (σp value: 0.36), a sulfamoyl group (σp value: 0.57), a sulfoxide group, a heterocyclic group, and a phosphoryl group.

The σp value is preferably in the range of from 0.2 to 2.0, and more preferably from 0.4 to 1.0.

As the electron withdrawing group, a carbamoyl group, an alkoxycarbonyl group, an alkylsulfonyl group, an alkylphosphoryl group, a carboxyl group, an alkyl or aryl carbonyl group, and an aryl sulfonyl group are preferable; a carbamoyl group, an alkoxycarbonyl group, an alkylsulfonyl group, and an alkylphosphoryl group are especially preferable; and a carbamoyl group is most preferable.

X is preferably an electron withdrawing group; more preferably a halogen atom, an aliphatic, aryl or heterocyclic sulfonyl group, an aliphatic, aryl or heterocyclic acyl group, an aliphatic, aryl or heterocyclic oxycarbonyl group, a carbamoyl group, or a sulfamoyl group; and especially preferably a halogen atom.

Of the halogen atoms, a chlorine atom, a bromine atom, and an iodine atom are preferable; a chlorine atom and a bromine atom are further preferable; and a bromine atom is especially preferable.

Y preferably represents —C(=O)—, —SO—, or —$SO_2$—; more preferably —C(=O)— or —$SO_2$—; and especially preferably —$SO_2$—. n represents 0 or 1, and preferably 1.

Specific examples of the compound of the general formula (H) according to this embodiment will be given below, but it should not be construed that this embodiment is limited thereto.

(H-1)

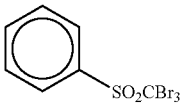

(H-2)

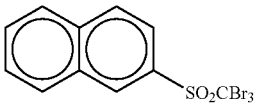

-continued (H-3)

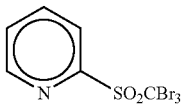

(H-5)

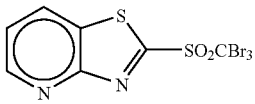

(H-6)

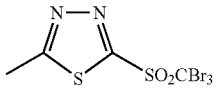

(H-7)

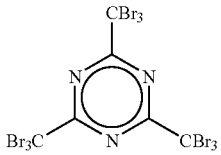

(H-8)

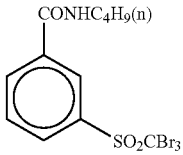

(H-9)

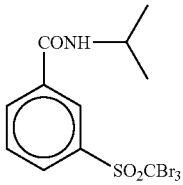

(H-10)

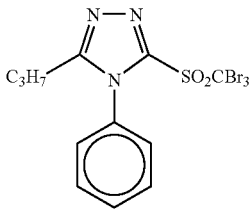

(H-11)

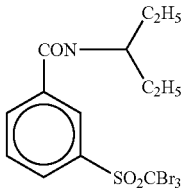

(H-12)

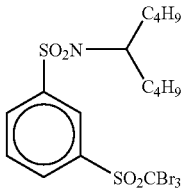

-continued (H-13)

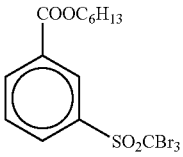

(H-14)

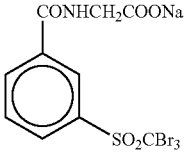

(H-15)

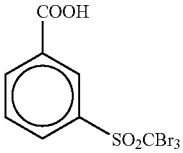

(H-16)

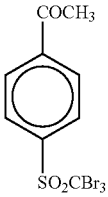

(H-17)

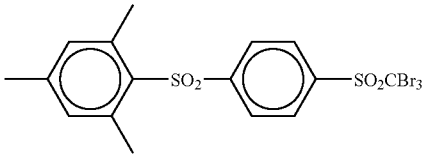

(H-18)

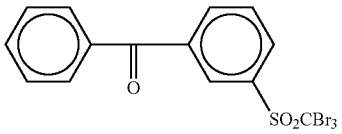

(H-19)

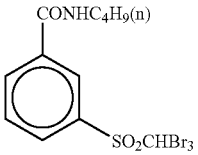

(H-20)

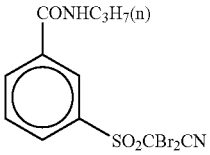

(H-21)

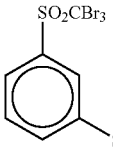

-continued (H-22)

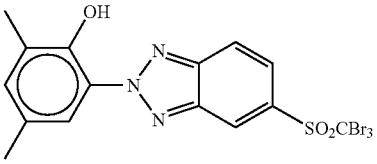

(H-23)

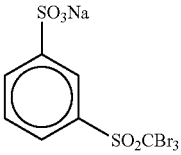

(H-24)

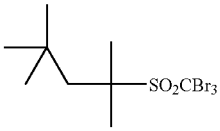

The compound represented by the general formula (H) according to this embodiment is preferably used in an amount ranging from $10^{-4}$ to 0.8 moles, more preferably from $10^{-3}$ to 0.1 moles, and further preferably from $5\times10^{-3}$ to 0.05 moles per mole of the non-photosensitive silver salt of the image forming layer.

In particular, in the case where a silver halide having a formulation with a high silver iodide content according to this embodiment, for the purpose of obtaining a sufficient antifogging effect, the addition amount of the compound of the general formula (H) is important, and it is most preferable to use the compound of the general formula (H) in an amount ranging from $5\times10^{-3}$ to 0.03 moles.

In this embodiment, as a method of containing the compound represented by the general formula (H), the foregoing methods of containing the reducing agent can be enumerated.

The compound represented by the general formula (H) preferably has a melting point of not higher than 200° C., and more preferably not higher than 170° C.

Examples of other organic polyhalogen compounds that are used in this embodiment include those disclosed in patents described in paragraph Nos. 0111 to 0112 of JP-A-11-65021. Especially, organic polyhalogen compounds represented by the formula (P) of Japanese Patent Application No. 11-87297, organic polyhalogen compounds represented by the general formula (II) of JP-A-10-339934, and organic polyhalogen compounds described in Japanese Patent Application No. 11-205330 are preferable.

(Other Antifoggants)

Examples of other antifoggants include silver(II) salts described in paragraph No. 0113 of JP-A-11-65021, benzoic acids described in paragraph No. 0114 of ibid., salicylic acid derivatives described in JP-A-2000-206642, formalin scavenger compounds represented by the formula (S) described in JP-A-2000-221634, triazine compounds according to claim 9 of JP-A-11-352624, and 4-hydroxy-6-methyl-1,3, 3a, 7-tetrazaindene that is a compound represented by the general formula (III) described in JP-A-6-11791.

As the antifoggant, stabilizer and stabilizer precursor that can be used in this embodiment, compounds described in paragraph No. 0070 of JP-A-10-62899, compounds described in patents cited at page 20, line 57 to page 21, line 7 of European Patent No. 0803764A1, and compounds described in JP-A-9-281637 and JP-A-9-329864 are enumerated.

In this embodiment, the photothermographic material may contain an azolium salt for the purpose of antifogging. Examples of the azolium salt include compounds represented by the general formula (XI) described in JP-A-59-193447, compounds described in JP-B-55-12581, and compounds represented by the general formula (II) described in JP-A-60-153039. Though the azolium salt may be added in any site of the photosensitive material, it is preferably added to a layer in the side having a photosensitive layer, and more preferably an organic silver salt-containing layer.

The timing of adding the azolium salt may be any step of preparing a coating solution. In the case where the azolium salt is added to the organic silver salt-containing layer, though it may be added in any step of from the time of preparation of an organic silver salt until the time of preparation of a coating solution, it is preferable that the azolium salt is added after the preparation of an organic silver salt until just before coating. The azolium salt may be added in any form of a powder, a solution, or a fine particle dispersion. Also, the azolium salt may be added as a solution mixed with other additives such as a sensitizing dye, a reducing agent, and a color toner.

In this embodiment, though the addition amount of the azolium salt may be any amount, it is preferably from $1\times10^{-6}$ moles to 2 moles, and more preferably from $1\times10^{-3}$ moles to 0.5 moles per mole of silver.

(Other Additives)

1) Mercapto, Disulfide and Thione Compounds:

In this embodiment, for the purposes of controlling the development by retarding or accelerating the development, enhancing the spectral sensitization efficiency, and enhancing the preservability before and after the development, mercapto compounds, disulfide compounds and thione compounds can be contained. Compounds described in paragraph Nos. 0067 to 0069 of JP-A-10-62899 and compounds represented by the general formula (I) descried in JP-A-10-186572 are enumerated, and specific examples thereof are described in paragraph Nos. 0033 to 0052 of JP-A-10-186572, at page 20, lines 36 to 56 of European Patent No. 0803764A1 and in Japanese Patent Application No. 11-273670. Of these compounds, mercapto-substituted heteroaromatic compounds are preferable.

2) Color Toner:

In the photothermographic material of this embodiment, it is preferred to add a color toner. The color toner is described in paragraph Nos. 0054 to 0055 of JP-A-10-62899, at page 21, lines 23 to 48 of European Patent No. 0803764A1 and in JP-A-2000-356317 and Japanese Patent Application No. 2000-187298. Especially, phthalazinones (for example, phthalazinone and phthalazinone derivatives or metal salts, such as 4-(1-naphthyl)phthalazinone, 6-chlorophthalazinone, 5,7-dimethoxyphthalazinone, and 2,3-dihydro-1,4-phthalazinedione); combinations of a phthalazione and a phthalic acid (for example, phthalic acid, 4-methylphthalic acid, 4-nitrophthalic acid, diammonium phthalate, sodium phthalate, potassium phthalate, and tetrachlorophthalic anhydride); and phthalazines (for example, phthalazine and phthalazine derivatives or metal salts, such as 4-(1-naphthyl) phthalazine, 6-isopropylphthalazine, 6-t-butylphthalazine, 6-chlorophthalazine, 5,7-dimethoxyphthalazine, and 2,3-dihydrophthalazine) are preferable. In the combination with a silver halide having a formulation of high silver iodide content, combinations of a phthalazine and a phthalic acid are especially preferable.

The addition amount of the phthalazine is preferably from 0.01 moles to 0.3 moles, more preferably from 0.02 to 0.2 moles, and especially preferably from 0.02 to 0.1 moles per mole of the organic silver salt. This addition amount is an important factor for the development acceleration that is a problem of the silver halide emulsion having a formulation of high silver iodide content of this embodiment, and by choosing an adequate addition amount, it becomes possible to realize both sufficient developability and low fog.

3) Plasticizer and Lubricant:

A plasticizer and a lubricant that can be used in the photosensitive layer of this embodiment are described in paragraph No. 0117 of JP-A-11-65021. The lubricant is described in paragraph Nos. 0061 to 0064 of JP-A-11-84573 and paragraph Nos. 0049 to 0062 of Japanese Patent Application No. 11-106881.

4) Dye and Pigment:

From the viewpoints of improving the color tone, preventing the generation of interference fringe at the time of laser exposure, and preventing the irradiation, a variety of dyes and pigments (for example, C.I. Pigment Blue 60, C.I. Pigment Blue 64, and C.I. Pigment Blue 15:6) can be used. These dyes and pigments are described in detail in WO 98/36322, JP-A-10-268465, and JP-A-11-338098.

5) Superhigh Contrast Agent:

For the sake of forming a superhigh contrast image suitable for application to printing plate-making, it is preferable to add a superhigh contrast agent to the image forming layer. The superhigh contrast agent and its addition method and addition amount are described in paragraph No. 0118 of JP-A-11-65021 and paragraph Nos. 0136 to 0193 of JP-A-11-223898. Also, compounds of the formula (H), formulae (1) to (3), and formulae (A) and (B) described in Japanese Patent Application No. 11-87297 and compounds of the general formulae (III) to (V) (specific compounds: formulae 21 to 24) described in Japanese Patent Application N., 11-91652 are enumerated. Further, contrast agent accelerators are described in paragraph No. 0102 of JP-A-11-65021 and paragraph Nos. 0194 to 0195 of JP-A-11-223898.

In order to use formic acid or a formic acid salt as a strong fogging substance, the formic acid or formic acid salt is preferably contained in an amount of not more than 5 mmoles, and more preferably not more than 1 mmole per mole of silver in the side having an image forming layer containing a photosensitive silver halide.

In the photothermographic material of this embodiment, in the case where a superhigh contrast agent is used, it is preferred to jointly use an acid or a salt thereof formed by hydrating phosphorus pentoxide. Examples of the acid or its salt formed by hydrating phosphorus pentoxide include metaphosphoric acid (or salts thereof), pyrophosphoric acid (or salts thereof), orthophosphoric acid (or salts thereof), triphosphoric aid (or salts thereof), tetraphosphoric acid (or salts thereof), and hexametaphosphoric acid (or salts thereof). Especially, preferred examples of the acid or its salt formed by hydrating phosphorus pentoxide include orthophosphoric acid (or salts thereof) and hexametaphosphoric acid (or salts thereof). Specific examples of salts include sodium orthophosphate, sodium dihydrogenorthophosphate, sodium hexametaphosphate, and ammonium hexametaphosphate.

Though the use amount (coating amount per 1 $m^2$ of the photosensitive material) of the acid or its salt formed by hydrating phosphorus pentoxide may be a desired amount depending upon the performances such as sensitivity and fog, it is preferably from 0.1 to 500 $mg/m^2$, and more preferably from 0.5 to 100 $mg/m^2$.

(Preparation and Coating of Coating Solution)

The preparation temperature of a coating solution for image forming layer of this embodiment is preferably from 30° C. to 65° C., more preferably 35° C. or higher and lower than 60° C., and further preferably from 35° C. to 55° C. Also, it is preferable that the temperature of a coating solution for image forming layer immediately after adding a polymer latex is kept at from 30° C. to 65° C.

2. Layer Construction and other Constructive Components:

The photothermographic material of this embodiment can have a non-photosensitive layer in addition to the image forming layer. The non-photosensitive layer can be classified into (a) a surface protective layer to be provided on the image forming layer (far side from the support), (b) an interlayer to be provided between the plural number of image forming layers or between the image forming layer and the protective layer, (c) an undercoating layer to be provided between the image forming layer and the support, and (d) a back layer to be provided in the opposite side of the image forming layer depending upon the alignment thereof.

Also, though a layer acting as an optical filter can be provided, this layer is provided as the layer (a) or (b). An anti-halation layer is provided in the photosensitive material as the layer (c) or (d).

1) Surface Protective Layer:

In the photothermographic material of this embodiment, a surface protective layer can be provided for the purpose of preventing sticking of the image forming layer. The surface protective layer may be a single layer or the plural number of layers. The surface protective layer is described in paragraph Nos. 0119 to 0120 of JP-A-11-65021 and Japanese Patent Application No. 2000-171936.

As a binder of the surface protective layer of this embodiment, gelatin is preferable, but it is also preferable to use or jointly use polyvinyl alcohol (PVA). As the gelatin, inert gelatin (for example, Nitta Gelatin 750), phthalated gelatin (for example, Nitta Gelatin 801), and the like can be used.

As PVA, those described in paragraph Nos. 0009 to 0020 of JP-A-2000-171936 are enumerated, and examples thereof include PVA-105 as completely hydrolyzed polyvinyl alcohol, PVA-205 and PVA-335 as partially hydrolyzed polyvinyl alcohol, and MP-203 as modified polyvinyl alcohol (all of which are a trade name of Kuraray Co., Ltd.).

The coating amount of polyvinyl alcohol (per 1 $m^2$ of the support) of the protective layer (per one layer) is preferably from 0.3 to 4.0 $g/m^2$, and more preferably from 0.3 to 2.0 $g/m^2$.

The coating amount of the whole of binders (including the water-soluble polymer and latex polymer) (per 1 $m^2$ of the support) of the surface protective layer (per one layer) is preferably from 0.3 to 5.0 $g/m^2$, and more preferably from 0.3 to 2.0 $g/m^2$.

2) Anti-halation Layer:

In the photothermographic material of this embodiment, an anti-halation layer can be provided in the far side from an exposure light source against the photosensitive layer. The anti-halation layer is described in paragraph Nos. 0123 to 0124 of JP-A-11-65021, JP-A-11-223898, JP-A-9-230531, JP-A-10-36695, JP-A-10-104779, JP-A-11-231457, JP-A-11-352625, and JP-A-11-352626.

An anti-halation dye having absorption in the exposure wavelength is contained in the anti-halation-layer. In the case where the exposure wavelength is present in the infrared region, an infrared absorbing dye may be used. In that case, a dye not having absorption in the visible region is preferable.

In the case where the halation is prevented using a dye having absorption in the visible region, it is preferable that after the image formation, the color of the dye does not substantially remain. It is preferred to employ a measure for decolorization caused due to heat of the thermal development, and it is especially preferred to add a thermally decolorable dye and a base precursor to the non-photosensitive layer to make it function as an anti-halation layer. These technologies are described in JP-A-11-231457.

The addition amount of the decolorable dye is determined depending upon the utility of the dye. In general, the decolorable dye is used in an amount such that when measured in a desired wavelength, the optical density (absorbance) exceeds 0.1. The optical density is preferably from 0.2 to 2. The amount of the dye for obtaining such an optical density is in general from about 0.001 to 1 $g/mm^2$.

Incidentally, when the dye is decolorized in this way, it is possible to reduce the optical density after the thermal development to not more than 0.1. Two or more kinds of decolorable dyes may be used jointly in thermally decolorable recording materials or photothermographic materials. Similarly, two or more kinds of base precursors may be used jointly.

In the thermal decolorization using a decolorable dye and a base precursor, it is preferred from the standpoint of thermal decoloring property, etc. to jointly use a substance (for example, diphenylsulfone and 4-chlorophenyl (phenyl)-sulfone), which is capable of lowering the melting point by 3° C. or more when mixed with a base precursor described in JP-A-11-352626.

3) Back Layer:

A back layer that can be applied in this embodiment is described in paragraph Nos. 0128 to 0130 of JP-A-11-65021.

In this embodiment, it is possible to add a coloring agent having an absorption maximum at from 300 to 450 nm for the purpose of improving the silver color tone and the change of image with time. Such a coloring agent is described in, for example, JP-A-62-210458, JP-A-63-104046, JP-A-63-103235, JP-A-63-208846, JP-A-63-306436, JP-A-63-314535, JP-A-01-61745, and Japanese Patent Application No. 11-276751. The coloring agent is usually added in an amount ranging from 0.1 $mg/m^2$ to 1 $g/m^2$, and the layer to which the coloring agent is added is preferably the back layer to be provided in the opposite side of the photosensitive layer.

4) Matting Agent:

In this embodiment, it is preferable to add a matting agent to the surface protective layer and the back layer for the purpose of improving traveling property. The matting agent is described in paragraph Nos. 0126 to 0127 of JP-A-11-65021.

A coating amount of the matting agent is preferably from 1 to 400 $mg/m^2$, and more preferably from 5 to 300 $mg/m^2$ per 1 $m^2$ of the photosensitive material.

Also, the emulsion surface may have such a degree of matting that a so-called stardust trouble in which small deletion occurs in the image area to generate light leakage is not caused. The degree of matting is preferably from 30 seconds to 2,000 seconds, and especially preferably from 40 seconds to 1,500 seconds in terms of the Bekk smoothness. The Bekk smoothness can be easily determined according to Japanese Industrial Standards (JIS) P8819: "Test method for smoothness of paper and paper board using a Bekk smoothness tester" and the TAPPI Standard Method T479.

In this embodiment, the back layer preferably has a degree of matting of from 10 seconds to 1,200 seconds, more preferably from 20 seconds to 800 seconds, and further preferably from 40 seconds to 500 seconds in terms of the Bekk smoothness.

In this embodiment, it is preferable that the matting agent is contained in an outermost surface layer or a layer functioning as an outermost surface layer of the photosensitive material, or a layer close to the external surface and contained in a layer acting as the so-called protective layer.

5) Polymer Latex:

A polymer latex can be added in the surface protective layer or back layer of this embodiment.

Such a polymer latex is described in, for example, *Synthetic Resin Emulsions* (compiled by Taira Okuda and Hiroshi Inagaki and published by Kobunshi Kankokai (1978)), *Application of Synthetic Latices* (compiled by Takaaki Sugimura, Yasuo Kataoka, Soichi Suzuki, and Keishi Kasahara and published by Kobunshi Kankokai (1993)), and *Chemistry of Synthetic Latices* (written by Soichi Muroi and published by Kobunshi Kankokai (1970)). Specific examples thereof include a latex of a methyl methacrylate (33.5% by weight)/ethyl acrylate (50% by weight)/methacrylic acid (16.5% by weight) copolymer, a latex of a methyl methacrylate (47.5% by weight)/butadiene (47.5% by weight)/itaconic acid (5% by weight) copolymer, a latex of an ethyl acrylate/methacrylic acid copolymer, a latex of a methyl methacrylate (58.9% by weight)/2-ethylhexyl acrylate (25.4% by weight)/styrene (8.6% by weight)/2-hydroxyethyl methacrylate (5.1% by weight)/acrylic acid (2.0% by weight) copolymer, and a latex of a methyl methacrylate (64.0% by weight)/styrene (9.0% by weight)/butyl acrylate (20.0% by weight)/2-hydroxyethyl methacrylate (5.0% by weight)/acrylic acid (2.0% by weight) copolymer.

The polymer latex is preferably used in an amount of from 10% by weight to 90% by weight, and especially preferably from 20% by weight to 80% by weight of the whole of binders (including the water-soluble polymer and latex polymer) of the surface protective layer or back layer.

6) Film Surface pH:

The photothermographic material of this embodiment preferably has a film surface pH before the thermal development processing of not more than 7.0, and more preferably not more than 6.6. Though its lower limit is not particularly limited, it is about 3. The most preferred pH range is in the range of from 4 to 6.2.

In adjusting the film surface pH, it is preferred from the viewpoint of reducing the film surface pH to use a non-volatile acid such as organic acids such as phthalic acid derivatives and sulfuric acid, or a volatile base such as ammonia. In particular, ammonia is preferable in achieving the low film surface pH because it is readily volatilized and can be removed in the coating step or before the thermal development. Also, it is also preferred to use a non-volatile base such as sodium hydroxide, potassium hydroxide, and lithium hydroxide together with ammonia. Incidentally, the measurement method of the film surface pH is described in paragraph No. 0123 of Japanese Patent Application No. 11-87297.

7) Hardening Agent:

In this embodiment, a hardening agent may be used in the respective layers including the photosensitive layer, the protective layer, and the back layer.

Examples of the hardening agent are described on pages 77 to 87 of T. H. James, *THE THEORY OF THE PHOTOGRAPHIC PROCESS, FOURTH EDITION*, Macmillan Publishing Co., Inc. (1977), including chromium alum, 2,4-dichloro-6-hydroxy-s-triazine sodium salt, N,N-ethylenebis(vinylsulfonacetamide), N,N-propylenebis(vinylsulfonacetamide), and polyvalent metal ions described on page 78 of ibid. Also, polyisocyanates described in U.S. Pat. No. 4,281,060 and JP-A-6-208193, epoxy compounds described in U.S. Pat. No. 4,791,042, and vinyl sulfone based compounds described in JP-A-62-89048 are preferably used.

The hardening agent is added as a solution. The timing of adding this solution to a coating solution for protective layer is from 180 minutes before coating to immediately before coating, and preferably from 60 minutes before coating to 10 seconds before coating. The mixing method and mixing condition are not particularly limited so far as the effects of this embodiment are sufficiently revealed.

Specific examples of the mixing method include a method in which mixing is carried out in a tank so as to set up a mean residence time calculated from the addition flow amount and the solution feed amount into a coater at a desired time and a method of using a static mixer described in Chapter 8 of *Fluid Mixing Technology*, written by N. Harnby, M. F. Edwards and A. W. Nienow and translated by Koji Takahashi (published by Nikkan Kogyo Shimbun, Ltd., 1989).

8) Surfactant:

A surfactant that can be applied to this embodiment is described in paragraph No. 0132 of JP-A-11-65021.

In this embodiment, it is preferred to use a fluorine based surfactant. Preferred examples of the fluorine based surfactant include compounds described in JP-A-10-197985, JP-A-2000-19680, and JP-A-2000-214554. Also, high-molecular fluorine based surfactants described in JP-A-9-281636 are preferably used. In this embodiment, the use of fluorine based surfactants described in Japanese Patent Application No. 2000-206560 is especially preferable.

9) Antistatic Agent:

Also, in this embodiment, an antistatic layer containing a variety of known metal oxides or conductive polymers may be provided. The antistatic layer may also serve as the foregoing undercoating layer, back layer or surface protective layer or may be provided separately. With respect to the antistatic layer, technologies described in paragraph No. 0135 of JP-A-11-65021, JP-A-56-143430, JP-A-56-143431, JP-A-58-62646, JP-A-56-120519, paragraph Nos. 0040 to 0051 of JP-A-11-84573, U.S. Pat. No. 5,575,957, and paragraph Nos. 0078 to 0084 of JP-A-11-223898 can be applied.

10) Support:

For the purposes of relieving an internal strain remaining in the film at the time of biaxial stretching and a heat contraction strain generated during the thermal development processing, polyesters having been thermally processed within the temperature range of from 130 to 185° C., especially polyethylene terephthalate, are preferably used as a transparent support.

As a support of the photothermographic material that is used in combination with an ultraviolet emitting screen, PEN can be preferably used. However, it should not be construed that this embodiment is limited thereto. As PEN, an polyethylene-2,6-napthalate is preferable. In this embodiment, the polyethylene-2,6-napthalate as referred to herein may be any polymer in which a repeating structural unit thereof is substantially constructed of an ethylene-2,6-naphthalenedicaboxylate unit and includes not only non-copolymerized polyethylene-2,6-naphthalenedicarboxylate but also copolymers in which not more than 10%, and preferably not more than 5% of the number of repeating structural units is modified with other component, mixtures of other polymers, and compositions.

The polyethylene-2,6-naphthalate is synthesized by binding naphthalene-2,6-dicarboxylic acid or a functional derivative thereof with ethylene glycol or a functional derivative thereof in the presence of a catalyst under adequate reaction conditions. In this embodiment, the polyethylene-2,6-naphthalate as referred to herein may be a polyester prepared by copolymerization or mixing by adding adequate one or two or more kinds of third components (modifying agents) prior to completion of the polymerization of this polyethylene-2,6-naphthalate. Examples of the adequate third components include compounds inclusive of divalent ester-forming functional group-containing compounds, for example, dicarboxylic acids (such as oxalic acid, adipic acid, phthalic acid, isophthalic acid, terephthalic acid, naphthalene-2,7-dicarboxylic acid, succinic acid, and diphenyl ether dicarboxylic acid) or lower alkyl esters thereof; hydroxycarboxylic acids (such as p-hydroxybenzoic acid and p-hydroxyethoxybenzoic acid) or lower alkyl esters thereof; and divalent alcohols (such as propylene glycol and trimethylene glycol). The polyethylene-2,6-naphthalate or modified polymers thereof may be one in which the terminal hydroxyl group and/or carboxyl group is hindered by a monofunctional compound such as benzoylbenzoic acid, benzyloxybenzoic acid, and methoxypolyalkylene glycols, or one modified within the range where a substantially linear copolymer is obtained using an extremely small amount of a trifunctional or tetrafunctional ester forming compound such as glycerin and pentaerythritol.

In the case of a medical photothermographic material, the transparent support may be colored with a blue dye (for example, Dye-1 described in the working examples of JP-A-8-240877) or may be non-colored.

Specific examples of the support are described in paragraph No. 0134 of JP-A-11-65021.

It is preferable that undercoating technologies with, for example, a water-soluble polyester described in JP-A-11-84574, a styrene-butadiene copolymer described in JP-A-10-186565, or a vinylidene chloride copolymer described in JP-A-2000-39684 and paragraph Nos. 0063 to 0080 of Japanese Patent Application No. 11-106881 are applied to the support.

11) Other Additives:

An antioxidant, a stabilizing agent, a plasticizer, an ultraviolet absorbing agent, or a coating aid may be added to the photothermographic material. A solvent described in paragraph No. 0133 of JP-A-11-65021 may be added. The various additives are added in either one of the photosensitive layer or the non-photosensitive layer. With respect to these matters, WO 98/36322, EP803764A1, JP-A-10-186567, JP-A-10-18568, etc. can be made hereof by reference.

12) Coating mode:

In this embodiment, the photothermographic material may be coated by any method. Concretely, a variety of coating operations including extrusion coating, slide coating, curtain coating, dip coating, knife coating, flow coating, and extrusion coating using various hoppers described in U.S. Pat. No. 2,681,294 are employable. Of these operations, extrusion coating or slide coating described on pages 399 to 536 of Stephen F. Kistler and Peter M. Schweizer, *LIQUID FILM COATING* (published by CHAPMAN & HALL, 1997) is preferable, and slide coating is especially preferable.

Examples of the shape of a slide coater to be used for the slide coating are described in FIG. 11b.1 on page 427 of ibid. Also, if desired, two layers or more layers can be coated at the same time according to methods described on pages 399 to 536 of ibid. and methods described in U.S. Pat. No. 2,761,791 and British Patent No. 837,095.

In this embodiment, it is preferable that a coating solution for organic silver salt-containing layer is a so-called thixotropic fluid. With respect to this technology, JP-A-11-52509 can be made hereof by reference.

In this embodiment, the coating solution for organic silver salt-containing layer preferably has a viscosity of from 400 mPa·s to 100,000 mPa·s, and more preferably from 500 mPa·s to 20,000 mPa·s at a shear rate of 0.1 $S^{-1}$.

Also, the viscosity of the coating solution for organic silver salt-containing layer is from 1 mPa·s to 200 mPa·s, and more preferably from 5 mPa·s to 80 mPa·s at a shear rate of 1,000 $S^{-1}$.

13) Packaging Material:

For the purpose of preventing the change in quality of the photographic performance at the time of preservation before the use, or preventing curling or falling into the habit of winding occurred in the case of a product in the rolled state, it is preferable that the photothermographic material of this embodiment is sealed and packaged by a packaging material having low oxygen permeability and/or moisture permeability. The oxygen permeability is preferably not more than 50 mL/atm/$m^2$·day, more preferably not more than 10 mL/atm/$m^2$·day, and further preferably not more than 1.0 mL/atm/$m^2$·day at 25° C. The moisture permeability is preferably not more than 10 g/atm/$m^2$·day, more preferably not more than 5 g/atm/$m^2$·day, and further preferably not more than 1 g/atm/$m^2$·day. As specific examples of the packaging material having low oxygen permeability and/or moisture permeability, those described in JP-A-8-254793 and JP-A-2000-206653 can be utilized.

14) Other Applicable technologies:

As technologies that can be applied to the photothermographic material of this embodiment, there are enumerated those described in EP803764A1, EP883022A1, WO 98/36322, JP-A-56-62648, JP-A-58-62644, JP-A-9-43766, JP-A-9-281637, JP-A-9-297367, JP-A-9-304869, JP-A-9-311405, JP-A-9-329865, JP-A-10-10669, JP-A-10-62899, JP-A-10-69023, JP-A-10-186568, JP-A-10-90823, JP-A-10-171063, JP-A-10-186565, JP-A-10-186567, JP-A-10-186569, JP-A-10-186570, JP-A-10-186571, JP-A-10-1865672, JP-A-10-197974, JP-A-10-197982, JP-A-10-197983, JP-A-10-197985, JP-A-10-197986, JP-A-10-197987, JP-A-10-207001, JP-A-10-207004, JP-A-10-221807, JP-A-10-282601, JP-A-10-288823, JP-A-10-288824, JP-A-10-307365, JP-A-10-312038, JP-A-10-339934, JP-A-11-7100, JP-A-11-15105, JP-A-11-24200, JP-A-11-24201, JP-A-11-30832, JP-A-11-84574, JP-A-11-65021, JP-A-11-109547, JP-A-11-125880, JP-A-11-129629, JP-A-11-133536, JP-A-11-133537, JP-A-11-133538, JP-A-11-133539, JP-A-11-133542, JP-A-11-133543, JP-A-11-223898, JP-A-11-352627, JP-A-11-305377, JP-A-11-

305378, JP-A-11-305384, JP-A-11-305380, JP-A-11-316435, JP-A-11-327076, JP-A-11-339096, JP-A-11-338098, JP-A-11-338099, JP-A-11-343420, and Japanese Patent Application Nos. 2000-187298, 2000-10229, 2000-47345, 2000-206642, 2000-98530, 2000-98531, 2000-112059, 2000-112060, 2000-112104, 2000-112064 and 2000-171936.

15) Color Image Formation:

The construction of a multicolor photothermographic material may contain a combination of two layers with respect to each color. Also, all of the components may be contained in a single layer as described in U.S. Pat. No. 4,708,928.

In the case of a multicolor photothermographic material, the respective emulsion layers are in general distinguished from each other and held by using a functional or non-functional barrier layer between the respective photosensitive layers as described in U.S. Pat. No. 4,460,681.

3. Image Forming Method:

3-1. Exposure:

The photothermographic material of this embodiment may be of a "single-sided type" having an image forming layer on only one surface of the support or a "double-sided type" having an image forming layer on the both surfaces of the support.

(Double-sided Type Photothermographic Material)

The photothermographic material of this embodiment can be preferably used in the image forming method of recording an X-ray image using an X-ray intensifying screen.

The step of forming an image using such a photothermographic material comprises the following steps.

(a) A step of placing the photothermographic material between a pair of X-ray intensifying screens to obtain an image forming assembly;
(b) A step of aligning a subject between the assembly and an A-ray source;
(c) A step of irradiating the subject with an X-ray having an energy level in the range of from 25 kVp to 125 kVp;
(d) A step of discharging the photothermographic material from the assembly; and
(e) A step of heating the discharged photothermographic material at a temperature in the range of from 90° C. to 180° C.

With respect to the photothermographic material that is used in the assembly in this embodiment, it is preferable that an image obtained by stepwise exposure with X-rays and thermal development is prepared so as to have a characteristic curve such that in the characteristic curve on orthogonal coordinates having equal unit lengths of coordinate axes of optical density (D) and exposure amount (log E), a mean gamma (γ) formed by a point of {[minimum density (Dmin)]+(density: 0.1)} and a point of {[minimum density (Dmin)]+(density: 0.5) } is from 0.5 to 0.9, and a mean gamma (y) formed by a point of {[minimum density (Dmin)]+(density: 1.2) } and a point of {[minimum density (Dmin)]+(density: 1.6) } is from 3.2 to 4.0. In the radiographic system of this embodiment, when a photothermographic material having the foregoing characteristic curve is used, there is obtained an X-ray image having an excellent photographic characteristic such that the leg part is very extended and that the gamma is high in the intermediate density part. Due to this photographic characteristic, there give rise to advantages such that the registration property of low density regions where the X-ray transmission amount is small, such as mediastinal part and heart shadow, becomes good, that the density becomes readily visual in images of lung field where the X-ray transmission amount is large, and that the contrast becomes good.

For example, a photothermographic material having the foregoing preferred characteristic curve can be easily produced in a method in which respective image forming layers on the both sides are constructed of two or more layers of silver halide emulsion layers having a different sensitivity from each other. In particular, it is preferred to form image forming layers using a high-speed emulsion in the upper layer and a low-speed emulsion having a contrasty photographic characteristic in the lower layer. In the case of using such an image forming layer comprising two layers, a difference in the sensitivity of silver halide emulsion between the respective layers is from 1.5 times to 20 times, and preferably from 2 times to 15 times. Incidentally, a ratio of the amount of the emulsion to be used for forming each layer varies depending upon a difference of the sensitivity and a covering power of the emulsion to be used. In general, as the difference of the sensitivity is large, a ratio of the emulsion to be used in the high-speed side is decreased. For example, when the difference of the sensitivity is 2 times, in the case where the covering power is substantially equal, a ratio of the respective emulsions to be used is adjusted such that a ratio of the high-speed emulsion to the low-speed emulsion falls within the range of from 1/20 to 1/50 in terms of the silver amount.

With respect to technologies of crossover cut (double-sided photosensitive material and anti-halation (single-sized photosensitive material), dyes, or dyes and mordants described at page 13, left lower column, line 1 to page 24, left lower column, line 9 of JP-A-2-68539 can be employed.

Next, a fluorescent intensifying screen (radiographic intensifying screen) of this embodiment will be described below. The radiographic intensifying screen comprises a support and a fluorescent material layer formed on one side thereof as a basic structure. The fluorescent material layer is a layer having a fluorescent material dispersed in a binder. Incidentally, a transparent protective film is in general provided on the surface of the support in the opposite side to the fluorescent material layer (surface in the side not faced at the support), thereby protecting the fluorescent material layer from a chemical change in quality or a physical impact.

In this embodiment, the following fluorescent materials are preferable. That is, examples thereof include tungstate based fluorescent materials (for example, $CaWO_4$, $MgWO_4$, and $CaWO_4$:Pb), terbium-activated rare earth acid sulfide based fluorescent materials [for example, $Y_2O_2S$:Tb, $Gd_2O_2S$:Tb, $La_2O_2S$:Tb, $(Y,Gd)_2O_2S$:Tb, and (Y,Gd) $O_2S$: Tb, Tm], terbium-activated rare earth phosphate based fluorescent materials (for example, $YPO_4$:Tb, $GdPO_4$:Tb, and $LaPO_4$:Tb), terbium-activated rare earth oxyhalide based fluorescent materials (for example, LaOBr:Tb, LaOBr:Tb, Tm, LaOCl:Tb, LaOCl:Tb,Tm, LaOBr:Tb, GdOBr:Tb, and GdOCl:Tb), thulium-activated rare earth oxyhalide based fluorescent materials (for example, LaOBr:Tm and LaOCl: Tm), barium sulfate based fluorescent materials [for example, $BaSO_4$:Pb, $BaSO_4$:$Eu^{2+}$, and $(Ba,Sr)SO_4$:$Eu^{2+}$], divalent europium-activated alkaline earth metal phosphate based fluorescent materials [for example, $(Ba_2PO_4)_2$:$Eu^{2+}$ and $(Ba_2PO_4)_2$:$Eu^{2+}$], divalent europium-activated alkaline earth metal fluorohalide based fluorescent materials [for example BaFCl:$Eu^{2+}$, BaFBr:$Eu^{2+}$, BaFCl:$Eu^{2+}$,Tb, BaFBr: $Eu^{2+}$,Tb, $BaF_2$·BaCl·KCl:$Eu^{2+}$, and (Ba,Mg) $F_2$·BaCl·KCl: $Eu^{2+}$], iodide based fluorescent materials (for example, CsI:Na, CsI:Tl, NaI, and KI:Tl), sulfide based fluorescent materials [for example, ZnS:Ag, (Zn,Cd)S:Ag, (Zn,Cd)S:

Cu, and (Zn,Cd)S:Cu,Al], hafnium phosphate based fluorescent materials (for example, $HfP_2O_7$:Cu), and $YTaO_4$ and those having added a variety of activating agents thereto as a light emission center. However, it should not construed that the fluorescent material to be used in this embodiment is limited thereto. Any fluorescent materials exhibiting light emission in the visible or near ultraviolet regions upon irradiation with radiations can be employed.

In the fluorescent intensifying screen to be used in this embodiment, it is preferable that the fluorescent material is filled in the inclined particle size structure. In particular, it is preferable that fluorescent particles having a large particle size are coated in the side of the surface proactive layer and that fluorescent particles having a small particle size are coated in the side of the support. The fluorescent particles having a small particle size have a particle size in the range of from 0.5 to 2.0 μm, and those having a large particle size have a particle size in the range of from 10 to 30 μm.

(Single-sided Type Photothermographic Material)

In particular, it is preferred to use a single-sided type photothermographic material in this embodiment as an X-ray photographic material for mammography.

It is important that the single-sided type photothermographic material to be used for this purpose is designed such that the contrast of the resulting image falls within an adequate range.

With respect to the construction requirements preferred as an X-ray photographic material for mammography, descriptions of JP-A-5-45807, JP-A-10-62881, JP-A-10-54900 and JP-A-11-109564 can be made hereof by reference.

(Combination with Ultraviolet Fluorescent Screen)

As the image forming method using the photothermographic material of this embodiment, a method of forming an image by combining with a fluorescent material having a main peak at not longer than 400 nm can be preferably employed. A method of forming an image by combining a fluorescent material having a main peak at no longer than 380 nm is more preferable. All of double-sided photographic materials and single-sided photographic materials can be used as an assembly. As a screen having a main light-emitting peak at not longer than 400 nm, screens described in JP-A-6-11804 and WO 93/01521 are employed, but it should not be construed that this embodiment is limited thereto. With respect to technologies of crossover cut (double-sided photosensitive material and anti-halation (single-sized photosensitive material), technologies described in JP-A-8-76307 can be employed. As ultraviolet absorbing dyes, dyes described in Japanese Patent Application No. 2000-320809 are especially preferable.

3-2. Thermal Development:

Though the photothermographic material of this embodiment may be developed by any method, in general, an imagewise exposed photothermographic material is developed by raising the temperature. The development temperature is preferably from 80 to 250° C., and more preferably from 100 to 140° C.

The development time is preferably from 1 to 60 seconds, more preferably from 5 to 30 seconds, and especially preferably from 5 to 20 seconds.

As the thermal development mode, a plate heater mode may be employed in addition to a mode using the thermal development apparatus according to the invention. As the thermal development mode by the plate heater mode, a method described in JP-A-11-133572 is preferable. This mode is concerned with a thermal development apparatus in which a photothermographic material having a latent image formed therein is brought into contact with a heating unit in the thermal development part to obtain a visible image. This thermal development apparatus is characterized in that the heating unit is composed of a plate heater, that the plural number of press rolls are aligned oppositely to each other along one side of the plate heater, and that the photothermographic material is passed between the press roll and the plate heater to perform thermal development. It is preferable that the plate heater is divided into from two to six stages, with the temperature of the front end being reduced by from about 1 to 10° C.

Such a method is described in JP-A-54-30032, and the moisture and organic solvent contained in the photothermographic material can be removed out the system. Also, it is possible to suppress a change of the shape of the support of the photothermographic material caused when the photothermographic material is abruptly heated.

3-3. System:

In addition to the thermal development apparatus according to the invention, there is enumerated Fuji Medical Dry Imager FM-DPL as a medical laser imager provided with an exposing section and a thermal development section. This system is described in *Fuji Medical Review*, No. 8, pages 39 to 55, and those technologies can be utilized. Also, this system can be applied as a photothermographic material for laser imager in "AD Network" proposed by Fujifilm Medical Co., Ltd. as a network system adapted for the DICOM Standards.

4. Application of this Embodiment:

The photothermographic material using a high-silver iodide photographic emulsion of this embodiment forms a black-and-white image by silver images and is preferably used as a photothermographic material for medical diagnosis, a photothermographic material for industrial photography, a photothermographic material for printing, or a photothermographic material for COM.

The foregoing photothermographic material will be specifically described below with reference to the following Examples, but it should not be construed that the photothermographic material of this embodiment is limited thereto.

EXAMPLES

Example 1

1. Preparation of PET Support and Undercoating:

1-1. Film Formation:

Using terephthalic acid and ethylene glycol, PET having an intrinsic viscosity, IV=0.66 (measured in phenol/tetrachloroethane=6/4 (by weight) at 25° C.) was obtained in the customary manner. PET was pelletized and then dried a 130° C. for 4 hours. The resulting pellets were dyed blue with a blue dye (1,4-bis(2,6-diethylanilino)anthraquinone) and then quenched by extruding from a T-die to prepare a non-stretched film.

This film was stretched 3.3 times in the machine direction using rolls having a different peripheral speed and then stretched 4.5 times in the transverse direction using a tenter. At this time, the temperature was 110° C. and 130° C., respectively. Thereafter, the resulting film was thermally fixed at 240° C. for 20 seconds and then relieved by 4% in the transverse direction at the same temperature. Thereafter, the chuck part of the tenter was slit, the both ends were subjected to knurling, and the film was wound up at 4 kg/cm$^2$ to obtain a roll having a thickness of 175 μm.

1-2. Surface Corona Treatment:

The both surfaces of the support were treated at room temperature at 20 m/min using a solid state corona processor, 6KVA Model, manufactured by Piller. At this time, it was noted from the read values of current and voltage that the support was treated at 0.375 kV·A·min/m$^2$. At this time, the treatment frequency was 9.6 kHz, and a gap clearance between the electrode and the dielectric roll was 1.6 mm.

1-3. Preparation of Undercoated Support:

(1) Preparation of Coating Solution for Undercoating Layer:

Formulation [1] (for coating layer in the photosensitive layer side)

| | |
|---|---|
| PES Resin A-520, manufactured by Takamatsu Oil & Fat Co., Ltd. (30% by weight solution): | 46.8 g |
| Vylonal MD-1200, manufactured by Toyobo Co., Ltd.: | 10.4 g |
| Polyethylene glycol monononylphenyl ether (average number of ethylene oxide = 8.5) (1% by weight solution): | 11.0 g |
| MP-1000, manufactured by The Soken Chemical & Engineering Co., Ltd. (PMMA polymer fine particles, mean particle size: 0.4 μm): | 0.91 g |
| Distilled water: | 931 mL |

After subjecting the both surfaces of the foregoing biaxially stretched polyethylene terephthalate having a thickness of 175 μm to the foregoing corona discharge treatment, the foregoing formulation [1] of coating solution for undercoating was coated in a wet coating amount of 6.6 mL/m$^2$ (per one side) on the both surfaces using a wire bar and then dried at 180° C. for 5 minutes to prepare an undercoated support.

2. Preparation of Coating Material:

1) Silver Halide Emulsion:

<<Preparation of Silver Halide Emulsion A>>

4.3 mL of a 1% by weight potassium iodide solution was added to 1,421 mL of distilled water, to which were then added 3.5 mL of 0.5 moles/L sulfuric acid, 36.5 g of phthalated gelatin, and 160 mL of a methanol solution of 5% by weight 2,2'-(ethyleneditho)diethanol. To this solution, a solution A prepared by adding distilled water to 22.22 g of silver nitrate to dilute it to 218 mL and a solution B prepared by diluting 36.6 g of potassium iodide with distilled water to 366 mL were added by the controlled double jet method by adding the whole of the solution A at a fixed flow rate over 16 minutes and keeping the solution B at a pAg of 10.2, while keeping the liquid temperature at 75° C. with stirring in a stainless steel reaction vessel. Thereafter, 10 mL of a 3.5% by weight hydrogen peroxide aqueous solution was added, and 10.8 mL of a 10% by weight aqueous solution of benzimidazole was further added. Further, a solution C prepared by adding distilled water to 51.68 g of silver nitrate to dilute it to 508.2 mL and a solution D prepared by diluting 63.9 g of potassium iodide with distilled water to 639 mL were added by the controlled double jet method by adding the whole of the solution C at a fixed flow rate over 80 minutes and keeping the solution D at a pAg of 10.2. The whole of potassium hexachloroiridate(III) was added in an amount of $1\times10^{-4}$ moles per mole of silver 10 minutes after starting the addition of the solution C and the solution D. Also, 5 seconds after completion of the addition of the solution C, the whole of an aqueous solution of potassium hexacyanoferrate(II) was added in an amount of $3\times10^{-4}$ moles per mole of silver. The pH was adjusted at 3.8 using sulfuric acid having a concentration of 0.5 moles/L, and then, the stirring was stopped, followed by performing sedimentation/desalting/water washing steps. The pH was adjusted at 5.9 using sodium hydroxide having a concentration of 1 mole/L to prepare a silver halide dispersion having a pAg of 11.0.

The silver halide emulsion A was a pure silver iodide emulsion in which tabular grains having a mean projected area diameter of 0.93 μm, a coefficient of variation of the mean protected area diameter of 17.7%, a mean thickness of 0.057 am, and a mean aspect ratio of 16.3 accounted for 80% or more of the total projected area. A sphere-corresponding diameter was 0.42 μm. As a result of the X-ray powder diffraction analysis, 90% or more of silver iodide was present in the γ phase.

<<Preparation of Silver Halide Emulsion B>>

One mole of the AgI emulsion of tabular grains prepared in the silver halide emulsion A was charged in a reaction vessel. The pAg measured at 38° C. was 10.2. Next, a KBr solution of 0.5 moles/L and an $AgNO_3$ solution of 0.5 moles/L were added at 10 mL/min over 20 minutes by the double jet addition, thereby precipitating substantially 10% by mole of silver bromide on the AgI host emulsion in the epitaxial state. The pAg was kept at 10.2 during the operation. Further, the pH was adjusted at 3.8 using sulfuric acid having a concentration of 0.5 moles/L, and then, the stirring was stopped, followed by performing sedimentation/desalting/water washing steps. The pH was adjusted at 5.9 using sodium hydroxide having a concentration of 1 mole/L to prepare a silver halide dispersion having a pAg of 11.0.

The foregoing silver halide dispersion was kept at 38° C. while stirring, and 5 mL of a methanol solution of 0.34% by weight 1,2-benzoisothiazolin-3-one was added. After a lapse of 40 minutes, the temperature was raised to 47° C. Twenty minutes after temperature rising, a methanol solution of sodium benzenethiosulfonate was added in an amount of $7.6\times10^{-5}$ moles per mole of silver. After a lapse of 5 minutes, a methanol solution of a tellurium sensitizer C was added in an amount of $2.9\times10^{-5}$ moles per mole of silver, and the mixture was ripened for 91 minutes. Thereafter, 1.3 mL of a methanol solution of 0.8% by weight N,N'-dihydroxy-N"-diethylmelamine was added. After a lapse of 4 minutes, a methanol solution of 5-methyl-2-mercaptobenzimidazole in an amount of $4.8\times10^{-3}$ moles per mole of silver, a methanol solution of 1-phenyl-2-heptyl-5-mercapto-1,3,4-triazole in an amount of $5.4\times10^{-3}$ moles per mole of silver, and an aqueous solution of 1-(3-methylureidophenyl)-5-mercaptotetrazole in an amount of $8.5\times10^{-3}$ moles per mole of silver were added, respectively to prepare a silver halide emulsion B.

<<Preparation of Silver Halide Emulsion C>>

A silver halide emulsion C was prepared in the same manner as in the preparation of the silver halide emulsion A, except for properly changing the addition amount of the methanol solution of 5% by weight 2,2'-(ethyleneditho) diethanol, the temperature at the time of grain formation, and the addition time of the solution A. The silver halide emulsion C was a pure silver iodide emulsion in which tabular grains having a mean projected area diameter of 1.369 μm, a coefficient of variation of the mean protected area diameter of 19.7%, a mean thickness of 0.130μm, and a mean aspect ratio of 11.1 accounted for 80% or more of the total projected area. A sphere-corresponding diameter was 0.71 μm. As a result of the X-ray powder diffraction analysis, 90% or more of silver iodide was present in the γ phase.

<<Preparation of Silver Halide Emulsion D>>

A silver halide emulsion D containing 10% by mole of silver bromide in the epitaxial state was prepared in a manner exactly the same as in the preparation of the silver halide emulsion B, except for using the silver halide emulsion C.

<<Preparation of Mixed Emulsion for Coating Solution>>

The silver halide emulsion B and the silver halide emulsion D were dissolved in such an amount that the silver molar ratio was 5/1, and a 1% by weight aqueous solution of benzothiazolium iodide was added in an amount of $7\times10^{-3}$ moles per mole of silver. Further, compounds 1, 2 and 3, in each of which a one-electron oxidant formed when subjected to one-electron oxidation can release one electron or more electrons, were added in an amount of $2\times10^{-3}$ moles per mole of the silver halide, respectively.

Also, compounds 1, 2 and 3 each containing an adsorbing group and a reducing group were added in an amount of $8\times10^{-3}$ moles per mole of the silver halide, respectively.

Further, water was added such that the content of the silver halide was 15.6 g in terms of silver per liter of the mixed emulsion for coating solution.

2) Preparation of Fatty Acid Silver Dispersion:

<Preparation of Recrystallized Behenic Acid>

100 kg of Henkel's behenic acid (a product name: Edenor C22-85R) was mixed with 1,200 kg of isopropyl alcohol and dissolved at 50° C. After filtering with a 10-μm filter, the filtrate was cooled to 30° C. for recrystallization. In the recrystallization, the cooling speed was controlled at 3° C./hour. The resulting crystal was subjected to centrifugal filtration and applied and washed with 100 kg of isopropyl alcohol, followed by drying. The resulting crystal was esterified and subjected to GC-FID measurement. As a result, the crystal had a behenic acid content of 96% and also contained 2% of lignoceric acid, 2% of arachidic acid, and 0.001% of erucic acid.

<Preparation of Fatty Acid Silver Dispersion>

88 kg of recrystallized behenic acid, 422 L of distilled water, 49.2 L of an NaOH aqueous solution having a concentration of 5 moles/L, and 120 L of t-butyl alcohol were mixed, and the mixture was stirred for reaction at 75° C. for one hour to obtain a sodium behenate solution B. Separately, 206.2 L of an aqueous solution of 40.4 kg of silver nitrate (pH=4.0) was prepared and thermally insulated at 10° C. A reaction vessel charged with 635 L of distilled water and 30 L of t-butyl alcohol was thermally insulated at 30° C., and the whole of the foregoing sodium behenate solution and the whole of the silver nitrate aqueous solution were added at a fixed flow rate with though stirring over 93 minutes 15 seconds and 90 minutes, respectively. At this time, the addition of these solutions was scheduled in such a manner that during a period of time of 11 minutes after starting the addition of the silver nitrate aqueous solution, only the silver nitrate aqueous solution was added; that thereafter, the addition of the sodium behenate solution was started; and that a during a period of time of 14 minutes 15 seconds after completion of the addition of the silver nitrate aqueous solution, only the sodium behenate solution was added. At this time, the external temperature was controlled in such a manner that the temperature within the reaction vessel was set up at 30° C. and that the liquid temperature was constant. Also, a piping of the addition system of the sodium behenate solution was thermally insulated by circulating warm water into the outer side of double pipes, thereby adjusting the liquid temperature of an outlet of the tip of an addition nozzle at 75° C. Also, a piping of the addition system of the silver nitrate aqueous solution was thermally insulated by circulating cold water into the outer side of double pipes. The position of adding the sodium behenate solution and the position of adding the silver nitrate aqueous solution were symmetrically aligned while making the stirring axis as a center and adjusted in a height not so as to come into contact with the reaction liquid.

After completion of the addition of the sodium behenate solution, the mixture was stirred and allowed to stand at that temperature for 20 minutes, and the temperature was raised to 35° C. over 30 minutes, followed by ripening for 210 minutes. Immediately after completion of the ripening, a solid was separated out by centrifugal filtration and then washed with water until the filtrate had a conductivity of 30 μS/cm. There was thus obtained a fatty acid silver salt. The resulting solid was stored as a wet cake without drying.

The shape of the resulting silver behenate grains was evaluated by electron microscopic photography. As a result, the silver behenate grains were a crystal having a=0.21 μm, b=0.4 μm and c=0.4 μm in average, a mean aspect ratio of 2.1, and a coefficient of variation of sphere-corresponding diameter of 11% (a, b and c are defined in the specification).

19.3 kg of polyvinyl alcohol (a trade name: PVA-217) and water were added to the wet cake corresponding to 260 kg of the solid, to make the whole to 1,000 kg. Thereafter, the mixture was slurred using a dissolver blade and further preliminarily dispersed in a pipeline mixer (PM-10 Model, manufactured by Mizuho Industrial Co., Ltd.).

Next, the preliminarily dispersed stock solution was processed thrice while adjusting the pressure of a dispersion machine (a trade name: Microfluidizer M-610, manufactured by MFIC Corporation, using a Z type interaction chamber) at 1,150 kg/cm$^2$, to obtain a silver behenate dispersion. The cooling operation was carried out at a dispersion temperature of 18° C. by installing a coiled heat exchanger before and behind the interaction chamber to adjust the temperature.

3) Preparation of Reducing Agent Dispersion:

<<Preparation of Reducing Agent-1 Dispersion>>

10 kg of water was added to 10 kg of a reducing agent-1 (2,2'-methylenebis-(4-ethyl-6-tert-butylphenol) and 16 kg of a 10% by weight aqueous solution of modified polyvinyl alcohol (Poval MP203, manufactured by Kuraray Co., Ltd.) and well mixed to form a slurry. This slurry was sent using a diaphragm pump and dispersed for 3 hours in a horizontal sand mill (UVM-2, manufactured by Imex Co., Ltd.) filled with zirconia beads having a mean diameter of 0.5 mm, to which were then 0.2 g of benzoisothiazolinone sodium salt and water, thereby adjusting the concentration of the reducing agent at 25% by weight. This dispersion was heat treated at 60° C. for 5 hours to obtain a reducing agent-1 dispersion. The reducing agent particles contained in the thus obtained reducing agent dispersion had a median size of 0.40 μm and a maximum particle size of not more than 1.4 μm. The resulting reducing agent dispersion was filtered by a polypropylene-made filter having a pore size of 3.0 μm to remove foreign matters such as contaminants, and then stored.

<<Preparation of Reducing Agent-2 Dispersion>>

10 kg of water was added to 10 kg of a reducing agent-2 (6,6'-di-t-butyl-4,4'-dimethyl-2,2'-butylidenediphenol) and 16 kg of a 10% by weight aqueous solution of modified polyvinyl alcohol (Poval MP203, manufactured by Kuraray Co., Ltd.) and well mixed to form a slurry. This slurry was sent using a diaphragm pump and dispersed for 3 hours 30 minutes in a horizontal sand mill (UVM-2, manufactured by Imex Co., Ltd.) filled with zirconia beads having a mean diameter of 0.5 mm, to which were then 0.2 g of benzoisothiazolinone sodium salt and water, thereby adjusting the concentration of the reducing agent at 25% by weight. This dispersion was heated at 40° C. for 1 hour and subsequently heat treated at 80° C. for 1 hour to obtain a reducing agent-2 dispersion. The reducing agent particles contained in the thus obtained reducing agent dispersion had a median size of 0.50 μm and a maximum particle size of not more than 1.6 μm. The resulting reducing agent dispersion was filtered by a polypropylene-made filter having a pore size of 3.0 μm to remove foreign matters such as contaminants, and then stored.

4) Preparation of Hydrogen Bonding Compound Dispersion:

<<Preparation of Hydrogen Bonding Compound-1 Dispersion>>

10 kg of water was added to 10 kg of a hydrogen bonding compound-1 (tri(4-(t-butylphenyl)phosphineoxide) and 16 kg of a 10% by weight aqueous solution of modified polyvinyl alcohol (Poval MP203, manufactured by Kuraray Co., Ltd.) and well mixed to form a slurry. This slurry was sent using a diaphragm pump and dispersed for 4 hours in a horizontal sand mill (UVM-2, manufactured by Imex Co., Ltd.) filled with zirconia beads having a mean diameter of 0.5 mm, to which were then 0.2 g of benzoisothiazolinone sodium salt and water, thereby adjusting the concentration of the hydrogen bonding compound at 25% by weight. This dispersion was heated at 40° C. for 1 hour and subsequently heat treated at 80° C. for 1 hour to obtain a hydrogen bonding compound-1 dispersion. The hydrogen bonding compound particles contained in the thus obtained hydrogen bonding compound dispersion had a median size of 0.45 μm and a maximum particle size of not more than 1.3 μm. The resulting hydrogen bonding compound dispersion was filtered by a polypropylene-made filter having a pore size of 3.0 μm to remove foreign matters such as contaminants, and then stored.

5) Preparation of Development Accelerator Dispersion and Color Toner Dispersion:

<<Preparation of Development Accelerator-1 Dispersion>>

10 kg of water was added to 10 kg of a development accelerator-1 and 20 kg of a 10% by weight aqueous solution of modified polyvinyl alcohol (Poval MP203, manufactured by Kuraray Co., Ltd.) and well mixed to form a slurry. This slurry was sent using a diaphragm pump and dispersed for 3 hours 30 minutes in a horizontal sand mill (UVM-2, manufactured by Imex Co., Ltd.) filled with zirconia beads having a mean diameter of 0.5 mm, to which were then 0.2 g of benzoisothiazolinone sodium salt and water, thereby adjusting the concentration of the development accelerator at 20% by weight to obtain a development accelrator-1 dispersion. The development accelerator particles contained in the thus obtained development accelerator dispersion had a median size of 0.48 μm and a maximum particle size of not more than 1.4 μm. The resulting development accelerator dispersion was filtered by a polypropylene-made filter having a pore size of 3.0 μm to remove foreign matters such as contaminants, and then stored.

With respect to solid dispersions of development accerator-2 and color toner-1, dispersions having a concentration of 20% by weight and 15% by weight, respectively were prepared in the same manner as in the development accelerator-1.

6) Preparation of Polyhalogen Compound Dispersion:

<<Preparation of Organic Polyhalogen Compound-1 Dispersion>>

10 kg of an organic polyhalogen compound-1 (tribromomethanesulfonylbenzene), 10 kg of a 20% by weight aqueous solution of modified polyvinyl alcohol (Poval MP203, manufactured by Kuraray Co., Ltd.), 0.4 kg of a 20% by weight aqueous solution of sodium triisopropylnaphthalenesulfonate, and 14 kg of water were added and well mixed to form a slurry. This slurry was sent using a diaphragm pump and dispersed for 5 hours in a horizontal sand mill (UVM-2, manufactured by Imex Co., Ltd.) filled with zirconia beads having a mean diameter of 0.5 mm, to which were then 0.2 g of benzoisothiazolinone sodium salt and water, thereby adjusting the concentration of the organic polyhalogen compound at 30% by weight to obtain an organic polyhalogen compound-1 dispersion. The organic polyhalogen compound particles contained in the thus obtained polyhalogen compound dispersion had a median size of 0.41 μm and a maximum particle size of not more than 2.0 μm. The resulting organic polyhalogen compound dispersion was filtered by a polypropylene-made filter having a pore size of 10.0 μm to remove foreign matters such as contaminants, and then stored.

<<Preparation of Organic Polyhalogen Compound-2 Dispersion>>

10 kg of an organic polyhalogen compound-2 (N-butyl-3-tribromomethanesulfonylbenzamide), 20 kg of a 10% by weight aqueous solution of modified polyvinyl alcohol (Poval MP203, manufactured by Kuraray Co., Ltd.), and 0.4 kg of a 20% by weight aqueous solution of sodium triisopropylnaphthalenesulfonate were added and well mixed to form a slurry. This slurry was sent using a diaphragm pump and dispersed for 5 hours in a horizontal sand mill (UVM-2, manufactured by Imex Co., Ltd.) filled with zirconia beads having a mean diameter of 0.5 mm, to which were then 0.2 g of benzoisothiazolinone sodium salt and water, thereby adjusting the concentration of the organic polyhalogen compound at 30% by weight. This dispersion was heated at 40° C. for 5 hours to obtain an organic polyhalogen compound-2 dispersion. The organic polyhalogen compound particles contained in the thus obtained polyhalogen compound dispersion had a median size of 0.40 μm and a maximum particle size of not more than 1.3 μm. The resulting organic polyhalogen compound dispersion was filtered by a polypropylene-made filter having a pore size of 3.0 μm to remove foreign matters such as contaminants, and then stored.

7) Preparation of Silver Iodide Complex Forming Agent:

8 kg of modified polyvinyl alcohol MP203 was dissolved in 174.57 kg of water, to which were then added 3.15 kg of a 20% by weight aqueous solution of sodium triisopropylnaphthalenesulfonate and 14.28 kg of a 70% by weight aqueous solution of 6-isopropylphthalazine, to prepare a 5% by weight solution of a silver iodide complex forming agent compound.

8) Preparation of Mercapto Compound:

(Preparation of Mercapto Compound)

<<Preparation of Mercapto Compound-1 Aqueous Solution>>

7 g of a mercapto compound-1 (1-(3-sulfonyl)-5-mercaptotetrazole sodium salt) was dissolved in 993 g of water to prepare a 0.7% by weight aqueous solution.

<<Preparation of Mercapto Compound-2 Aqueous Solution>>

20 g of a mercapto compound-2 (1-(3-methylureidophenyl)-5-mercaptotetrazole) was dissolved in 980 g of water to prepare a 2.0% by weight aqueous solution.

9) Preparation of SBR Latex Solution:

<<Preparation of SBR Latex Solution>>

An SBR latex was prepared in the following manner.

A polymerizer of a gas monomer reaction device (TAS-2J Model, manufactured by Taiatsu Techno Corporation) was charged with 287 g of distilled water, 7.73 g of a surfactant (Pionin A-43-S, manufactured by Takemoto Oil & Fat Co., Ltd., solids content: 48.5%), 14.06 mL of 1 mole/L NaOH, 0.15 g of tetrasodium ethylenediaminetetraacetate, 255 g of styrene, 11.25 g of acrylic acid, and 3.0 g of tert-dodecyl mercaptan, and after sealing the reaction vessel, the mixture was stirred at a stirring rate of 200 rpm. Deaeration was carried out using a vacuum pump, and displacement with a nitrogen gas was repeated several times. Thereafter, 108.75 g of 1,3-butadiene was charged under pressure, and the internal temperature was raised to 60° C. Then, a solution having 1.875 g of ammonium persulfate dissolved in 50 mL of water was added, and the mixture was stirred for 5 hours as it was. Further, the temperature was raised to 90° C., and stirring was continued for 3 hours. After completion of the reaction, the internal temperature was dropped to room temperature, and the reaction mixture was subjected to addition processing using 1 mole/L of NaOH and $NH_4OH$ such that the molar ratio of $Na^+$ ion to $NH_4^+$ ion became 1/5.3, whereby the pH was adjusted at 8.4. Thereafter, the resulting reaction mixture was filtered by a polypropylene-made filter having a pore size of 1.0 μm to remove foreign matters such as contaminants, and then stored There was thus obtained 774.7 g of an SBR latex. As a result of measuring a halogen ion by ionic chromatography, the chloride ion concentration was 3 ppm. As a result of measurement by high-performance chromatography, the concentration of a chelating agent was 145 ppm.

The foregoing latex had a mean particle size of 90 nm, a Tg of 17° C., a solids content concentration of 44% by weight, an equilibrium water content at 25° C. and 60% RH of 0.6% by weight, an ion conductivity of 4.80 mS/cm (the ion conductivity was measured at 25° C. with respect to the latex stock solution (44% by weight) using a conductivity analyzer, CM-30S, manufactured by DKK-TOA CORPORATION), and a pH of 8.4. SBR latices having a different Tg can be prepared in the same manner by properly changing the ratio of styrene and butadiene.

1-3-2. Preparation of Coating Solution:

1) Preparation of Coating Solution-1 for Emulsion Layer (Photosensitive Layer):

The organic polyhalogen compound-1 dispersion, the organic polyhalogen compound-2 dispersion, the SBR latex (Tg: 17° C.) solution, the reducing agent-1 dispersion, the reducing agent-2 dispersion, the hydrogen bonding compound-1 dispersion, the development accelerator-1 dispersion, the development accelerator-2 dispersion, the color toner-1 dispersion, the mercapto compound-1 aqueous solution, and the mercapto compound-2 aqueous solution were successively added to 1,000 g of the above-obtained fatty acid silver dispersion and 276 mL of water. After adding the silver iodide complex forming agent, the mixed emulsion for silver halide coating solution was added in an amount of 0.22 moles per mole of the fatty acid silver immediately before coating, and the mixture was well mixed. The resulting mixture was sent to a coating die as it was and then coated.

The viscosity of the foregoing coating solution for emulsion layer was measured by a B type viscometer, manufactured by Tokimec Inc. and found to be 25 [mPa·s] at 40° C. (using a No. 1 rotor at 60 rpm).

The viscosity of the coating solution as measured at 25° C. using an RFS Fluid Spectrometer, manufactured by Rheometrics Far East was 242, 65, 48, 26 and 20 [mPa·s] at a shear rate of 0.1, 1, 10, 100 and 1,000 [1/sec], respectively.

The amount of zirconium in the coating solution was 0.52 mg per gram of silver.

2) Preparation of Coating Solution for Interlayer in the Emulsion Side:

27 mL of a 5% by weight aqueous solution of Aerosol OT (manufactured by American Cyanamid Company) and 135 mL of a 20% by weight aqueous solution of diammonium phthalate were added to 1,000 g of polyvinyl alcohol PVA-205 (manufactured by Kuraray Co., Ltd.) and 4,200 mL of a 19% by weight solution of a methyl methacrylate/styrene/butyl acrylate/hydroxyethyl methacrylate/acrylic acid copolymer (copolymerization weight ratio=64/9/20/5/2) latex, and water was further added in such a manner that the whole amount became 10,000 g. The mixture was adjusted with NaOH so as to have a pH of 7.5, to prepare a coating solution for interlayer, which was then sent to a coating die such that the coating amount was 9.1 mL/$m^2$.

The viscosity of this coating solution was measured at 40° C. by a B type viscometer (using a No. 1 rotor at 60 rpm) and found to be 58 [mPa·s].

3) Preparation of Coating Solution for First Protective Layer in the Emulsion Side:

64 g of inert gelatin was dissolved in water, to which were then added 112 g of a 19.0% by weight solution of a methyl methacrylate/styrene/butyl acrylate/hydroxyethyl methacrylate/acrylic acid copolymer (copolymerization weight ratio=64/9/20/5/2) latex, 30 mL of a 15% by weight methanol solution of phthalic acid, 23 mL of a 10% by weight aqueous solution of 4-methylphthalic acid, 28 mL of sulfuric acid having a concentration of 0.5 moles/L, 5 mL of a 5% by weight aqueous solution of Aerosol OT (manufactured by American Cyanamid Company), 0.5 g of phenoxyethanol, and 0.1 g of benzoisothiazolinone. Water was further added in such a manner that the whole amount became 750 g, to prepare a coating solution. This coating solution was mixed with 26 mL of 4% by weight chromium alum in a static mixer immediately before coating and sent to a coating die such that the coating amount was 18.6 mL/$m^2$.

The viscosity of this coating solution was measured at 40° C. by a B type viscometer (using a No. 1 rotor at 60 rpm) and found to be 20 [mPa·s].

4) Preparation of Coating Solution for Second Protective Layer in the Emulsion Side:

80 g of inert gelatin was dissolved in water, to which were then added 102 g of a 27.5% by weight solution of a methyl methacrylate/styrene/butyl acrylate/hydroxyethyl methacrylate/acrylic acid copolymer (copolymerization weight ratio=64/9/20/5/2) latex, 5.4 mL of a 2% by weight solution of a fluorine based surfactant (F-1), 5.4 mL of a 2% by weight aqueous solution of a fluorine based surfactant (F-2), 23 mL of a 5% by weight aqueous solution of Aerosol OT (manufactured by American Cyanamid Company), 4 g of polymethyl methacrylate fine particles (mean particle size: 0.7 μm, volume weighted average distribution: 30%), 21 g of polymethyl methacrylate fine particles (mean particle size: 3.6 μm, volume weighted average distribution: 60%), 1.6 g of 4-methylphthalic acid, 4.8 g of phthalic acid, 44 mL of sulfuric acid having a concentration of 0.5 moles/L, and 10 mg g of benzoisothiazolinone. Water was further added in such a manner that the whole amount became 650 g, and this mixture was mixed with 445 mL of an aqueous solution containing 4% by weight chromium alum and 0.67% by weight phthalic acid in a static mixer immediately before coating to prepare a coating solution for surface protective layer, which was then sent to a coating die such that the coating amount was 8.3 mL/$m^2$.

The viscosity of this coating solution was measured at 40° C. by a B type viscometer (using a No. 1 rotor at 60 rpm) and found to be 19 [mPa·s].

1-4. Preparation of Photothermographic Material-1:

An emulsion layer, an interlayer, a first protective layer, and a second protective layer were subjected to simultaneous multilayer coating in this order from the undercoated surface by the slide bead coating process, to prepare a photothermographic material sample. At this time, the temperature of each the emulsion layer and the interlayer was adjusted at 31° C., the temperature of the first protective layer was adjusted at 36° C., and the temperature of the second protective layer was adjusted at 37° C., respectively. The coating amount of silver of the image forming layer was 0.821 g/$m^2$ per one side in terms of the total amount of the fatty acid silver and the silver halide, and the image forming layer was provided on the both surfaces of the support.

The coating amount (g/$m^2$) of each of the compounds in the emulsion layer per one side is as follows.

| | |
|---|---|
| Silver behenate: | 2.80 |
| Polyhalogen compound-1: | 0.028 |
| Polyhalogen compound-2: | 0.094 |
| Silver iodide complex forming agent: | 0.46 |
| SBR latex: | 5.20 |
| Reducing agent-1: | 0.33 |
| Reducing agent-2: | 0.13 |
| Hydrogen bonding compound-1: | 0.15 |
| Development accelerator-1: | 0.005 |
| Development accelerator-2: | 0.035 |
| Color toner-1: | 0.002 |
| Mercapto compound-1: | 0.001 |
| Mercapto compound-2: | 0.003 |
| Silver halide (as Ag): | 0.146 |

The coating and drying conditions are as follows.

The support was subjected to destaticization by ionic wind before coating, and the coating was carried out at a speed of 160 m/min. The coating and drying conditions were adjusted every sample within the following ranges, and the conditions under which the most stable surface property was obtained were set up.

A gap between the tip of the coating die and the support was set up at from 0.10 to 0.30 mm.

The pressure of the vacuum chamber was set up at from 196 to 882 Pa lower than the atmospheric pressure.

In the subsequent chilling zone, the coating solution was cooled by a wind having a dry-bulb temperature of from 10 to 20° C.

The sample was traveled in the non-contact state and dried in a helical non-contact type dryer using a dry wind having a dry-bulb temperature of from 23 to 45° C. and a wet-bulb temperature of from 15 to 21° C.

After drying, the sample was humidified at 25° C. and at a humidity of from 40 to 60% RH.

Subsequently, the sample was heated such that the film surface reached from 70 to 90° C., and after heating, the film surface was cooled to 25° C.

The prepared photothermographic material had a degree of matting of 550 seconds in the photosensitive layer surface side and 130 seconds in the back surface side in terms of the Bekk smoothness. Also, the pH of the film surface of the photosensitive layer surface side was measured and found to be 6.0.

The chemical structures of the compounds used in the Example of this embodiment will be shown below.

Tellurium sensitizing agent C

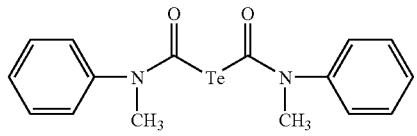

Compound 1 in which a one-electron oxidant formed upon one-electron oxidation can release one electron or more electrons

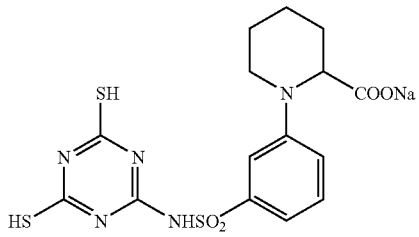

Compound 2 in which a one-electron oxidant formed upon one-electron oxidation can release one electron or more electrons

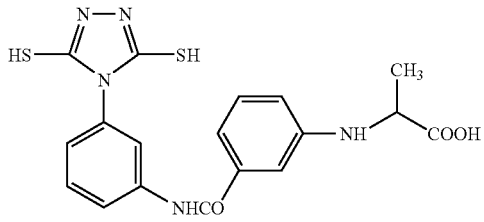

Compound 3 in which a one-electron oxidant formed upon one-electron oxidation can release one electron or more electrons

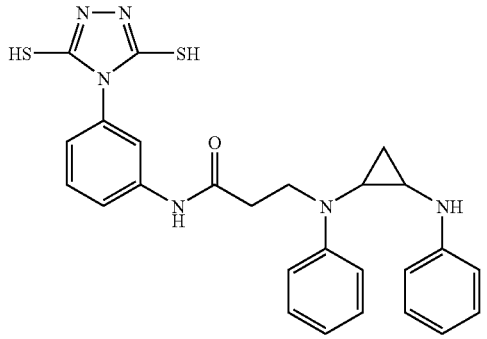

Compound 1 having an adsorbing group and a reducing group

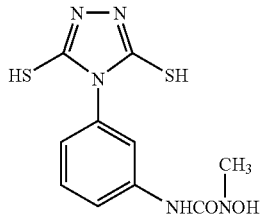

Compound 2 having an adsorbing group and a reducing group

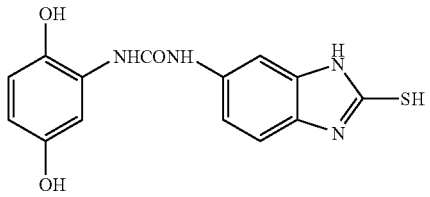

Compound 3 having an adsorbing group and a reducing group

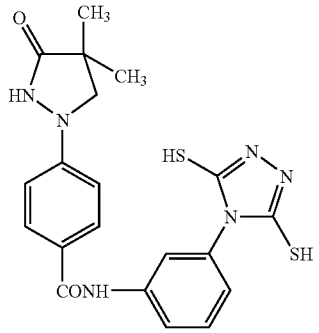

Reducing agent-1

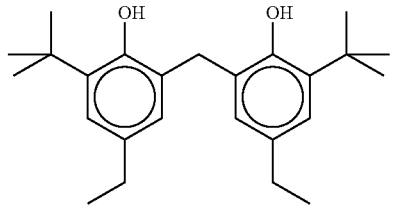

Reducing agent-2

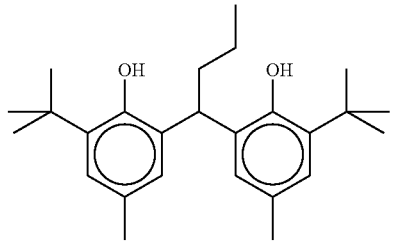

Hydrogen bonding compound-1

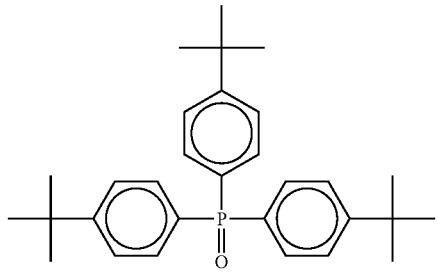

Polyhalogen compound-1

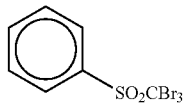

Polyhalogen compound-2

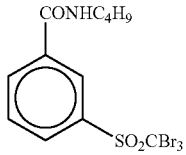

Mercapto compound-1

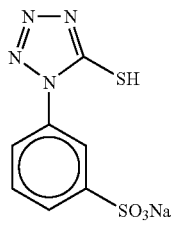

Mercapto compound-2

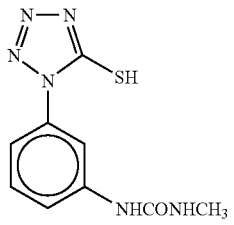

Silver iodide complex forming agent

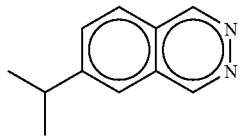

Development accelerator-1

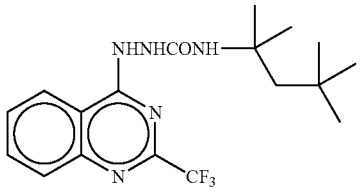

Development accelerator-2

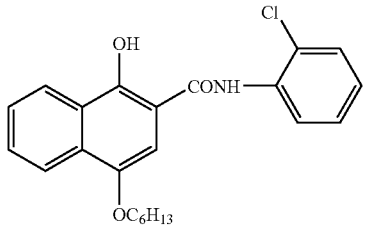

Color toner-1

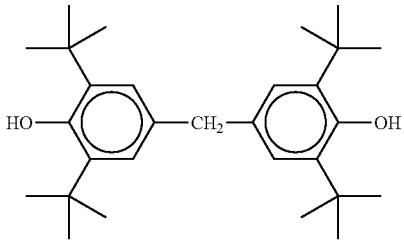

F-1

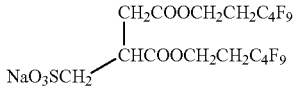

F-2

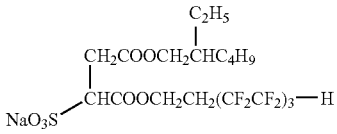

(Evaluation of Photographic Performance)

The resulting sample was cut into a size of 14 inch×17 inch, packaged by a packaging material in an atmosphere at 25° C. and 50%, and stored at the ambient temperature for two weeks. Therefore, the sample was evaluated in the following manner.

(Packaging Material)

A laminate of 10 μm of PET/12 μm of PE/9 μm of aluminum foil/15 μm of Ny/50 μm of polyethylene containing 3% of carbon, oxygen permeability: 0.02 mL/atm·$m^2$·day, moisture permeability: 0.10 g/atm·$m^2$·day The thus prepared double side-coated photosensitive material was evaluated in the following method.

The sample was put between two sheets of an R-ray regular screen, HI-SCREEN B3 (using $CaWO_4$ as a fluorescent material, light-emitting peak wavelength: 325 nm) manufactured by Fuji Photo Film Co., Ltd., to prepare an assembly for image formation. This assembly was subjected to X-ray sensitometry upon irradiation with X-rays for 0.05 seconds. The used X-ray device was DRX-3724HD, which is a trade name of Toshiba Corporation, and a tungsten target was used. A voltage of 80 kVp was applied using a three-phase pulse generator, and X-rays through a 7-cm filter having absorption substantially equivalent to a human body were used as a light source. The exposure amount of the X-rays was changed by the distance method, and stepwise exposure was carried out in a width of log E=0.15. After the exposure, the sample was thermally developed under the thermal development processing conditions by the thermal development apparatus according to the invention. The evaluation of the resulting image was carried out using a densitometer.

On the other hand, a regular photographic material, RX-U of a wet development mode, manufactured by Fuji Photo Film Co., Ltd. was exposed under the same conditions and processed for 45 seconds using an automatic processor, CEPROS-M2, manufactured by Fuji Photo Film Co., Ltd. and a processing liquid, CE-D1.

The image obtained from the thermally developable photosensitive material of this embodiment was compared with respect to the photographic property with the image obtained by the wet development mode. As a result, it was revealed that the both exhibited an equivalent good performance.

The present invention is not limited to the specific above-described embodiments. It is contemplated that numerous modifications may be made to the present invention without departing from the spirit and scope of the invention as defined in the following claims.

What is claimed is:

1. A thermal development apparatus for thermally developing a thermal developable recording material in a thermal development section, the thermal developable recording material having a latent image formed in advance, wherein the thermal development section comprises:

a heating member made of a porous body having a gas permeability, the heating member having a heating surface that is disposed so as to face a surface of the thermal developable recording material;

an air feed unit for feeding heated air to the thermal developable recording material through the heating member; and which further comprises a pressure reducing machine for sucking air within the pressure chamber and bringing the thermal developable recording material into contact with the heating surface.

2. A thermal development apparatus for thermally developing a thermal developable recording material in a thermal development section, the thermal developable recording material having a latent image formed in advance, wherein the thermal development section comprises:

a heating member made of a porous body having a gas permeability, the heating member having a heating surface that is disposed so as to face a surface of the thermal developable recording material;

an air feed unit for feeding heated air to the thermal developable recording material through the heating member; and wherein the heating surface is provided in one of an oblique and a vertical position against a horizontal direction, and the thermal development apparatus has a stopper for stopping the thermal developable recording material at a position opposite to the heating surface.

3. A thermal development process which performs a thermal development in a state that a traveling of a thermal developable recording material is stopped, the thermal developable recording material having a latent image formed in advance, wherein the thermal development process comprises performing the thermal development by sucking air through a porous member so that the porous member and the thermal developable recording material bring into contact with each other.

4. The thermal development process according to claim 3, which comprises performing the thermal development sequentially every region of the thermal developable recording material that is divided into at least two regions along a traveling direction of the thermal developable recording material.

* * * * *